United States Patent [19]

Hahn et al.

[11] Patent Number: 4,544,102

[45] Date of Patent: Oct. 1, 1985

[54] DIFFERENTIAL RATE SCREENING

[75] Inventors: William F. Hahn, Devon, Pa.; Hiramie T. McAdams, Williamsville, N.Y.

[73] Assignee: Penn Virginia Corporation, Philadelphia, Pa.

[21] Appl. No.: 366,965

[22] Filed: Apr. 9, 1982

[51] Int. Cl.[4] ..... B02C 23/14; B02C 23/16

[52] U.S. Cl. ..... 241/24; 241/76

[58] Field of Search ..... 209/263–265, 209/313, 315, 316, 317, 326; 241/24, 76, 80, 101.7

[56] References Cited

U.S. PATENT DOCUMENTS 2,617,532 11/1952 Gorton ..... 209/263 X 3,016,203 1/1962 Sears et al. ..... 241/80 X 3,409,235 11/1968 Quinn ..... 241/76

*Primary Examiner*—Howard N. Goldberg

*Assistant Examiner*—Timothy V. Eley

*Attorney, Agent, or Firm*—Pollock, Vande Sande & Priddy

[57] ABSTRACT

Disclosed are differential rate screening processes and apparatuses for continuously screening undersize particles in different size classes to different degrees of incompletion to provide a product having a preselected distribution of particle sizes substantially different from the distribution of particle sizes in a feed of particulate material. A stream of feed is introduced onto a screening member having apertures of sufficient size to pass a plurality of size classes, and is separated into at least a throughs stream and one other stream by causing undersize classes to pass through screen apertures and into a throughs stream in proportions relative to one another substantially different from the proportions of the same undersize classes relative to one another in the feed stream. A sufficient population of undersize particles are provided in each undersize class and differentials between relative proportions of undersize classes in the feed stream and relative proportions of undersize classes in the throughs stream are controlled so as to provide a product having substantially the desired particle size distribution. Various means are provided for causing differentials between relative proportions of undersize classes in the feed and relative proportions of undersize classes passing through the screening member and into the throughs stream, and for controlling these differentials.

79 Claims, 49 Drawing Figures

| SAMPLING AND GATING UNIT | FLOW LINES | | |
|---|---|---|---|
| | 1 | 2 | 3 |
| ON | SHUT | OPEN | SHUT |
| OFF | OPEN | SHUT | OPEN |

TOTAL FLOW

TOTAL FLOW

INDIVIDUAL SIZE CATEGORIES

INDIVIDUAL SIZE CATEGORIES

CUMULATIVE SIZE CATEGORIES

CUMULATIVE SIZE CATEGORIES

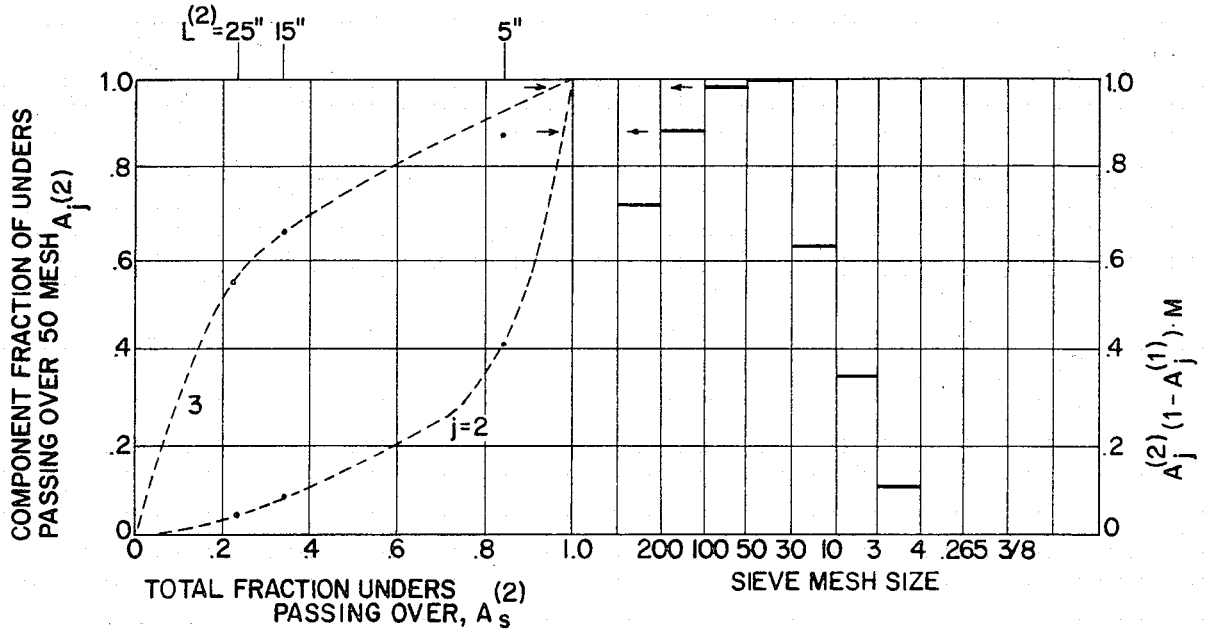
| KEY | j | MESH | j | MESH |
|---|---|---|---|---|
| | 7 | -4+8 | 3 | -50+100 |
| | 6 | -8+16 | 2 | -100+200 |
| | 5 | -16+30 | 1 | -200 |
| | 4 | -30+50 | | |
Fig. 24
Fig. 25
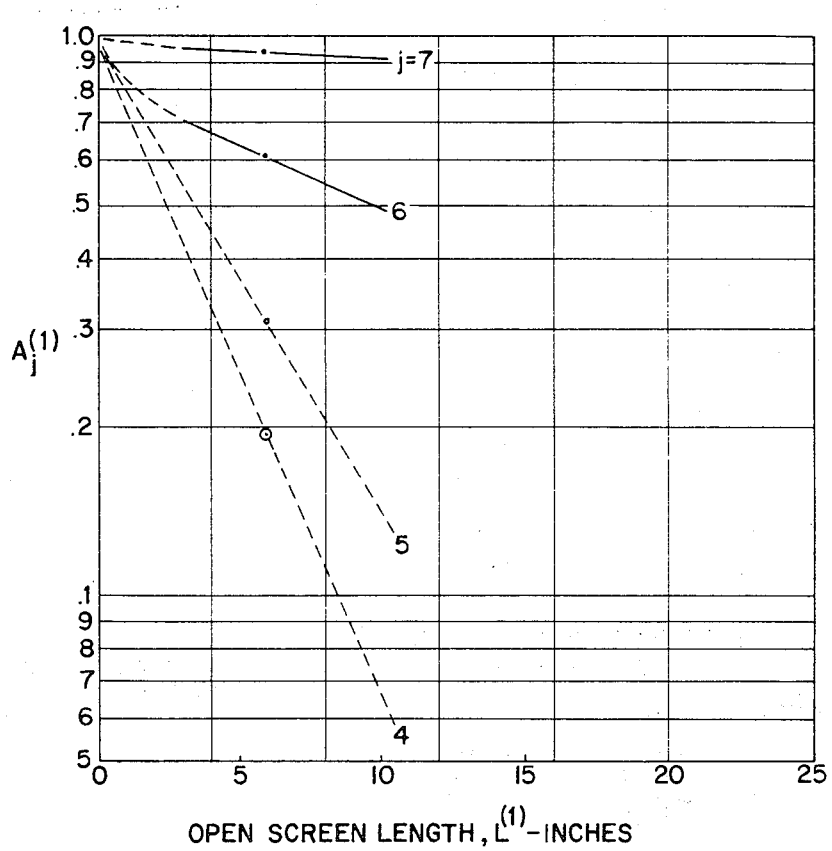

KEY:

| j | Mesh |
|---|---|
| 4 | -30+50 |
| 3 | -50+100 |
| 2 | -100+200 |
| 1 | -200 |

KEY:

| j | Mesh |
|---|---|
| 4 | -30+50 |
| 3 | -50+100 |
| 2 | -100+200 |
| 1 | -200 |

$L^{(1)}=6''$ $L^{(2)}=0''$

NOMINAL FEED RATES:
4.5 TPH
16.7 TPH

.0578 TPH/IN
$L^{(1)}$=6"

NOMINAL FEED RATE:
4.5 TPH

.156 TPH/IN
$L^{(1)}$ =6"

NOMINAL FEED RATE:
10.1 TPH

.244 TPH/IN
$L^{(2)} = 6"$

NOMINAL FEED RATE:
16.7 TPH

DIFFERENTIAL RATE SCREENING

RELATED APPLICATIONS AND TECHNICAL FIELD

The present application is related to another application on similar subject matter in the name of William F. Hahn, Hiramie T. McAdams and Robert L. Talley filed on Apr. 9, 1982, bearing Ser. No. 366,961. the entire contents of said other application being incorporated herein by reference. The present invention relates to the sizing particulates and more particularly to adjusting the size distribution of particulate materials, such as artificial stonesands, for specific applications, such as for use in concrete and asphalt compositions or as filter or molding sands.

BACKGROUND OF THE INVENTION

The present invention is applicable to adjusting the particle size distribution of all kinds of particulates, including sands, ores, minerals, powdered metals, seeds and grains. The invention is especially useful in obtaining a controlled gradation of crushed fine aggregate produced from quarried stone by crushing or grinding. Crushed fine aggregate is referred to in the art by various terms such as stone sand, crusher sand, crushed fine aggregate, specification sand or manufactured sand. In this specification, such crushed fine aggregate is referred to as "stonesand". An accepted standard for stonesand used in concrete is set forth in Standard Specification C-33 for Concrete Aggregates as published by the American Society for Testing and Materials (ASTM). Stonesand may be produced from almost all rock types which are commonly quarried to make coarse aggregate for roadbeds and the like. As natural sand deposits become depleted or unavailable through land development, the demand for stonesand has increased in recent years.

There are basically two different types of crushers for the rock types yielding stonesand. Jaw, gyratory and cone crushing are compression types depending upon compression (squeezing), friction and/or attrition between particles to break down the larger rock particles. Roll, rod mill, hammer mill and centrifugal are impact types which rely largely upon impact (hitting) for breakage. Depending on the rock type, the impact crushers generally produce a more cubical shaped particle than the compression crushers. Only limited control of particle shape or size can be realized in a communition process, especially in the smallest sizes produced, because of the tendency of breakage to occur along the surfaces of weakness dictated by the mineralogy of the material being crushed. Regardless of the type of crusher used, stonesand tends to be somewhat deficient in the intermediate particle size classes (No. 30 to No. 100 mesh), relative to sands which will satisfy the ASTM C-33 specification and to contain more fracture dust or fines (minus 100 mesh) than natural sands. On the other hand, the fractured cubical shape of some stonesand is capable of providing a concrete of higher strength and greater durability (more resistant to freezing and thawing deterioration) than some natural sands which are more rounded in shape.

In order to obtain good quality stonesands, it is therefore often necessary to remove at least a portion of the minus 100 and minus 200 mesh material, as well as some of the larger sizes near ⅜ inch mesh. To accomplish this and improve the overall gradation of stonesand, some type of classifer is usually employed. Classifiers are also generally of two types, namely wet classifiers and dry classifiers. Classification, whether by wet or dry processes, is possibly the single most important step in the production of a stonesand product of acceptable quality. Although wet classification systems generally produce more reproducible particle size distributions, such systems are of relatively low capacity per unit of capital cost and are relatively expensive to operate. On the other hand, dry classification systems of the prior art require that the aggregate feed be adequately populated in the particle sizes of interest and be uniform in moisture content because any significant variations, particularly in moisture content, will result in an output that does not meet the needed criteria. Excessive moisture content may also cause blinding of screen classifiers such that the required degree of passage of undersize particles through the screen is prevented by partial or complete blockage of the screen apertures.

Conventional approaches to producing a graded stonesand product often involve separating the crushed feed material into individual size fractions and then recombining two or more of those fractions in the proportions necessary to obtain the relative quantities of each fraction desired in a final product. The multiple processing stages required by these prior art approaches are time consuming and are not energy efficient. The necessity for blending two or more fractions often causes problems in handling the particulates and in adequately mixing the different size fractions to achieve the required uniformity in the final product.

Conventional classification of particulates with multiple screens may be in the form of batch sieving or continuous screening. In batch sieving, a stacked set of sieves are operated so as to provide particle exposure to the screen for a relatively long period of time that permits passage of nearly all (typically greater than 99 mass percent) of the undersize particles, i.e., those of a size capable of passing through a given screen. This is referred to in this patent specification as operating under complete separation conditions. A set of sieves operated in this manner will separate the batch feed into mass fractions corresponding to different size classes, where each size class consists of all particle sizes between the mesh sizes of two successive sieves (or screens). Each such mass fraction represents the ratio of mass of particles in the given size class to the total mass of all particles in the sample of the parent size distribution. The sieving is carried out for the period of time required to achieve substantially complete separation of the feed material into preselected size classes. The mass fractions so separated will not be substantially changed by sieving for longer periods of time. The mass fractions provided by classifiers employing batch sieving may then be reblended in the desired proportions to provide a finished product having the size distribution desired for a given application. In continuous screening, the screen sizes and lengths are selected as if each screening stage were to be carried out in a fashion analogous to batch sieving but assuming a somewhat lesser degree of complete screening (typically 85 to 95 mass percent). The mesh size of the screen, the screen length, the screen vibratory rate and values of other screening parameters are therefore selected to provide the desired product by assuming a predetermined level of essentially complete screening chosen on the basis of the estimated characteristics of a constant particle size distribution of feed material under fixed conditions of screening. The 85 to 95% completion values for continuous screening typically arise because of the finite length of practical screens. Very long screens of impractical lengths would usually be required to achieve operation close to complete screening conditions (greater than 95 mass percent passage of those particles capable of passing through the screen).

In conventional continuous screening systems, which often operate relatively near complete screening conditions, it is desirable to control closely the screening conditions and the moisture content, size distribution and other characteristics of the feed because significant variations in feed and/or screening conditions can cause corresponding variations in the rate of passage of undersize particles through the screen apertures and result in a product outside the limits of the applicable size distribution specification. Typically these controls are not used and sometimes it is not even recognized that they should be used. In addition, conventional screening systems are often tailor-made for a given feed and set of screening conditions such that product specifications cannot be maintained with a significantly different feed or under significantly different screening conditions.

Prior art classifiers employing continuous screening processes depend upon essentially complete screening to provide the desired size distribution in the finished product. An example of one such prior art process is illustrated by U.S. Pat. No. 4,032,436 to Johnson, the entire contents of which are incorporated herein by reference. Such classifiers may be sensitive to screen blinding where a portion of the open screen area is blocked by near size particles. Variations in the rate of passage of undersize particles through the screen because of blinding may cause excessive waste and/or the finished product to be out of specification.

A specific application of stonesand, such as in making concrete or asphalt, may require a closely defined sieve analysis and fineness modulus (F.M.). In other words, the stonesand must be carefully processed so as to have a consistent gradation and a consistent F.M. as necessary to meet applicable specifications and achieve a high quality concrete or asphalt composition with good workability, flowability and finishability.

ASTM Standard Specification C-33 (ASTM C-33) as applied to stonesand has the following sieve analysis limits based on the cumulative percentages passing through each sieve size indicated upon screening substantially to completion: 100% passing $\frac{3}{8}$ inch, 95 to 100% passing No. 4, 80 to 100% passing No. 8, 50 to 85% passing No. 16, 25 to 60% passing No. 30, 10 to 30% passing No. 50, 2 to 15% passing No. 100 and 0 to 7% passing No. 200. ASTM C-33 further requires that not more than 45% of the sample be retained between any two consecutive sieves, that the F.M. not be less than 2.50 nor more than 3.10 and that the F.M. not vary by more than 0.20 unless suitable adjustments are made in proportioning the concrete to compensate for the difference in grading. Thus, once the proportion of stonesand is selected for concrete, it is preferable that such fluctuations in the stonesand grading be prevented to avoid having to change this proportion.

To determine whether a stonesand product meets ASTM C-33, a sample of the product is subjected to a sieve analysis using batch sieving through a set of test sieves having the sizes specified above to measure the percent retained on each of the sieves. The F.M. value is then determined by summing the accumulated weight percentages retained on the successive sieves and the resulting number which is in excess of 100% is divided by 100 to produce a number which is the fineness modulus. A more detailed explanation of the F.M. indicator is set forth in the Johnson patent referenced above.

DISCLOSURE OF THE INVENTION

A principal object of the invention is to improve on the prior art by providing a continuous dry screening process having improved control of particle size distribution in the product and reducing the need for costly classifying and reblending systems.

Another object of the invention is to provide a differential rate screening process which continuously alters by a controllably variable amount the size distributions of practical feed materials so as to obtain directly an output product with a size distribution adhering closely to preselected proportions.

Another object of the invention is to provide a differential rate screening process in which the degree of completeness of screening a particulate feed material is controlled so as to selectively alter tne relative rates at which undersize particles in different classes pass through the screen and into an output product.

Another object of the invention is to provide a commercially practicable dry process for continuously screening crushed fine aggregate so as to minimize the necessity of blending two or more streams of different particle size distributions and provide a product having a substantially constant particle size distribution.

Another object of the invention is to provide a continuous dry screening process capable of being adjusted so as to maintain a substantially constant size distribution in a particulate product in the presence of significant variations in feed and/or screening conditions.

Still another object of the invention is to provide a continuous dry screening process capable of being periodically or continuously adjusted in response to one or more measured characteristics of one or more input and/or output streams and/or in response to one or more measured characteristics of the screening conditions so as to maintain a substantially constant size distribution in a particulate product in the presence of different feed and/or screening conditions, such as those causing screening blinding.

These and other objects of the invention are accomplished by a differential rate screening process.

The term "differential rate screening" as used here connotes a continuous process in which undersize particles in a feed of particulate material are incompletely screened and the degree of incomplete screening is so controlled as to provide a particle size distribution substantially different from the particle size distribution of the feed. More particularly, undersize particles in different size classes are screened to different degrees of completion on the same screen in a controlled fashion so that the product obtained has the desired distribution of different particle sizes.

The differential rate screening process takes advantage of the fact that particles in successively smaller size classes pass through a screen having given size openings at successively higher mass flow rates. The terminology "mass flow rate" as used in this specification denotes the mass of material per unit time which moves as a complete stream or as a component of a complete stream of particles. A composite stream of particles, such as the feed stream to a screen, may be visualized as containing a plurality of "substreams", each of a different size class component. By appropriately biasing to different degrees the effective retention time of different particle size classes on the screen, the screen is used as an adjustable component in a continuous size classification system. One tends to think of one or more "variable" screens rather than one or more "fixed" screens since the invention causes a given screen to act as if it were a family of screens rather than a single, fixed screening component. This system is in marked contrast to the conventional approach of separating the feed into its individual size fractions and then recombining and remixing those fractions according to a new blend designed to achieve the desired product. Differential rate screening involves the implementation of controlled differential screening rates between substreams of different size classes so as to achieve a preselected size distribution in the product.

The differential rate screening process of the present invention comprises introducing a feed stream of particulate material onto a first screening member having apertures of sufficient size to pass a plurality of size classes in the feed stream. The feed stream is then separated into at least a first throughs stream and a first overs stream by causing at least two of the undersize classes in the feed to pass through the apertures of the screening member and into the throughs stream in proportions relative to one another which are substantially different from the relative proportions of the at least two undersize classes in the feed stream. The differential between the mass flow rate of undersize particles in the feed stream and the mass flow rate of undersize particles passing through the screening member and into the selected throughs stream is controlled so as to provide substantially a preselected distribution of particle sizes in a product stream comprised of at least a portion of the throughs stream and/or the overs stream. A portion of the particles passing through the screening member may be intercepted before reaching the "selected" throughs stream and diverted as a separate stream or combined with the overs stream as a "retained" stream.

The apparatus of the invention comprises a screen means having at least one screening member with apertures of sufficient size to pass a plurality of size classes in a feed stream, feed means for introducing a stream of particulate feed onto the screen member, means for causing at least two undersize classes in the feed stream to pass through the apertures of the screening member and into a first throughs stream in proportions relative to one another which are substantially different from the proportions of the at least two undersize classes relative to one another in the feed stream so as to separate the feed stream into at least the first throughs stream and first overs stream, adjustment means for controlling the differential between the mass flow rate of undersize particles in the feed stream and the mass flow rate of undersize particles passing through the screening member and into the first throughs stream so as to control the proportions of the at least two undersize classes relative to one another in the first throughs stream and provide substantially a preselected distribution of particle sizes in a particulate product comprised of at least a portion of the first throughs stream and/or a portion of the first overs stream, and supply means for providing in the feed stream sufficient amounts of undersize particles in each of the plurality of undersize classes to provide the preselected distribution of particle sizes in the particulate product.

The screening member may comprise a screen of apertures with constant size, shape and orientation and with uniform spatial distribution of position over the screen surface. Alternately, it may comprise a screen of apertures whose characteristics of size, shape, orientation and position may individually or in various combinations be distributed spatially in some defined manner over the screen surface. In particular, these characteristics may be spatially distributed along the length of the screen, where the latter is taken to be in the direction of the normal flow of material over the screen. The feed means for introducing a stream of particulate feed onto the screening member may comprise some type of conveyor or a special feeder device. The means for causing undersize particles to pass through the screening member may comprise inclining and vibrating the screening member.

In differential rate screening, there is a substantial differential between the mass flow rate of a substream of undersize particles in a feed or other input stream to a screening member and the mass flow rate at which this undersize substream passes through the screening member and into a throughs stream. This mass flow differential represents the amount of the undersize substream retained on the screening member and may be in the range of about 5% to about 40%, more preferably at least about 20%, by weight of the mass flow rate of the undersize substream in the feed or other input stream. The largest particles in the undersize substream may be smaller than the average size of the apertures in the screening member by at least one or two mesh sizes of a preselected standard establishing different standard mesh sizes for the classification of particulate materials. Where two screens in series are each operated in the differential rate mode, the mesh size of the first screen may differ from the mesh size of the second screen by at least two standard mesh sizes.

A wide variety of adjustment means may be provided for controlling the differential between the mass flow rate of undersize particles in the feed stream and the mass flow rate of undersize particles passing through the screening member and into the throughs stream. These may include an adjustable chute, an adjustable plate, pan or tray, or an adjustable conveyor so as to vary the location at which feed is introduced onto the screening member. Alternately or in combination, an adjustable retention means may be provided such as an adjustable cover for receiving overs from above the screen or an adjustable plate, tray or pan for intercepting a portion of the throughs after they pass through the screen but before they pass into the throughs stream having a controlled proportion of the respective undersize classes. Each of these several adjustment schemes can be characterized by a parameter called "open length of the screen" in this specification. This parameter refers to the actual length of uncovered screen, including both the apertures and the material in between, which interacts with the feed stream in the sense of differential rate screening.

Another adjustment means for controlling the undersize differential between feed and select throughs is to provide means for adjusting the vibratory motion of the screening member. The means of vibratory adjustment may include adjusting the frequency or amplitude of the vibrations imparted to the screen, or the wave form followed by the screen's vibratory motion, or a combination of these vibratory screening parameters. The screen inclination, that is the angle between the plane of the screen and a horizontal plate, may also be adjustable.

A further adjustment means for controlling the undersize differential between feed and throughs is the provision of means for adjusting the feed rate, that is the rate at which the particulate feed material is introduced onto the screening member. Such means may include an adjustable speed conveyor or a feeder of a type wherein the mass flow of feed from a bin or the like may be adjusted by changing the vibratory rate and/or size openings of a feeder component. Another such adjustment means is the provision of means for adjusting the particle size distribution of the feed, such as by prescreening an adjustable portion of the feed on a conventional scalping screen, or by prescreening on another screen operated in accordance with the principles of the present invention, or by adjusting the particle size reduction provided by a crusher or grinder supplying feed to the feed means. Yet another way to adjust the particle size distribution of the feed is to return all or a portion of the overs output from the screening member with larger particulate material to a crusher or grinder supplying feed to the feed means.

The invention also contemplates combinations of two or more screening members employing differential rate screening to achieve the desired distribution of particle sizes in the final product. The basic screen combinations include (a) conveying throughs passing through a first screen to a second screen and taking overs from the second screen as a product stream, (b) conveying throughs passing through a first screen to a second screen and taking throughs passing through the second screen as a product stream, (c) conveying overs from a first screen to a second screen and taking overs from the second screen as a product stream, and (d) conveying overs from a first screen to a second screen and taking throughs passing through the second screen as a product stream. Additional screens for either conventional or differential rate screening may be used in combination with the two differential rate screens. For example, a third screen may be operated upstream or downstream of the two differential rate screens. Thus, a scalping screen may be used upstream of the first differential rate screen for removing coarse materials of a size near or above the mesh size of the first differential rate screen, or a fines screen may be used downstream of the second differential rate screen for removing fines or dust-like material much below the mesh size of the second differential rate screen. Where more than one screen is employed, a portion of the feed to a given screen may be diverted to a subsequent screen or a portion of the output from a given screen may be returned to a preceding screen.

While the invention will usually avoid the need for any blending with another stream to achieve a desired particle size distribution in the product, it may sometimes be desirable to blend one or more output streams from a differential rate screening system to achieve a particular product from a particular feed material. Thus, all or a portion of an overs or a throughs stream from any of the screens in the screening system may be blended with another such stream to form a product. In addition, a portion of the feed to a given screen may be diverted and blended directly with an output stream from the same or a different screen of the screening system. As a further alternative, two separate screening systems with different screen setups may be operated in parallel and one or more output streams from each screening system may be blended to provide a product.

Various setup procedures are described in the detailed description below for selecting an appropriate mesh size, the optimum values for open screen length, and the values of other screening parameters depending upon the rate, size distribution and other characteristics of the feed to be processed. These procedures are based upon estimates or measurements (or a combination of both) of what are referred to herein as transfer functions (A). A transfer function may apply either to the total mass flow rate of undersize particles being screened or to the mass flow rate of a specific size class of undersize particles, and is defined as the ratio of the mass flow rate of undersize material passing over the screen to the total mass flow rate of undersize material that would pass through the screen if the feed to the screen were screened so as to achieve substantially complete separation.

In certain embodiments of the invention, one or more screening parameters influencing the transfer functions may be varied either manually or automatically during the screening process. Screening parameters that can be varied in this fashion are referred to as "controllably variable" in this specification. A number of screening parameters are also "variable" in the sense that they may be changed during shutdown or interruption of the screening process or apparatus. At least one of the "variable" screening parameters is selected in accordance with the present invention so that the combination of the screening parameters operative on the feed stream is such that the "differential rate" screen does not provide essentially complete screening but instead provides a substantial degree of "incomplete" screening. For purposes of this specification, the degree of "incomplete" screening is synonymous with the transfer function, A.

A particularly important feature of the invention is that means may be provided to automatically vary one or more of the controllably variable screening parameters in response to a sensed control function. In this manner, the invention provides means of achieving automatic control over the size distribution of particles in the product stream. One objective of automatic control of the adjustable rate screening system is to assure that the size distribution of the product stream meets the desired specifications, such as the requirements of the ASTM C-33 specification for stonesand. A further objective is to minimize the quantities of waste materials that must be disposed of either as low economic return products or by reprocessing with attendant increases in costs. It is also desirable to achieve these results with the least effort and expense practicable.

A number of control schemes are feasible. Quite clearly, if control is to be achieved in a closed-loop sense, it is essential that some function of the size distribution be sensed to generate an error signal on which such control can be based. Either the product size distribution or the feed size distribution can provide this error signal. The use of product size distribution connotes some form of feedback control, whereas the use of feed size distribution connotes some form of feed-forward control. Because of difficulties and expense involved in direct sensing of the size distribution of either feed or product, a simpler basis for generating an error signal was developed. It was found that the flow rate of material either through the screen or over the screen may provide sufficient information for maintaining satisfactory control, either with or without some intermittent particle size analysis. Intermittent size distribution information provides a refinement to on-line rate control and constitutes a form of adaptive or hierarchical control. Three basic types of control systems may therefore be utilized, namely, feedback control, feedforward control and adaptive control.

In feedback control, at least one characteristic of an output stream from the screening system is monitored and compared with a set point. An error signal is then generated and used to adjust a controllably variable screening parameter and/or a parameter of the crushing machine to null out the error signal. The feedback signal may also be used to return a flow of out-of-specification material, either for rescreening or for recrushing.

Feed-forward control involves monitoring a characteristic of the crusher output or other source of feed to the adjustable differential rate screening operation. The monitored characteristic is then used to geneate a signal to adjust the product size distribution so that it comes within specifications. In this control scheme, the output of the crusher may be delayed in a holdup bin for a sufficient length of time to complete the monitoring operation so that an adjustment signal can be sent forward and arrive at the screen in phase with the corresponding material flow. Although material partitioning by the screen may be sufficiently accurate to avoid the need for compensating adjustments on the basis of screen output, such a secondary feedback control loop in combination with the feedforward control loop is contemplated by the invention. As a further alternative, a measured characteristic of the feed may be used to generate a feed-forward signal to the adjustable screen and/or a feedback signal to the crusher. Many other options also exist for control by means of either feedback or feed-forward loops or a combination thereof.

An adaptive control system employs more than one control loop. In one embodiment of adaptive control of the differential rate screening process, one loop consists of a means for continuous monitoring of a particulate stream characteristic, such as mass flow rate, and a means for comparing this monitored characteristic with a set point. A second loop monitors a second quantity to be used as a basis for changing the set point on demand. The set point initially selected assumes that the particle-size characteristics of the feed, as well as the feed mass flow rate, remains relatively constant. The set point is used as the basis for making operational adjustments to the adjustable screen, such as adjustment to open screen length, so as to maintain the mass flow rate needed to satisfy the size distribution requirements of the product. However, if there should be a substantial change in the mineralogy of the material being fed to the crusher, the crusher output could experience a significant change in particle size distribution. As a result, the open screen length would undergo an excursion beyond its normal operating range, and this phenomenon would signal the need for set point adjustment. By monitoring open screen length as well as stream mass flow rate, the system can be programmed to perform an "on-demand" sampling and particle size analysis of the monitored particulate stream. Particle size analysis may be performed either manually by conventional sieve analysis or automatically by a particle-size analyzer of a type available in the industry. The results of this analysis can then be used to manually or automatically establish a change in the mass flow rate set point, against which the signal from the continuous weight monitor is compared to generate the error signal used for screen adjustment. Thus, the system "adapts" to significant changes in the character of the incoming feed.

As indicated above, the sensed (measured) characteristic or control function may be that of either an input or an output stream from the adjustable screening system and may comprise the mass flow rate of the stream. A number of other stream characteristics may be measured and used to generate an input signal to the control system. These include the actual particle size distribution, the relative proportions of particles above or below a selected size, the relative mass flow rates of two or more streams containing different particle size distributions, the mean particle size, fineness modulus, or some other characteristic proportional to or indicative of particle size distribution, such as the noise level or impact energy generated by particle momentum on a conveyor or in free fall. A particularly preferred characteristic which is measured and used for generating a control signal is a mass flow rate ratio between two or more output streams or between the input feed stream and one or more output streams, such as the mass flow rate ratio between the feed stream and the product stream. This product stream may comprise overs and/or throughs from one or more screens within the adjustable screening system.

The signal generated by a measured characteristic of a particulate stream is used as an input to the control system for the adjustable differential rate screening system. The output from the control system may be used to adjust any of the controllably variable screening parameters of the differential rate screening system, namely, feed mass flow rate (by adjusting feed conveyor and/or other feeder device), feed size distribution (by adjusting crusher, pre-screening device and/or return mass flow rate to crusher), effective screen opening size (by adjusting location of feed discharge onto a screen having different opening sizes spatially distributed along its length), open screen length which passes throughs into a particular throughs stream of interest (by adjusting relative position of a screen cover, an interceptor pan beneath screen, and/or a feeder device), screen inclination (by direct adjustment), vibratory motion (by direct adjustment of frequency, amplitude and/or wave form), feed diversion rate (by adjusting mass flow rate of feed diverted to a prior or subsequent screen or to an output stream), and blending ratios (by adjusting relative mass flow rates of mixed output streams or parallel screening systems).

BRIEF DESCRIPTION OF THE DRAWINGS

The invention may be further understood by reference to the accompanying drawings in which:

FIG. 24 illustrates a dynamic setup procedure for the bottom screen of the differential rate screening system of FIG. 4.

FIG. 25 is a plot of class transfer functions, $A_j$, for the top screen of the differential rate screening system of FIG. 4.

BEST MODE AND OTHER EMBODIMENTS

Figure 1:
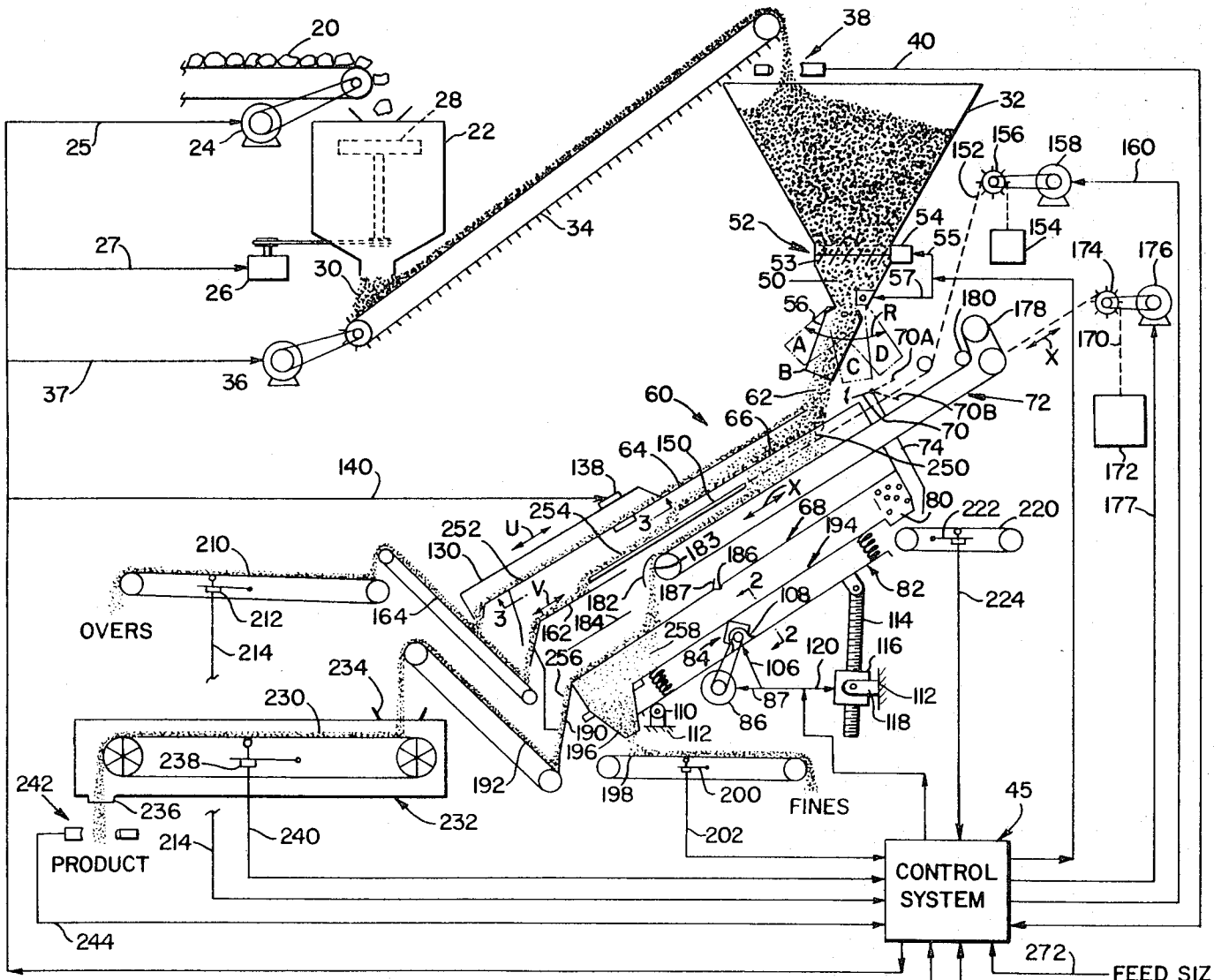
FIG. 1 is a diagramatic illustration of a process and apparatus for differential rate screening in accordance with the present invention.

FIG. 1 is a diagramatic illustration of the process and apparatus of the rate screening system of the present invention. With reference to this figure, relatively large quarried rocks are fed by conveyor 20 to a centrifugal crusher 22, which may be of a rotary impact type such as described in U.S. Pat. No. 4,061,279 to Sautter of Dec. 6, 1977, the entire disclosure of said patent being incorporated herein by reference. The mass flow rate of quarried rocks to crusher 22 may be varied by a variable speed motor 24 which drives belt conveyor 20 in response to a control signal 25.

The centrifugal crusher includes a variable speed motor 26 for driving the crusher impeller 28 in response to a control signal 27. Variable speed impeller 28 provides a means for controllably varying the mean particle size and particle size distribution of the stonesand 30 produced by crusher 22. It is to be understood that ballmills and other types of crushers having means for adjusting the particle size distribution of the crushed output may be used instead of crushers of the centrifugal type illustrated.

The stonesand produced by crushing the much larger quarried rocks is conveyed to a feed bin 32 by means of a belt conveyor 34 driven by a variable speed motor 36 in response to a control signal 37. Motor 36 may be synchronized with motor 24 to equalize the capacities of conveyor 20 supplying quarried rocks to, and conveyor 34 removing stonesand from, crusher 22. As the stonesand falls from conveyor 34 into bin 32, a measurable characteristic of the stonesand, such as the cumulative weight or volume percentage above or below a preselected size, fineness modulus, and/or mean particle size may be determined by a measuring device 38 providing an input signal 40 to a control system, generally designated 45. Feed measuring device 38 may also comprise a weigh belt of the type described hereinafter for measuring the mass flow rate of stonesand conveyed to bin 32. Bin 32 is preferably in the shape of an inverted truncated rectangular pyramid having a square discharge opening at its bottom and four sides each inclined at about 70° upwardly from the horizontal.

Mounted under the discharge opening of bin 32 is a bin discharging feeder 52, such as a live bottom "Siletta" feeder manufactured by Solids Flow Control (SFC) Corporation of West Caldwell, N.J. The Siletta feeder has a "venetian blind" feeder tray comprised of elongated slats 53 spaced transversely apart and sized to pass crushed stone in the size range from about ⅜ inch to fines (minus 200 mesh). With a feed density in the range of about 80 to about 100 pounds per cubic foot, feeder 52 can provide a controllably variable feed rate in the range of about 2 to about 25 tons per hour. The feeder tray is vibrated horizontally in a direction perpendicular to the length of slats 53 by an adjustable amplitude magnetic drive unit 54, such as that manufactured by Eriez Magnetics of Erie, Penn. In a preferred embodiment, drive unit 54 vibrates the feeder tray at a constant frequency of about 60 hertz and has an adjustable amplitude with a maximum amplitude of about 1 mm. The drive unit may also include a controller permitting manual or automatic adjustment of the size of the slat openings and/or the vibratory amplitude in response to the input of an external analog signal 55. Since the slat opening size and vibratory amplitude regulate the mass flow rate of stonesand from bin 32, analog signal 55 can be used to vary the instantaneous mass feed rate passing through feeder discharge chute 56 and thereby provides one means for achieving relatively precise control over the mass feed rate. If there is no need for the surge capacity provided by bin 32, both the bin and its feeder may be omitted and feed rate control provided by variable speed conveyor motors 24 and 36.

Beneath feeder 52 is a screening unit, generally designated 60, having multiple screens or "screen decks". A Siletta feeder is preferably mounted so that the length of the slats of the feed tray is perpendicular to the lengthwise direction of the underlying screen deck. In this position, the Siletta feeder discharges particulate material substantially uniformly over the full width of the screening unit in the longitudinal direction of the "slats" and discharge chute 56 is preferably of the full-width type so as to maintain this spread condition as the stonesand is fed onto the underlying screen deck. Discharge chute 56 is manually or automatically adjustable through an arc of about 90° in the direction of arrow R for purposes of directing the feed discharge as explained in more detail below.

The screening unit 60 receiving stonesand feed 62 from chute 56 may be comprised of one or more screen decks. In the embodiment shown in FIG. 1, the screening unit has three (3) screen decks, namely, a top screen 64 of 8-mesh size, an intermediate screen 66 of 4-mesh size and a bottom screen 68 having a 50-mesh size section and a 30-mesh size section. Screen 64 may extend for almost the full length of the screening unit, e.g., about 84 inches, while screen 66 and each section of screen 68 may extend about one-half that length, e.g., about 42 inches. Each of these screens may be about 46 inches in width. The support grid (not shown) of each screen may be independent of the others and is preferably built as an open waffle-like structure with only longitudinal stringer supports for the overlying wire screens. To aid in screen cleaning and preventing screen "blinding", a coarse underscreen having a mesh of about ⅜ or ½ inches may be attached to and underneath each support grid so that individual compartments about 6 inches square and 1½ inches thick are formed adjacent to the under surface of each screen. Hard rubber balls may then be loaded into each such compartment to form a ball cleaning system to help prevent screen blinding.

An adjustable deflector plate 70 is provided along the upper transverse edge of the screening unit to direct input feed material onto screen 66, onto an interscreen conveyor 72 or through a feed diverter 74 having a pair of chutes, one extending downward past each side of conveyor 72. Adjustable chute 56 cooperates with deflector plate 70, interscreen conveyor 72 and feed diverter 74 so as to direct feed 62 to one or more of the three screens or to divert all or a portion of feed 62 around one or more screens. Accordingly, when chute 56 is in position "A" all of the feed 62 falls onto top screen 64. When chute 56 is in position "B", feed 62 is divided between top screen 64 and intermediate screen 66. When chute 56 is in position "C" and deflector 70 is fuly closed to shut off flow to diverter 74, all of feed 62 is fed onto screen 66. When chute 56 is in position "C" and deflector 70 is open, feed 62 is divided between screen 66 and diverter 74. When chute 56 is in position "D" and deflector 70 is fully open or fully closed, all of feed 62 bypasses screens 64 and 66 and is conveyed to screen 68 by interscreen conveyor 72, feed being discharged onto either the 50-mesh section or the 30-mesh section of screen 68 depending on the position of the adjustable discharge end of the interscreen conveyor. Both chute 56 and deflector 70 may also have intermediate positions so as to divide feed 62 between screen 66 and screen 68 and between screen 68 and feed diverter 74.

Figure 2:
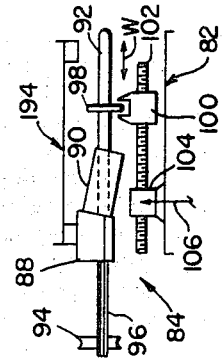
FIG. 2 is a fragmentary sectional view along lines 2—2 of FIG. 1 illustrating in more detail the means for controllably varying the vibratory motion of the differential rate screening apparatus.

Screens 64, 66 and 68 are arranged in the form of screen decks carried by vibratory frame 80 which is dynamically balanced and resiliently mounted on a fixed frame 82. An adjustable vibratory unit 84 is driven by a variable speed motor 86 in response to a control signal 87 for varying the vibratory frequency. With reference to FIG. 2, the screen vibratory unit 84 includes means for varying both the vibratory amplitude and vibratory wave form in addition to the vibratory frequency. A rectangular vibratory cam or bearing member 88 provides a saw-tooth type of wave form and an eccentric cylindrical bearing member 90 provides a sinusoidal type of wave form. Alternately, cams of other shapes could be used to generate a variety of other types of wave forms. Members 88 and 90 are axially mounted for rotation upon a shaft 92 carrying a pulley 94 driven by a belt of motor 86. Pulley 94 engages a spline portion 96 of shaft 92 so that shaft 92 may be adjusted longitudinally by means of a bearing disc 98 engagable by a slotted journal member 100 threaded to a shaft 102 mounted for rotation parallel to shaft 92. A reversible electric motor 104 rotatably engages shaft 102 so as to reciprocate journal member 100 and shaft 92 in the direction of arrow "W" in response to a control signal 106, disc 98 secured to shaft 92 being free to rotate within the slot of journal member 100 during adjusting engagement between these two components. Longitudinal adjustment of shaft 92 causes longitudinal displacement of the vibratory members 88 and 90 which are rigidly secured to shaft 92 for rotation therewith. A change in wave form is achieved by longitudinally displacing shaft 92 so that cylindrical member 90 engages vibratory frame 80 in place of rectangular member 88. As illustrated in FIG. 2, the longitudinal axis of member 90 is canted relative to the longitudinal axis of shaft 92 so that longitudinal adjustment of member 90 relative to vibratory frame 80 will change the amplitude at which frame 80 is vibrated by its engagement with the eccentric bearing surface provided to either side of the longitudinal position at which shaft 92 passes through the radial center of member 90. Shaft 92 is mounted both for rotation and for longitudinal reciprocation by a pair of journal members 108 mounted near opposite edges of fixed frame 82, one such journal member 108 being shown in FIG. 1 but omitted from FIG. 2 for purposes of clarity.

The angle of inclination of the screen decks relative to the horizontal may be varied since one end of the fixed frame 82 is pivotally mounted upon a foundation 112 by means of a pivot connection 110. The other end of fixed frame 82 is pivotally connected to a vertically adjustable shaft 114 which has threads engaged by a reversible electric motor 116 so that actuation of motor 116 in response to a control signal 120 causes longitudinal movement of threaded shaft 114. Motor 116 is pivotally connected to foundation 112 by a pivotal mounting 118 similar to pivotal connection 110.

Figure 3:
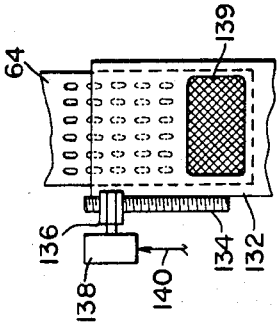
FIG. 3 is a fragmentary sectional view along lines 3—3 of FIG. 1 illustrating in more detail the means for controllably varying the open screen length and/or the effective screen aperture size of the differential rate screening apparatus.

Each of the screens 64, 66 and 68 is configured so that the open length of the screen can be varied, either manually or automatically. With respect to top screen 64, a shroud member 130 is arranged to be movable in the direction of arrow "U" and has a solid bottom pan 132 underlying screen 64 as illustrated in FIG. 3. Also attached at or near the bottom of shroud member 130 is an elongated rack 134 engaged by a pinion 136 rotatably driven by a reversible electric motor 138. Shroud 130 is mounted on ball bearing rollers that ride on a track preferably comprised of a pair of angle iron side rails (not shown) so that shroud pan 132 may be adjusted relative to the longitudinal length of screen 64 by movement of rack 134 upon rotation of pinion 136 by motor 138 in response to a control signal 140. As an alternative, pan 132 may itself include a screen or other apertured section 139 arranged to cooperate with the apertures of screen 64 so as to vary the effective opening size of at least some of the apertures seen by the particles passing along the screen deck formed by such a parallel structure.

The open length of screen 66 is varied by means of a longitudinally adjustable interscreen pan 150 connected by a tether 152 to a counterbalance 154. The tether 152 is preferably in the form of a chain engaged by a sprocket 156 of a reversible pan positioning motor 158. The interscreen pan 150 is mounted on ball bearing rollers that ride on a track preferably comprised of a pair of angle iron side rails (not shown) mounted on vibratory frame 80 so as to be vibrated thereby for the purpose of causing movement of particles falling thereon toward the lower, discharge end. Actuation of motor 158 in response to a signal 160 causes pan 150 to move in either of the directions indicated by arrow "V" depending upon the direction of motor rotation as determined by the signal 160. Particulates falling past the upper end of pan 150 reach interscreen conveyor 72 as a first throughs stream for transport to bottom screen 68. The particulates falling on pan 150 are discharged from its lower end into a collection chute 162 through which they leave the screening apparatus as a separate stream of throughs and/or overs from the screen 66 and fall on an overs discharge conveyor 164.

Pan 150 is preferably arranged for sufficient upward travel to completely cut off the passage of particles from screen 66 to conveyor 72 and for sufficient downward travel to permit all particles passing through upper screen 64 to reach conveyor 72 either by passing through the larger mesh of screen 66 or by falling off the lower end of screen 66 directly onto conveyor 72. Pan 150 may also include an apertured section (not shown) similar to section 139 of pan 132 and arranged so as to alter the probability of passage from screens 64 and/or 66 to conveyor 72 for at least a portion of the particulates intercepted by pan 150.

The discharge end of interscreen conveyor 72 is adjustable in either of the directions indicated by arrow "X" by means of a tether 170 connecting the upper end of this conveyor to a counterbalance 172. Tether 170 is preferably a flexible chain arranged to be engaged by a sprocket 174 driven by a reversible electric conveyor positioning motor 176. The interscreen conveyor is preferably of the belt type and the upper end of the conveyor assembly includes a drive roller 178 and a tensioning roller 180. Drive roller 178 is driven by an adjustable speed motor (not shown) which is preferably synchronized with the feed rate so as to prevent an excessive build-up of particulates on or near the discharge end of the conveyor belt. A vertically extending deflector plate 182 is mounted adjacent to the discharge end 183 of conveyor 72 to ensure that the particulates are fed to screen 68 in a relatively narrow band extending across the screen width immediately below this end of the conveyor, instead of being thrown off the end of the conveyor through an unknown variable distance before impacting on the apertured surface of the underlying screen.

The longitudinal position of the discharge end of conveyor 72 preferably is adjustable from a lower position discharging to a throughs pan 184 to an upper position discharging to the upper portion of the 50-mesh screen section so as to be able to take advantage of the full open length of this screen section. The upper end of pan 184 is spaced longitudinally downstream of the upper end of the 30-mesh screen section so that the discharge end 183 of conveyor 72 may be positioned close enough to the discharge end of this screen section to provide the degree of incomplete screening desired. Located between the 50-mesh and 30-mesh screen sections is a side discharge channel 186 with a hinged door 187. Discharge channel 186 conveys particulates around the 30-mesh section directly to a chute 190 if door 187 is open. With door 187 closed, the particulates passing off of the end of the 50-mesh section will also pass over the 30-mesh section and be screened thereby. The particulates reaching either or both of these screen sections are separated into a fines component 258 passing through screen 68 and a bottom overs component 256 passing off of the end of screen 68 and through the chute 190 to a conveyor 192. The fines component 258 falls on a fines pan 194 and is discharged from the lower end of this pan through a chute 196 to a fines conveyor 198. Fines conveyor 198 is of the weigh belt type having a weight and conveyor speed sensing element 200 providing a mass flow rate signal 202 to control system 45.

A top overs stream 252 from screen 64 is discharged to oversconveyor 164 and transported to a weigh belt 210 having a weight and conveyor speed sensing element 212 for providing a mass flow rate signal 214 to control system 45. Intermediate overs and/or throughs 254, which pass through screen 64 and/or over or through screen 66 but do not reach a subsequent screen because of pan 150, are also discharged to conveyor 164 and transported to weigh belt 210.

For purposes of explanation only, but without limitation, the bottom overs 256 from screen 68 are designated as the product stream in FIG. 1. However, any of the output streams, such as those received by conveyors 164 and 198, may be designated as "product". Furthermore, the "product" stream may be comprised of an intimate mixture of two or more output streams or one or more output streams in intimate admixture with unscreened feed diverted through feed diverter 74 to a weigh belt 220 having a weight and conveyor speed sensing element 222 for providing a mass flow rate signal 224 to control system 45.

In the embodiment of FIG. 1, the product stream on conveyor 192 is discharged to a product weigh belt 230 enclosed within a housing 232 having an inlet chute 234 and a discharge chute 236. The weigh belt includes a weight and conveyor speed sensing element 238 for providing a mass flow rate signal 240 to control system 45. Heated air or direct heat may be provided within housing 232 so as to control the moisture content of the particulate stream at a uniform level for continuous mass flow rate measurements. Similar housings and heating units may be provided for weigh belts 198, 210 and 220.

A measuring device 242 may also be employed for measuring the particle size distribution or some other measurable characteristic of the product stream particulates, such as the mean particle size, and for providing an input signal 244 corresponding to the measured characteristic to control system 45. Measuring devices 38 and 242 for automatically measuring one or more characteristics of the particulates may provide either an intermitent or continous input signal and may be a radiant and/or impact energy type as illustrated by U.S. Pat. Nos. 3,478,597 to Merigold, et al., 3,797,319 to Abe and 4,084,442 to Kay; a sedimentation rate type as illustrated by U.S. Pat. Nos. 3,208,286 to Richard, et al., and 3,449,567 to Olivier, et al.; a centrifugal air classifier type for providing a control signal responsive to the proportion of particles above or below a selected size as illustrated by U.S. Pat. No. 2,973,861 to Jager; a sieving type for automatically measuring fineness modulus as illustrated by U.S. Pat. No. 2,782,926 to Saxe; a multiple screen classifying type as illustrated by U.S. Pat. Nos. 3,439,800 to Tonjes and 3,545,281 to Johnson; a continuous weight comparison type for providing a control signal responsive to the relative weights of different particulate streams as illustrated by U.S. Pat. Nos. 3,136,009, 3,126,010, 3,143,777, 3,151,368, 3,169,108 and 3,181,370 to Dietert alone or with others; a fluid elutriator type as illustrated by U.S. Pat. Nos. 3,478,599 and 3,494,217 to Tanaka, et al.; a piezoelectric type as illustrated by U.S. Pat. Nos. 3,630,090 to Heinemann, 3,844,174 to Chabre and 4,973,193 to Mastandrea; a volume measuring type for providing a control signal responsive to the rate of accumulation of one or more size fractions as illustrated by U.S. Pat. No. 3,719,089 to Kelsall, et al.; a radiant energy type for providing a process control signal as illustrated by U.S. Pat. Nos. 3,719,090 to Hathaway, 3,836,850 to Coulter, 3,908,465 to Bartlett, 4,178,796 to Zwicker and 4,205,384 to Merz, et al.; a particle noise measuring type as illustrated by U.S. Pat. Nos. 4,024,768 to Leach, et al. and 4,179,934 to Svarovsky; a trajectory type as illustrated by U.S. Pat. Nos. 3,952,207 to Leschonski, et al., and 4,213,852 to Etkin; a sequential weight of fraction type as illustrated by U.S. Pat. Nos. 3,943,754 and 4,135,388 to Orr; or any other type of prior art measuring device capable of providing a signal proportional to some scalar function of particle size distribution such as mean particle size, fineness modulus, or a point on the cumulative size distribution. The entire contents of each of the above mentioned patents are expressly incorporated herein by reference.

As a further example, input signals 40 and/or 244 may be produced manually and have a value selected on the basis of particle size analyses performed manually on particulate samples taken either automatically or manually from an input or output stream of the screening unit. Similarly, in some applications, automatic controls such as control system 45 may be eliminated entirely and necessary adjustments in one or more variable screening parameters may be made manually on the basis of either manual or automatic particle size analyses.

The total of the mass flow rate on weigh belts 198, 210, 220 and 230 equals the mass flow rate of the feed. Where a feeder of the Siletta type is employed, continuous measurement of the mass flow rate in all of the output streams may not be necessary since the feed flow rate from a Siletta feeder may be calibrated and controlled fairly accurately in the range of 2 to 25 tons per hour by adjustment of the slats 53 and the vibratory amplitude provided by the drive unit 54. In this regard, the output of the Siletta feeder may be calibrated by placing feeder chute 56 in position "D" and adjusting interscreen conveyor 72 over plate 184 so as to discharge the entire feed stream into chute 190 leading to product weight belt 230. Alternatively, the Siletta feeder may be calibrated by placing feeder chute 56 in position "A" and adjusting interscreen pan 150 so as to discharge the entire feed stream onto conveyor 164 leading to overs weigh belt 210.

As illustrated in FIGS. 1, 2 and 3, the screening apparatus 60 has a number of screening parameters that may be varied either manually or automatically during the screening process without stopping the equipment. In this specification, the term "controllably variable" is used to designate these screening parameters. The following controllably variable screening parameters may apply to each screen deck or screen section where a deck includes more than one screen in series: feed flow rate; feed particle size distribution; open screen length for a given screen width providing a separated throughs stream; effective screen opening size for each screen having different opening sizes spatially distributed along its length; screen inclination; screen vibratory frequency; screen vibratory amplitude; and screen vibratory wave form.

The foregoing screening parameters are also "variable" in the sense that they may be changed or varied during shutdown or interruption of the screening process. In this specification, the term "variable" is used alone as being more generic than "controllably variable". For example, the screening apparatus may be shut down and the screening process thereby interrupted to change the screens on one or more screen decks. In this manner, the aperture size or sizes of the screen component on a given screen deck may be varied. Similarly, the spatial distribution of screen apertures as well as the size distribution of apertures may be varied such as where the alternate screen contains more than one size aperture and the mixture of aperture sizes is either constant or varies down the length of the screen.

Each of the foregoing "variable" screening parameters is selected in accordance with the present invention so that the combination of screening parameters operative on the feed stream is such that one or more screens do not provide essentially complete screening but instead provide substantially "incomplete" screening. For purposes of this specification the degree of complete screening is defined as the ratio of mass flow rate of the feed passing through a screen relative to the total mass rate that is capable of passing through the same screen if the feed were screened to completion. The degree of incomplete screening is defined as one minus the degree of complete screening.

In addition, one or more of the screening steps may be set up to operate so that the degree of incomplete screening is "substantially variable". The degree of incomplete screening is "substantially variable" when it is at a level that can be varied by a substantial amount by varying one or more of the foregoing screening parameters. At these screening conditions, the differential rate of screening undersize particles (mass of throughs passing into output stream per unit time) is also "substantially variable", i.e., the differential screening rate can be varied by a substantial amount. In practicing the present invention, the degree of incomplete screening may be substantially variable for the entire feed stream or for one or more size fractions of the feed stream, e.g., −4+8 mesh, −8+16 mesh, −16+30 mesh, −30+50 mesh, −50+100 mesh and/or −100+200 mesh.

Depending on the size distribution of the feed, it may be that a single screen deck employing the incomplete screening principles of the invention may be sufficient to provide either an overs or a throughs output stream having an altered particle size distribution meeting the preselected distribution desired in the stonesand product. Any of the previously noted controllably variable parameters may be used to achieve incomplete differential rate screening with a single screen. However, the degree to which the particle size distribution of a feed stream can be altered with such a single screen is significantly less than that which can be achieved with two or more screens. Inasmuch as system complexity is expected to increase rapidly with increase in number of screens, it is believed that a practical system for effective control and flexibility is attained with the use of two or three successive screen decks of different mesh sizes. The screen decks are considered to be "successive" when the throughs or overs from one are fed onto the other.

The number of successive screens or screen decks is another important and controllably variable screening parameter of the present invention. The screening apparatus and process illustrated in FIG. 1 provide a number of different flow paths, some providing successive screenings and some having controllably variable mass flow rates. The flow paths include without limitation those discussed below.

With adjustable chute 56 in position "A", feed 62 will fall initially on the open length of top screen 64 and be separated there and on intermediate screen 66 by incomplete screening into a throughs stream 250 passing through screen 66 and falling on interscreen conveyor 72 and an overs stream 252 reaching the solid bottom 132 of shroud 130 without passing through the openings or apertures of screen 64. In this mode of operation, interscreen pan 150 may be positioned so as not to intercept any of the particulates passing through screen 64, and the shroud 130 may be adjusted to vary the open length of screen 64 and thereby vary the degree of incomplete screening provided by this screen. Since the mesh size of intermediate screen 66 is larger than that of top screen 64 in the embodiment shown, practically all of the particulates passing through screen 64 will pass even more rapidly through screen 66 and not build up on the latter. However, when pan 150 is in its lowermost position, its upper end is spaced downwardly beyond the lower end of screen 66 so that any buildup of particulates may be discharged from the lower end of screen 66 directly onto conveyor 72. Alternately, the position of pan 150 may be varied, either alone or in combination with the position of shroud 130, to vary the degree of incomplete screening provided by screen 64 and thereby generate another throughs stream 254 which may be combined with overs stream 252 on conveyor 164.

Throughs stream 250 upon reaching interscreen conveyor 72 is discharged from lower end 183 of this conveyor onto bottom screen 68 where these throughs are further separated by incomplete screening into two fractions, namely an overs stream 256 discharged through chute 190 to conveyor 192 and a throughs stream 258 (fines) discharged through chute 196 to conveyor 198. The degree of incomplete screening provided by bottom screen 68 may be varied by adjusting the longitudinal position of lower end 183 of interscreen conveyor 72 and thereby changing the location at which throughs stream 250 falls onto screen 68. This in effect varies the open length of screen 68 exposed to throughs 250.

Interscreen conveyor 72 may also be adjusted longitudinally so as to discharge throughs 250 either above or below channel 186 dividing screen 68 into two screening components of different mesh sizes, namely an upper 50-mesh screen and a lower 30-mesh screen in series. Adjustable door 187 may either allow overs from the upper screen section to pass unobstructed to the lower screen section or divert these overs into channel 186 providing a flow path for conveying the upper section overs directly to bottom overs chute 190. The first of these alternatives illustrates another important feature of the invention, namely, that one or more of the screen decks may be comprised of a series of different screens each of a different mesh size or of a different size distribution and/or spatial distribution of screen openings so as to controllably vary the effective screen aperture size and/or screen aperture spatial distribution in response to a characteristic of an input stream to or an output stream from the screening apparatus and process.

The effective screen aperture size and/or screen aperture spatial distribution of the screening means may also be controllably varied by positioning feeder chute 56 in position "B" so that the feed stream 62 is split between top screen 64 and intermediate screen 66 having different mesh sizes and/or different aperture spatial distributions. Position "B" represents any chute position between position "A" (entire feed to screen 64) and position "C" (entire feed to screen 66) so that the flow rate of feed to one of these screens may be varied relative to flow rate of feed to the other.

As another alternative, if throughs 250 have the desired size distribution without further screening, these throughs may be discharged as product by positioning the discharge end 183 of interscreen conveyor 72 over plate 184 leading to chute 190. As interscreen conveyor 72 is preferably mounted on fixed frame 82 so as not to be vibrated, stream 250 may also be discharged as product by reversing the direction of travel of the belt of conveyor 72 and providing means (not shown) for discharging stream 250 from the upper end of the conveyor, such as to weigh belt 220.

With chute 56 in position "C", all of the feed 62 falls on intermediate screen 66. In this mode of operation, the open length of screen 66 and thereby the degree of incomplete screening provided by this screen is controllably varied by positioning interscreen pan 150 to intercept more or less of the throughs stream 250. As indicated above, the throughs stream 250 is defined as those throughs passing through either or both screen 64 and 66 and reaching interscreen conveyor 72 without being intercepted by pan 150. Upon reaching the belt of conveyor 72, throughs 250 may be subjected to a second incomplete screening step upon being discharged to bottom screen 68 in accordance with the screening alternatives provided by this screen as described above.

As an alternative to discharging all of the feed to screen 66, chute 56 may be left in position "C" and hinged deflector plate 70 opened so as to divide feed 62 between screen 66 and diverter 74. The relative flow rates to screen 66 and diverter 74 are variable in accordance with the precise positioning of the discharge opening of chute 56 relative to the splitting edge formed by the juncture between the screen and the diverter passageway. In this mode of operation, the desired size distribution of the product would be achieved by mixing the diverted feed downstream of weigh belt 220 with one or more of the output streams available from the screening apparatus, namely, the throughs and/or overs 254 from chute 162, the throughs 250 from plate 184 and chute 190, the bottom overs 256 from chute 190 and/or the fines 258 from chute 196.

With chute 56 in position "D" and deflector plate 70 in fully open position 70B, the entire feed 62 is discharged onto interscreen conveyor 72. In this mode of operation, the entire feed may be subjected to a single screening step on screen deck 68, this screening step providing incomplete screening by either the 50-mesh section or the 30-mesh section depending on the position of the interscreen conveyor discharge relative to these screen sections. When the 50-mesh section is to be used alone, channel door 187 is in the open position shown in FIG. 1 to divert overs into the transverse channel 186. Alternately, door 187 is closed so that screening may take place both on the 50-mesh section and the 30-mesh section, the 50-mesh screening being substantially varied in response to the position of the interscreen conveyor discharge while the 30-mesh screening may be carried out essentially to completion by reason of the overs traversing the entire available length of the 30-mesh section.

In this mode of operation, interscreen conveyor 72 may be positioned so as to discharge all of the particulates thereon to chute 190 via fixed plate 184 so as to obtain measurements of the entire feed stream at different flow rates for purposes of calibrating the controllably variable feed flow provided by the Siletta feeder 52, or to provide periodic measurements of feed flow when using a feeding component having a relatively fixed mass flow rate.

Yet another alternative is provided by placing chute 56 in position "D" and the diverter door in position 70A so that feed 62 is divided between diverter 74 and interscreen conveyor 72. In this mode of operation, screening of the feed portion on conveyor 72 is provided by screen deck 68 in accordance with any one of the screening options provided thereby as described above. A product may then be provided by combining the diverted feed with one or more of the screened output streams, namely, bottom overs 256 and/or fines 258.

A number of other flow options are available within the contemplation of the present invention and it is not intended to describe all of them here. For example, pan 150 may be used to divide the overs discharged from the lower end of screen 66 and plate 184 may be used to divide the throughs discharged from the lower end of conveyor 72, such divisions affecting a change in the flow rate of particles reaching lower screen deck 68 and thereby being capable of changing the particle size distribution in the overs or throughs stream from the 30 mesh portion of this deck. Additional screening decks may be utilized or adjustable pan components or adjustable conveyor components utilized with a different screen than that illustrated in FIG. 1. All such variations may provide incomplete screening of an input feed or one or more intermediate feeds to a screening surface.

The particle size distribution of both throughs and overs from a given screen deck operating under incomplete screening conditions can be altered by changing the particle size distribution (the relative amounts of particles in different size ranges) of the feed to the screen or screens of that deck. As indicated above, the size distribution of feed 62 may be controllably varied by changing the degree or type of size reduction provided by crusher 22.

The control system 45 and the input signals thereto and the output signals thereform will now be described in more detail. With reference to FIG. 1, control system 45 may include input signal 40 responsive to some scalar function of particle size distribution such as mean particle size, fineness modulus, or a point on the cumulative size distribution and/or mass flow rate of feed; input signal 202 responsive to mass flow rate of throughs; input signal 214 responsive to the mass flow rate of overs; input signal 224 responsive to mass flow rate of diverted feed; input signal 240 responsive to mass flow rate of product; and/or input signal 244 responsive to some scalar function of particle size distribution of product. In this context, it is emphasized again that the product may be comprised of output streams other than overs from the lowest screen or of mixtures of one or more of the output streams and that the measuring device 242 or other devices measuring a stream characteristic may be located at positions other than those shown in FIG. 1 as appropriate to measure the characteristcs of the stream selected as product for a given application of the invention.

Outputs from control system 45 may include, without limitation, output signal 25 for regulating the speed of rock conveyor motor 24; output signal 27 for regulating the speed of crusher motor 26 and thereby the mean particle size and/or particle size distribution of the feed 30; output signal 37 for regulating the speed of conveyor motor 36; output signal 55 for regulating the transverse openings between slats 53 and/or the vibratory amplitude of Siletta feeder 52, thereby regulating the mass flow rate of feed 62; output signal 57 for regulating the position of chute 56 and thereby the selection of the screen deck to receive all or a portion of the feed 62; output signal 87 to regulate the vibratory frequency of the screen decks; output signal 106 to regulate the vibratory wave form and/or amplitude of the screen decks; output signal 120 to regulate the angle of inclination of the screen decks; output signal 140 to regulate the position of shroud 130 and thereby the open length of screen 64; output 160 to motor 158 to regulate the position of interscreen pan 150 and thereby the open length of screen 66; and/or output 177 to motor 176 to regulate the position of interscreen conveyor 72 and thereby the open screen length of bottom screen 68.

For given ranges of feed rate and feed size distribution, a particular set up of the apparatus and process of the invention may be required to provide particulate product of a preselected size distribution or range of size distribution. Accordingly, set points for control system 45 may include a feed rate set point 270, a feed mean particle size set point 272 and a product mean particle size set point 274. These set points provide a null point for generating appropriate signals for controlling the rate and a particular scalar function of particle size distribution of the feed within ranges compatible with the equipment set up, and for controlling the particle size distribution of the product within desired limits by regulating one or more screening parameters affecting particle size distribution of the product as previously described.

In crushing a number of rock types with conventional crushing equipment, the particle size distribution of stonesand provided by such equipment can be maintained relatively constant without controllably varying a crushing parameter. The rate of feeding these types of stonesand can also be maintained relatively constant by a feeder of the type described. Furthermore, in many applications, only one or two screens and one or two variable screening parameters may be needed to achieve the preselected size distribution desired in the aggregate or stonesand product. One such simplified apparatus and process is illustrated in FIG. 4 wherein the same numbers are used followed by a prime (') symbol to designate the same element or component as previously described.

Figure 4:
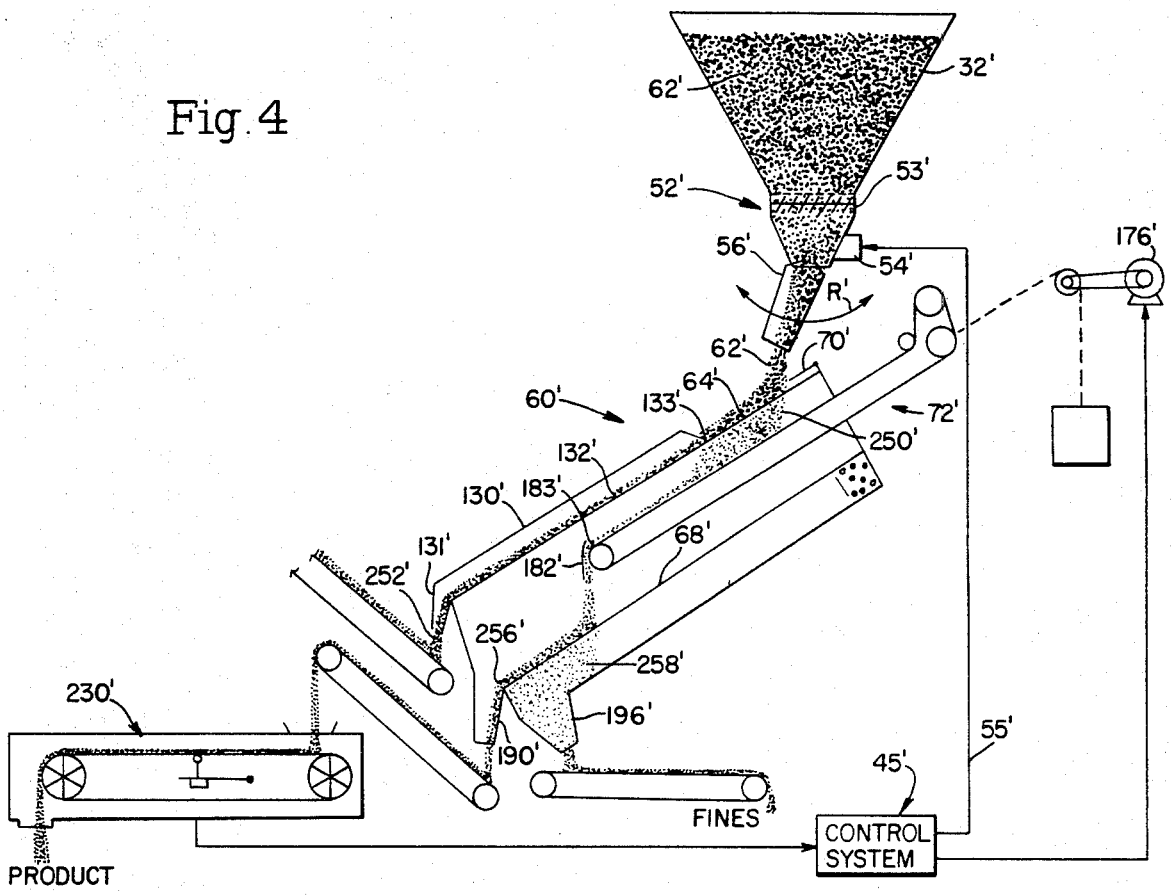
FIG. 4 is a diagramatic illustration of a simplifying modification of the differential rate screening process and apparatus of FIG. 1.

With reference to FIG. 4, a feed material 62' is provided to bin 32' so as to keep the bin relatively full with a substantially constant depth of particulate material. In the specific screening examples described below, the particulate feed material had a cumulative size distribution illustrated by curve F in FIG. 5. Also illustrated in FIG. 5 by dotted line curves H, M and L are the high, midpoint and low cumulative size distributions, respectively, of the ASTM C-33 Standard Specification for Concrete Aggregates as adapted for stonesand and set forth in "Stonesand for Portland Cement Concrete", Table C, Stone Products Update 1, National Crushed Stone Association, Feb. 1976. The particulates in the feed were produced by crushing limestone rocks with a centrifugal crusher of the type described in the Sautter patent referenced above, the crusher parameters being selected so as to reduce the particle sizes of the aggregate to less than ⅜ inch and the crusher discharge being prescreened to remove any carry over of ⅜ inch or larger material before being discharged to bin 32'.

The principal components of the system of FIG. 4 include a feed bin 32', bin discharger/feeder 52', a modified two-deck screening unit 60', a weigh belt 230', an interscreen conveyor 72' and a control system 45'. The entire two-deck screen is mounted on a support framewok (not shown) which permits manually changing the screen inclination angle above horizontal over the range from 21° to 36°, in 3° increments.

Bin-discharging feeder 52' is a "Siletta" 30-inch live bottom feeder of the type previously described. This is a carbon steel unit with a "Venetian blind" type feed tray sized to pass crushed stone with a density in the range of 80 to 100 lb/ft$^3$ and particle sizes ⅜ inch and smaller at a feed rate in the range of approximately 2 to 25 tons per hour. The feed tray is vibrated horizontally in a direction perpendicular to the length of slats 53' with an adjustable amplitude magnetic drive unit 54' manufactured by Eriez Magnetics of Erie, PA. The drive unit vibrates the feed tray at a constant frequency of 60 Hz and a variable amplitude up to about 1 mm, and includes a Model FS-75A controller configured to permit control both manually and in response to an external analog signal 55'. This analog signal can be used to vary the feed mass flow rate and thereby provides one means of achieving automatic control over the product particle size distribution. The Siletta unit is mounted so the length of slats 53' is perpendicular to the lengthwise direction of underlying screen 64'. Although the cant of these slants may be adjustable, it is preferably fixed in this embodiment. The mass flow rate of material discharged from the Siletta is quite uniform from one element of length to the next over the full length of the feed tray. To maintain this spread condition, the feed material 62' is fed into a full-width discharge chute 56'. Discharge chute 56' is manually adjustable through an arc R' of about 90° so that feed can be directed to the screen or to an interscreen conveyor 72', or divided between the screen and conveyor.

The screening unit 60' is preferably a Model 46-8400, lightweight, two-deck screening system manufactured by Forsbergs, Inc., of Thief River Falls, MN. Each of the screens in this system has a screen size of 46×84 inches. Unit 60' is dynamically balanced and mounted upon a fixed frame (not shown) by four eccentric bearing assemblies having a fixed throw of about 3/16-inch and a corresponding vibration amplitude of about 3/32-inch. An adjustable sheave drive unit permits the screening unit to operate over the speed range of approximately 800 to 1200 rpm. Each screen has an independent support grid built as an open waffle-like structure with only longitudinal stringer supports for the overlying wire screens. A coarse under screen is attached to each support grid so as to form individual compartments about 6-inches square by 1½inches thick. Hard rubber balls are loaded into each such compartment to form a ball cleaning system for the screens to prevent screen blinding. Separate discharge chutes 131', 190' and 196' receive the overs 252' from top screen 64', the overs 256' from bottom screen 68' and the throughs 258' from bottom screen 68', respectively.

Each screen is configured so that its open length can be changed to vary the degree of incomplete screening provided by each successive screening stage. This is accomplished by fitting top screen 64' with a thin overlying adjustable plate 132' placed in such a manner that the plate and screen sandwhich can be tightened down against the support deck with side screen tensioning screws. This permits manual adjustment of the open length of the upper screen, preferably over the length range of about 0 to 24 inches. This open length of top screen 64' is measured from the lip of an overlying discharge deflector plate 70' at its upper end to the upper edge 133' of cover plate 132' at its lower end. The open screen length range may be extended easily if necessary by changing the relative lengths of screen 64' and cover plate 132'.

The open length of bottom screen 68', whose entire length remains uncovered at all times, is measured from the position where interscreen conveyor 72' dumps material onto the screen surface to the downstream end of this screen. This effective length preferably varies from about 0 to about 70 inches. Inasmuch as the position of the interscreen conveyor can be adjusted by a reversible motor drive unit 176', the effective length of the bottom screen can be controlled automatically during the screening process. This provides another means for controlling the size distribution of particles in the output streams of this embodiment.

Interscreen conveyor unit 72' is preferably a low profile flatbelt type conveyor with an adjustable DC speed control drive available from Processing Equipment Co., Inc. The total thickness of the conveyor may be as little as approximately 3.0 inches, and its usable flat belt surface is at least about 12 inches longer than the screens. A conveyor of relative small thickness may be necessary in order for it to fit between the two screening components, such as between the central bearing support shaft and the lower screen of a Forsbergs unit. Rubber bumpers are preferably located on the screen support frame so that screen wobble transients during start up and shutdown will not cause the screening unit to impact against the interscreen conveyor. The entire interscreen conveyor 72' is mounted on ball bearing rollers that ride on a pair of angleiron side rails (not shown). The rails are end-supported outside of screening unit 60' and extend down between the screen decks without attachment to the screening unit. Thus the conveyor does not vibrate and motion of its belt is required to carry material to the prescribed dump point onto the bottom screen. A vertical deflector plate 182' is mounted at discharge end 183' of the conveyor to insure that particles 250' fall onto bottom screen 68' in a relatively narrow band instead of being thrown off the end of the conveyor through some variable distance.

The system layout of FIG. 4 in combination with a crusher of variable size output permits the following screening parameters to be varied for control of particle size distribution in the product: screen opening size(s) and/or size distribution and/or spatial distribution of screen openings (by manually changing screens on one or both screen decks), open screen lengths (by manually changing the position of shroud 130' and/or manually or automatically changing the position of conveyor discharge 183'), screen inclination (by manual adjustment of frame), screen vibratory frequency (by manual adjustment of vibrator drive), feed flow rate (by manual or automatic adjustment of Siletta feeder), feed size distribution (by manual adjustment of crusher), and/or feed division between top and bottom screens (by manual adjustment of chute 56'). Of these, the open length of screen 68', the inclination and vibratory frequency of both screens, and the flow rate, size distribution and division of feed 62' are controllably variable while the process is in operation.

When conveyor 72' is at its lowest position, material can be fed directly from the feeder 52' onto the upper end of this conveyor belt, and subsequently conveyed and discharged without screening to bottom overs discharge chute 190'. This arrangement permits introducing the entire feed stream to weigh belt unit 230' for calibrating or periodically checking the input mass flow rate to the screening unit. Likewise, material which has gone through the top screen alone can be directed to the weigh belt for periodic mass flow measurements.

In passing feed material from one screen to another screen in sequence, a screened product may be taken from four basic sources. The throughs from a first screen may be passed to a second screen and a product stream may be comprised of either the overs or the throughs from the second screen. These two operational possibilities are illustrated by the screening systems of FIGS. 1 and 4. Alternately, the overs from a first screen may pass to a second screen and a product stream may be comprised of either the overs or the throughs from the second screen. These operating alternatives of the rate screening process of the present invention are illustrated in the simplified apparatus and process shown in FIG. 6 wherein the same numbers are used followed by a double prime (") symbol to designate similar elements or components as previously described with reference to FIGS. 1 and 4. Since the components bearing the same number operate in the same manner previously indicated, primarily the differences in equipment setup will be described below.

Figure 6:
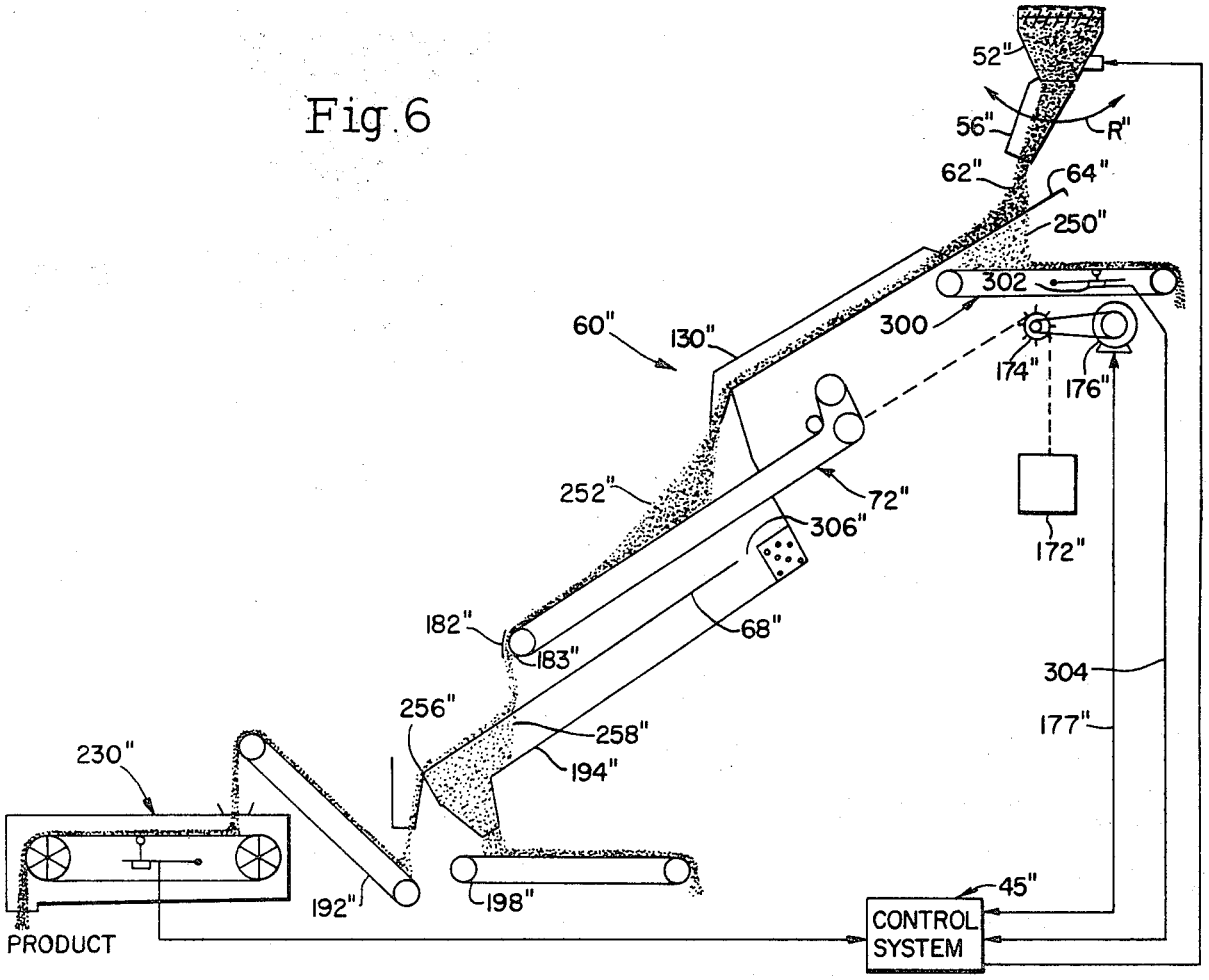
FIG. 6 is a diagramatic illustration of another modification of the differential rate screening process and apparatus of FIG. 1.

The principal components of the system of FIG. 6 include a Siletta feeder 52", a modified screening unit 60" having a first screening deck 64" and second screening deck 68" arranged so as to receive the overs 252" from the first screening deck, an interscreen conveyor 72", a product conveyor 192", a product weigh belt 230", and a control system 45". Since the two screening decks are separated horizontally, they may be mounted either on the same support framework or on separate support frameworks. Separate support frameworks for each screen deck provide the option of independent screen inclinations and independent screen vibratory motions. In other words, each screen deck may have its own means for controllably varying screen inclination (similar to elements 114, 116, 118 and 120 of FIG. 1) and/or its own means of controllably varying screen vibratory amplitude, frequency and/or wave form (similar to elements 84, 86 and 87 of FIG. 1 and the elements of FIG. 2). In addition, adjustable screen shroud 130" may be either the manually adjustable type of FIG. 4 or the automatically adjustable type of FIGS. 1 and 3.

In the embodiment of FIG. 6, the throughs of first screen 64" are designated as first throughs 250" and are collected on a first throughs conveyor 300" having a weight and conveyor speed sensing element 302" providing a mass flow rate signal 304" to control system 45". The overs 252" from first screen 64" are retained by the pan portion of shroud 130" and fall from the lower end of this pan onto interscreen conveyor 72". Interscreen conveyor 72" has an adjustable discharge location as previously described. The overs 252" on the interscreen conveyor are then discharged beneath deflector plate 182" onto the second screen 68" which separates this feed into a second throughs component 258" and a second overs component 256". The second throughs component is collected by a second throughs conveyor 198". The second overs component 256" is collected on a second overs conveyor 192" from which these overs are discharged as product onto the product weigh belt system 230".

Total particulate flow rate from the Siletta feeder may be measured by adjusting interscreen conveyor 72" so as to bypass screen 68" entirely and discharge directly to the product weigh belt system. Total mass flow rate is then obtained by adding the output of weigh belt 300" to that of the product weigh belt 230". The total mass flow rate so obtained may then be used to calibrate Siletta feeder 52". This particulate flow path may also be utilized where the first overs stream is already within specification so that further screening is unnecessary.

With further reference to FIG. 6, second throughs conveyor 198″ may be exchanged with weigh belt system 230″ and associated conveyor 192″ so that the product comprises the second throughs stream instead of the second overs stream. In the case where the second throughs comprise the product, the discharge end 183″ may be positioned over a gap or open area 306 in screen 68″ so as to discharge all of the first overs directly onto throughs pan 194″ and thence to the seoond throughs conveyor which in this option would discharge to a weigh belt. This option allows the second throughs system to measure either total first overs flow or to recover all of the first overs stream where it already meets its specification without further screening.

Screen 64″ and 68″ are each configured so that its open length can be changed to vary the degree of incomplete screening provided by each corresponding screening stage. The open screen length of screen 64″ may be adjusted by fitting this screen either with a thin overlying adjustable plate (such as plate 132″ of FIG. 4) or by an automatically adjustable shroud having a solid bottom pan underlying the screen (such as pan 132 of FIGS. 1 and 3). Adjustments in the open screen length of the second screen 68″ is accomplished by changing the discharge position of interscreen conveyor 72″ with respect to the length of this screen in the same manner that interscreen conveyor 72′ is adjusted in relation to bottom screen 68′ as described above in reference to FIG. 4.

Another advantage of the FIG. 6 embodiment over the other embodiments shown is that the height or thickness of the conveyor unit as a whole is not critical so that there is greater flexibility in designing and/or selecting the conveyor equipment for transporting particulates from the first (upstream) screen to the second (downstream) screen.

Product material 256′ (the overs of bottom screen 68′ in the screening unit of FIG. 4) and product material 256″ (the overs of second screen 68″ in the screening unit of FIG. 6) pass onto continuous weigh belts 230′ and 230″, respectively. These weigh belt units may be of the type manufactured by Autoweigh Inc., of Modesto, CA. This weigh belt has a 24-inch wide troughing belt and uses a torsion bar type weigh unit resting on special strain-gauge load cells. The weigh belt system is preferably designed to operate over a range of about 2 to 20 tons per hour for material with a bulk density or approximately 100 lb/ft$^3$. This system preferably includes a Mark IV integrator unit, which provides a display of integrated mass flow rate and instantaneous flow rate (which are labelled "total" and "mass rate", respectively), and an electronics package capable of supplying a signal in the 0–10 volt range proportional to the instantaneous mass flow rate. This output signal is preferably introduced directly into an analog digital (A/D) converter, such as is available in a Rockwell AIM-65 minicomputer.

In the embodiments of FIGS. 4 and 6, the weigh belt provides the only on-line measurement signal for controlling the overall screening system. Its calibration, performance and input to the control system is therefore of prime importance. The interfaces, circuitry and calibration procedures for this integrated weigh belt system are given in the manufacturer's hardware manual.

A key element of the preferred control system is a Rockwell AIM-65 minicomputer which has a 4,000 bytes of memory, a BASIC language capability, a thermal printer and a full keyboard. Programs for the AIM-65 can be stored permanently on cassette tape but must be reloaded any time the AIM-65 loses power. The AIM-65 receives its principal measured signal as a mass flow rate input from the weigh belt through an analog to digital (A/D) converter interface and controls the positioning motor of the interscreen conveyor and/or the drive unit of the Siletta feeder, each through a digital to analog (D/A) converter. All conversions are quantized at 8 bits, and accept a 10-volt signal range.

The positioning motor unit for interscreen conveyor 72′ preferably includes a ¼ HP, 1750 RPM, permanent magnet, ball bearing, DC motor with a 0–90 VDC armature, and a Winsmith 300:1 ratio, double-reduction worm gear reducer. This motor unit is preferably controlled by a Polyspede Electronics Corporation Model RPD2-16 DC regenerative drive. The complete variable speed capability of this driver may not be necessary in view of the large speed reduction ratio employed, but the position control feature of this Polyspede unit is particularly advantageous.

The conveyor positioning control system essentially operates with its own separate feedback loop. That is, a position-correction signal is generated by the AIM-65 minicomputer, either as a result of a program input to set an absolute position or as the result of a mass flow rate deviation of the weigh belt signal from a set point value. In either case, this correction signal consists of two parts; namely, a direction component and a given number of counts. Once the signal appears, the Polyspede driver actuates the reversible positioning drive motor in the proper direction for the correction. A set of points on the motor shaft generates a given number of pulses for each shaft rotation and these pulses are counted by the AIM-65 minicomputer. When the count equals the preset count the motor stops. For example, the control system may register 22.65 counts per inch of travel of the interscreen conveyor. In the preferred configuration, an auto/manual and safety interlock system provides for manual operation of the positioning system and prevents the interscreen conveyor from overrunning the ends of its track.

Figure 7:
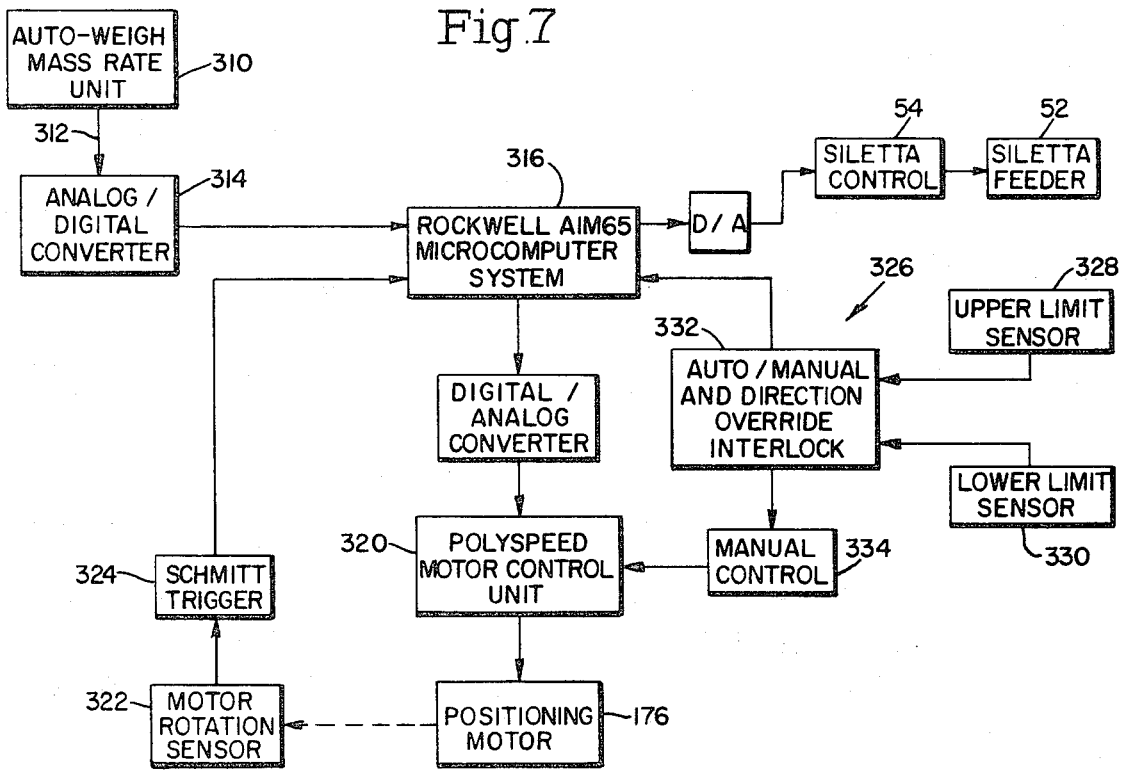
FIG. 7 is a block diagram of the control system for the differential rate screening process and apparatus of FIG. 4.

A block diagram of the control system as integrated with a AIM-65 minicomputer is shown in FIG. 7. With reference to this figure, the mass flow rate measuring component 310 feeds on analog signal 312 to an analog to digital (A-D) converter 314 of the AIM-65 computer 316. The output of the AIM-65 is used as an input either to the Siletta control 54 or to the conveyor positioning control 320, each of these alternative output signals passing through a corresponding digital to analog (D-A) converter. Siletta control 54 directly regulates the mass flow rate provided by Siletta feeder 52. Conveyor control 320 directly regulates the position of the discharge end 183″ of interscreen conveyor 72″ by controlling movement of conveyor positioning motor 176″ as previously described. Rotational movement of the set of points on the motor shaft is sensed by a motor rotation sensor 322 which provides an output signal to the AIM-65 through a Schmitt trigger 324.

The control system of FIG. 7 provides proportional control for either feeder mass flow rate or interscreen conveyor discharge position, stable control being available for only one of these functions at a time since only one downstream characteristic is measured in the embodiments of FIGS. 4 and 6, namely product mass flow rate. However, the invention contemplates measuring two or more output characteristics so that feed flow rate and conveyor discharge position may be controlled simultaneously. Periodic or continuous regulation of the Siletta feeder is desirable to maintain a relatively constant mass flow rate in the presence of upstream variations in feed flow rate and/or feed conditions. Periodic or continuous regulation of the position of the interscreen conveyor is desirable to control open screen length so as to maintain the preselected output size distribution in the presence of changes in the feed and/or screening conditions, such as compensating for screen blinding caused by cohesive (e.g., moist) feed material. Complete compensation for screen blinding may not be possible when the blinding is due to moisture. It is expected that the material flow rate can be compensated for, but this may not make the appropriate compensation in particle size distribution. Some of the cohesive material would be expected to pass through the screen as agglomerates rather than as individual particles and the resulting size distribution may very well differ from the one expected if no agglomerates were present. Deviations in the output size distribution may also be corrected by changing the rate of incoming mass flow provided by the Siletta feeder, but the output size distribution is much more sensitive to changes in open screen length as provided by changing the discharge position of the interscreen conveyor.

Figure 8:
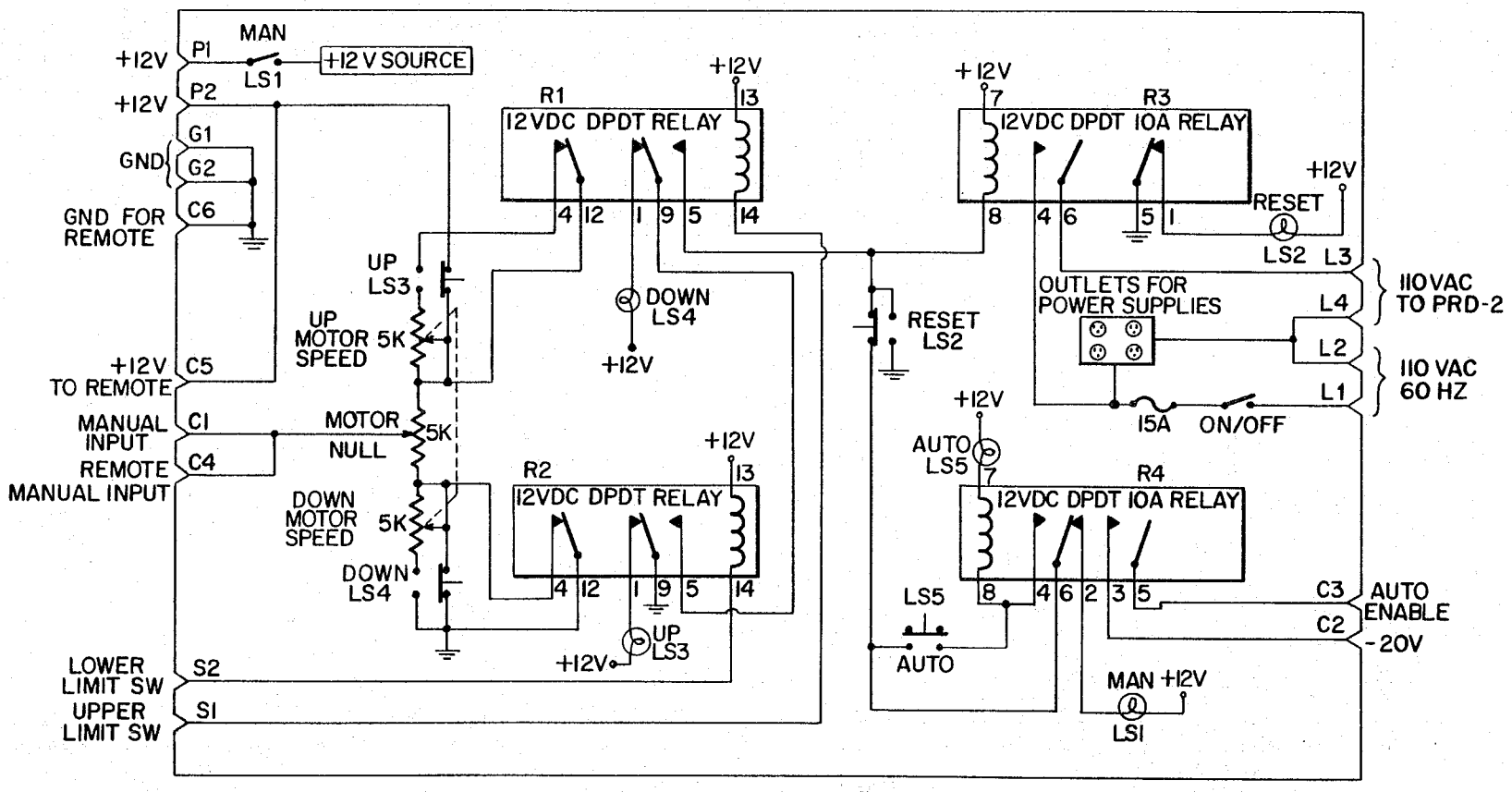
FIG. 8 is a circuit diagram of the manual control-safety interlock component of FIG. 7.

In a preferred configuration, an auto/manual and safety interlock system 326 provides for manual operation of the conveyor positioning system and prevents interscreen conveyor 72'' from overrunning the ends of its track. A circuit diagram of the auto/manual and safety interlock system is shown in FIG. 8. The interlock system includes a manual control 334 and upper and lower limit sensors 328 and 330 which actuate an automatic disabling circuit 332.

Figure 9:
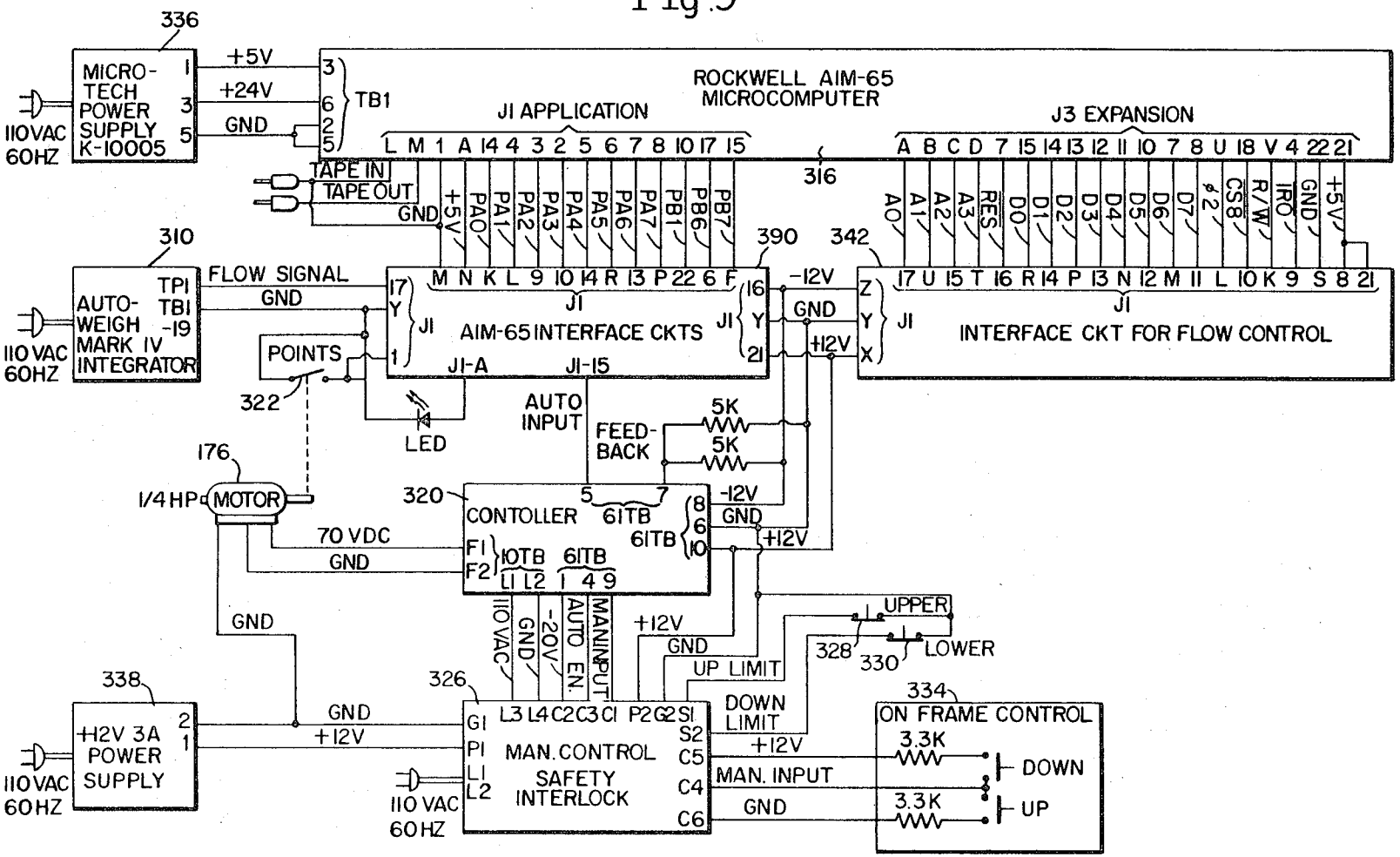
FIG. 9 is a wiring diagram for providing power to and interconnecting the control components of FIG. 7 and the remotely adjustable screening components of FIG. 4.
Figure 10:
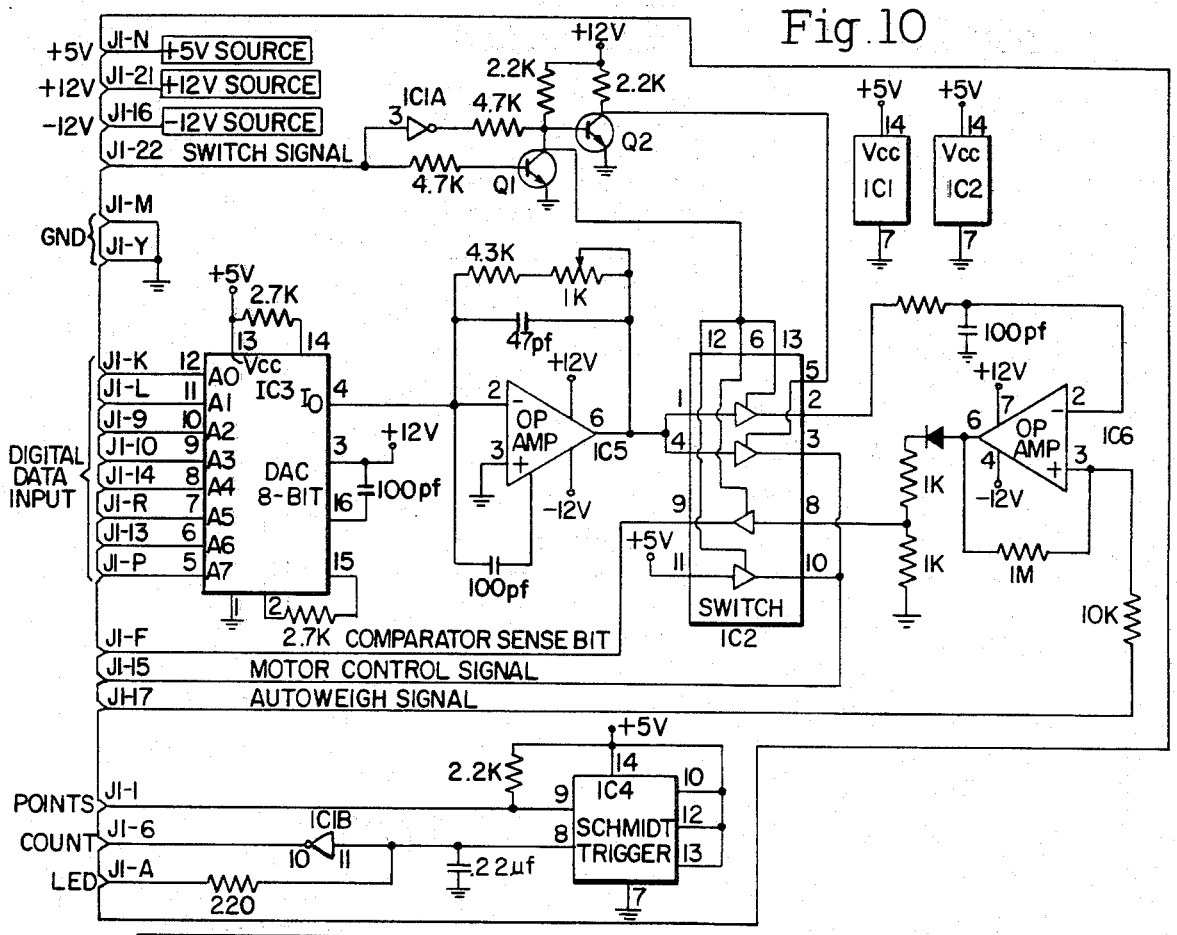
FIG. 10 is a circuit diagram of the interface circuit for integrating the AIM-65 minicomputer into the control system of FIG. 7.
Figure 11:
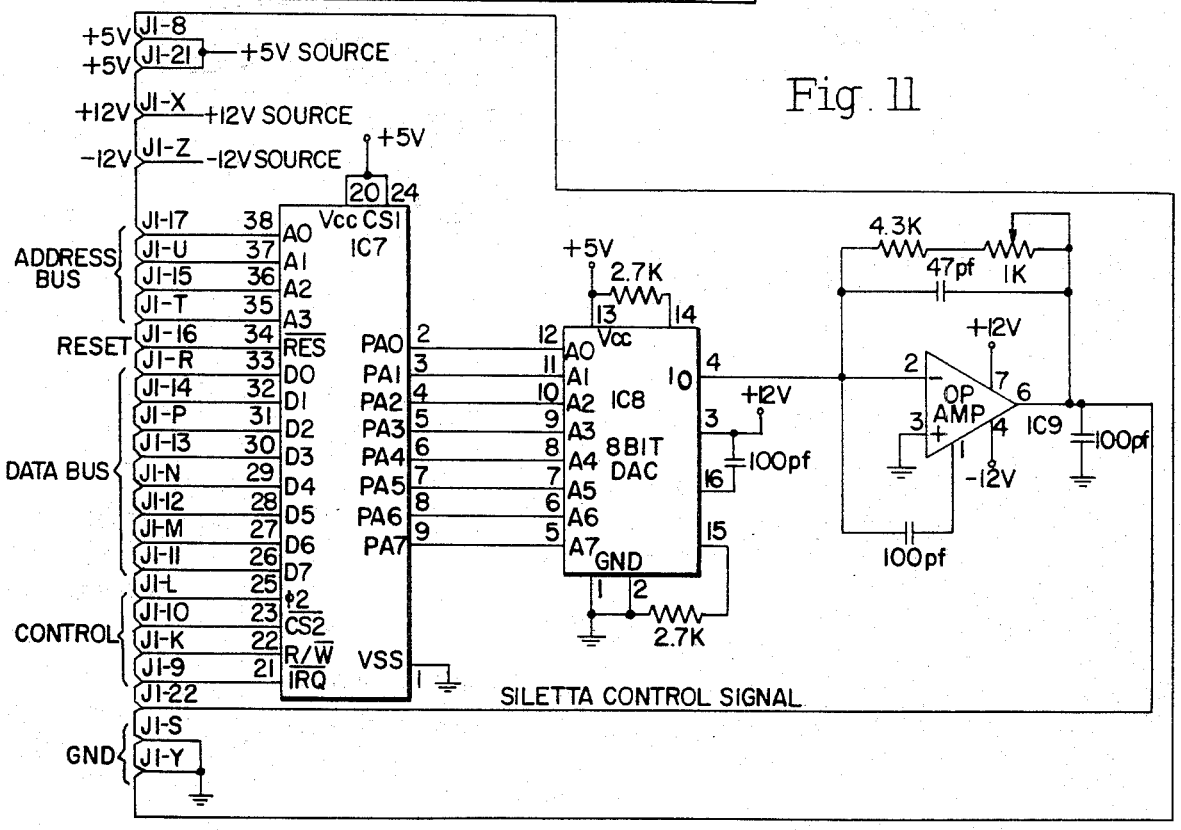
FIG. 11 is a circuit diagram for interfacing control of feed flow rate with the AIM-65 minicomputer.

A basic writing diagram of the electrical circuits interconnecting the various components of the control system is shown in FIG. 9. In addition to the components already described with reference to FIG. 7, the diagram of FIG. 9 includes a power supply 336 for the AIM-65, a power supply 338 for the conveyor positioning control circuitry, a master interface board 340 and a flow control board 342. The AIM-65 interface circuits on interface board 340 are shown in FIG. 10 and the flow control circuits on flow control board 342 are shown in FIG. 11.

In setting up the various measuring and control system components, such as the weigh belt and integrator components of the Autoweigh unit, the calibration and setup procedures set out in the manufacturer's equipment manuals should be followed carefully and each of the equipment set points should be carefully checked and accurately calibrated.

Figure 12:
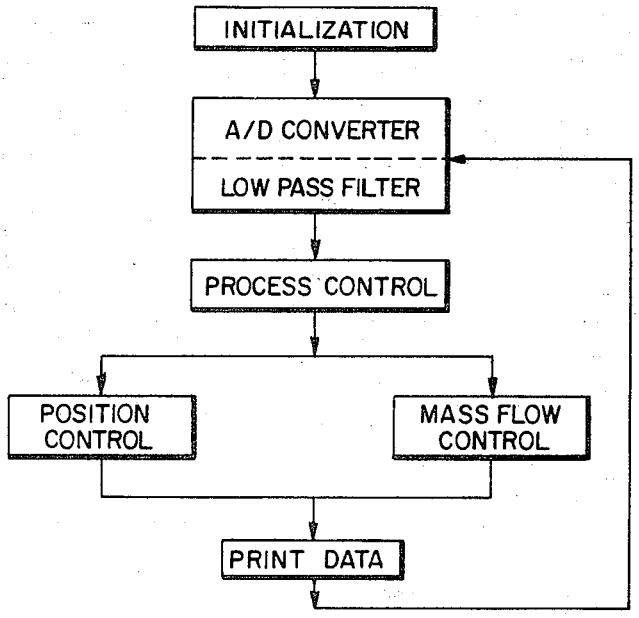
FIG. 12 is a block diagram of the computer program for controlling the process and apparatus of FIG. 4.

While the AIM-65 is very versatile and can be programmed to do a wide variety of tasks, there is a memory limitation of about 100 basic statements. A preferred set of programs for operating the AIM-65 as part of the control system is listed in Table 1. The Master Control Program is a real-time control program for normal system operation and includes statements 1 to 155 for inputs and initialization, including flow stabilization, and statements 200 to 250 for controlling the normal operating cycle. Statements 200 to 250 call upon subroutines 400 to 475 to convert the Autoweigh input, subroutines 601 to 680 to control the interscreen conveyor discharge position, and subroutines 800 to 900 to provide operational data output if desired. Subroutines 2000 to 2060 may also be provided for data runs to calibrate the weigh belt and/or the feeder. A schematic diagram of the process control program is shown in FIG. 12 where the "low pass filter" is a programmed filter for stabilization of the control signals. This filter is contained in statements 42 through 44 of Table 1.

TABLE 1

PROGRAMS

```
    MASTER CONTROL PROGRAM
  1 DEFFN R(B)=INT((100*B+.05)/100
  5 POKE 40962,2
  6 POKE 40963,255
  7 POKE 40960,0
 10 DIM SM(3)
 21 NN=10
 23 T1=256
 24 T2=255
 25 T2=32
 26 T4=128
 27 T5=T1*T1-1
 31 MP=0
 32 Y$="Y"
 33 LN=0
 34 C1=24/T2
 35 C2=.04415
 36 SM(1)=10
 37 SM(2)=20
 38 SM(3)=30
 40 CY=0
 41 RC=15
 42 DT=INT(RC/3+.01)
 43 F1=C1*DT/(DT+2.*RC)
 44 F2=(DT-2.*RC)/(DT+2.*RC)
    INPUT RUN DATA
 70 INPUT "PRINTOUT";P$
 80 INPUT "UPDATE RATE";IN
 82 IN=INT(IN/DT-.99)
 84 INPUT "STARTING L";LN
 86 INPUT "SCREEN CONST.";K1
 88 INPUT "MASS RATIO";SP
100 INPUT "MASS FLOW=";MI
102 IF MI>0 GOTO 150
    MEASURE MI
104 GOSUB 400
106 MI=MO
108 PRINT "MASS FLOW="MI
110 PRINT "CHANGE="MI-MP
112 INPUT "STABLE";A$
114 IF LEFT$(A$,1)=Y$ GOTO 150
116 MP=MI
118 GOTO 104
    MOVE TO LN
150 DL=LN
152 NN=IN
154 MP=MI
155 GOSUB 600
    MAIN PGM CYCLE
200 GOSUB 400
205 IF MO=0 GOTO 999
208 MI=MP*EXP(.004*CY)
210 DL=K1*(SP-MO/MI)
220 LN-LN+DL
230 IF DL<>0 THEN GOSUB 600
240 GOSUB 800
250 GOTO 200
    FLOW MEASUREMENT SUBR
400 FOR NA=1TONN
410 T=T4
415 V=T4
420 POKE 40961,V
421 D=PEEK(40960)
422 T=INT(T*.5)
425 IF T<1 GOTO 455
430 IF D<T4 GOTO 445
435 V=V+T
440 GOTO 420
445 V=V-T
450 GOTO 420
455 IF D<T4 THEN V=V-1
460 MO=F1*(V+M1)-F2*MO
462 M1=V
```

TABLE 1-continued

PROGRAMS

```
463 IF NN=10 THEN 470
464 FOR W=1T0(DT*33-23)
466 SW=SIN(.2)
468 NEXT W
470 NEXT NA
475 RETURN
    LENGTH CONTROL SUBR
600 POKE 40961,T4
605 POKE 40960,2
610 POKE 40971,T3
615 POKE 40968,T2
620 POKE 40969,T2
625 J=T5
630 K=J-ABS(DL/C2)
635 0=INT((J-K)/T3+1)
640 IF 0>3 THEN 0=3
645 0=T4-SM(0)*SGN(DL)
650 POKE 40961,0
655 TU=PEEK(40969)
660 TL=PEEK(40968)
665 J=TU*T1+TL
670 IF J>K GOTO 635
675 POKE 40960,0
680 RETURN
    PRINTOUT SUBR
800 IF LEFT$(P$,1)<>Y$ GOTO 900
803 CY=CY+1
804 PRINT "--------------------"
805 PRINT "CYCLE NO.="CY
810 PRINT "MASS FLOW="FNR(MO)
820 PRINT "SCREEN POS.="FNR(LN)
830 PRINT "POS. CHANGE="FNR(DL)
840 PRINT "FLOW RATIO="FNR(MO/MI)
850 PRINT "INPUT EST.="FNR(MI)
900 RETURN
    ERROR
999 PRINT "FLOW STOPPED!!!"
1000 END
    WEIGHBELT CALIBRATION
2000 NN=1
2010 POKE 40962,2
2015 POKE 40963,255
2020 POKE 40960,0
2025 F1=.02172
2030 F2=-.53846
2035 DT=3
2040 GOSUB 400
2045 PRINT "MASS FLOW="MO
2050 GOTO 2040
2060 END
```

ADAPTIVE HIERARCHICAL CONTROL

The preferred control scheme described above is a form of adaptive hierarchical control comprised of both a continuous monitoring system with feed-back control to correct for min- ute-to-minute process variations and an on-demand, discrete sampling and analysis step to update existing set-point values and to handle long term drift or known process alterations. To avoid the use of expensive and complex continuous monitoring systems which directly measure particle size distribution, the continuous system is operated on the basis of monitoring a process parameter which is particle size dependent, namely, the mass flow rate of the output particle stream relative to the mass flow rate of the feed.

Figure 13:
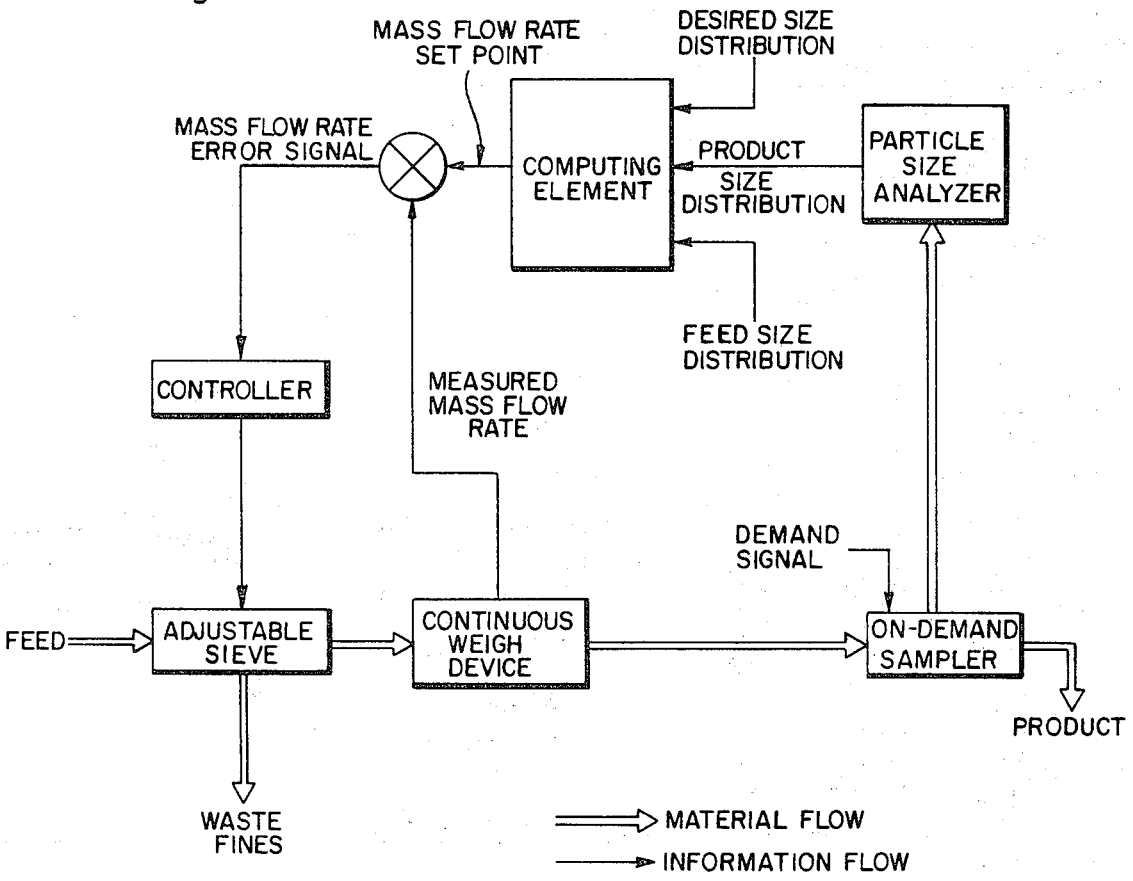
FIG. 13 is a block diagram of a hierarchial control means for the differential rate screening system of the invention.

The discrete sampling and analysis aspect of the control scheme may be comprised of an off-line sampling of the product stream and a rapid sieve analysis carried out either automatically or manually on a periodic basis and as needed to ensure compliance of the screened product with the preselected specifications. This on-demand scheme represents a practical standard against which both system performance and final product may be judged. The hierarchical concept of control is applicable to the control systems of FIGS. 1, 4 and 6 and is illustrated more generically in FIG. 13. The system shown in FIG. 13 is designed to accommodate material which has excessive fines. However, a return loop for returning oversize particles to the crusher supplying the feed (not shown) may be incorporated for controlling both fines and overs, the overs returned to the crusher being further reduced in size.

The discrete sampling of the product stream may be performed on demand, either by manual sampling or by automatic sampling, in response to an appropriate demand signal, the origin of which is not shown in the figure. This signal may be preprogrammed to call for a sample at regular intervals of time, or it may be in response to some monitored operating parameter of the system, such as open screen length. Open screen length can be monitored by monitoring the position of the screen blocking member, if that is the device used to vary open screen length, or the position of a feed conveyor, if that is the means employed to alter the open screen length. The scope of the invention is not limited to these means for executing on-demand sampling, and those skilled in the art will see other means for realizing the objectives of the adaptive-control scheme.

In the embodiment of FIG. 13, the characteristics of the incoming uncrushed stone and of the crusher output are determined and the crusher and adjustable screen are set up to provide a basic size distribution range in the feed and product, respectively. Trimming control of the size distribution within these ranges to maintain a desired size distribution specification and/or fineness modulus in the product is achieved by adjustments to the adjustable screen in response to a signal generated by changes in the mass flow rate of overs coming off the screen. In other words, the mass flow rate information from the continuous weigh device is compared with a mass flow rate set point and an error signal is used as the basis for screen adjustment.

If there is a substantial change in the nature of the feed to the screen, such as the particulates being of a different size distribution, this change will alter the overs mass flow rate required to maintain the desired particle size distribution of the product. The purpose of the on-demand particle size analysis is to detect the consequences of such a substantial change in the feed so that a new mass flow rate set point can be implemented to compensate for that change. In this way, the system "adapts" to changes in the character of the incoming feed to the adjustable screen. In the embodiment of FIG. 13, the advantages of "adaptive control" include keeping the need for a complete size analysis to a minimum while maintaining a continuous check on product output. The on-demand checks for particle size distribution can be made at regular intervals or, alternatively, the need for such a check can be recognized if it is observed that the screen-blocking member is abnormally displaced from its customary operating position. To those skilled in the art it will be evident that other means exist for restoring the system to normal operation, including modification of the feed size distribution by appropriate adjustment of the crushing operation.

The objective of holding to a preselected product size distribution can be assured most evidently by monitoring and evaluating the product stream, either continuously or intermittently. Nothing is as convincing as a sieve analysis performed on the actual material to be marketed, e.g., stonesand manufactured in accordance with the ASTM C-33 Specification. The attractiveness of such an approach, however, does not preclude control concepts based on direct monitoring of the feed size distribution. The scope of the present invention encompasses a variety of schemes for controlling the differential rate screening process, including feedback and feedforward alternatives, with or without utilization of the adaptive-control principle.

FEEDBACK CONTROL ALTERNATIVES

In a straightforward application of feedback control, the output of the screen is monitored through some form of particle size analysis of the product. An error signal then forms the basis for adjusting a variable screening parameter, such as the open screen length of the screen and/or the size reduction characteristics of the crushing machine, to null out the error signal. A return flow of material for either rescreening or recrushing may also be provided. Because there may be limitations on the transient capacity of various elements in the system, as well as time lags associated with particle size analysis (depending on the method used), it may be necessary to incorporate in the system some form of "capacitance," such as surge bins or other components for delaying material transfer.

Figure 14:
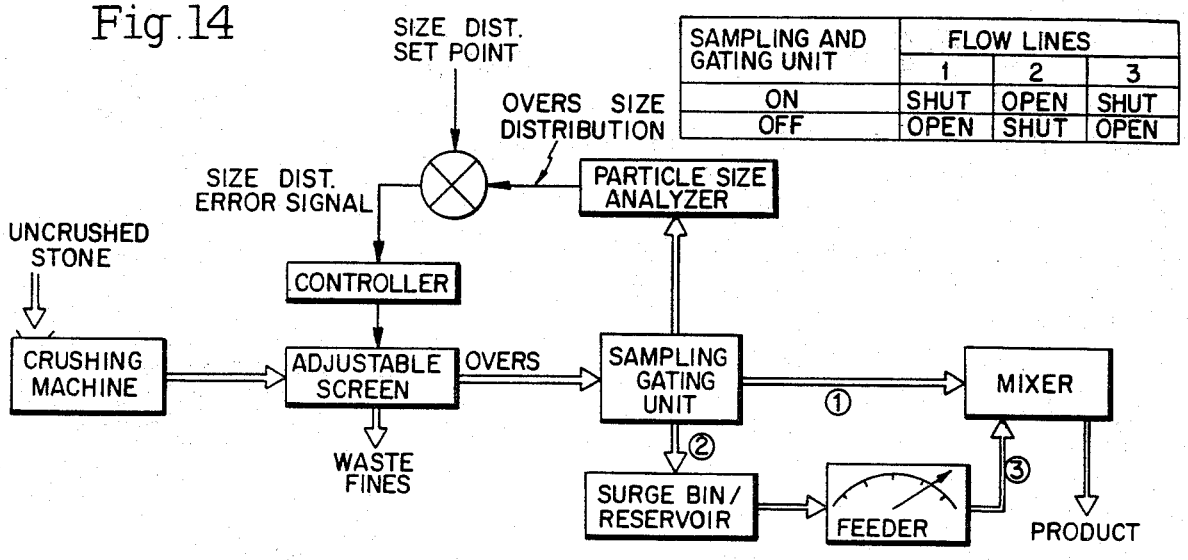
FIG. 14 is a block diagram of a feedback control means for the differential rate screening system of the invention.

FIG. 14 illustrates a control system employing closed-loop control of the adjustable differential rate screening operation but open-loop control of the crusher. Ostensibly, the crusher would be set at a fixed speed and at fixed throughput rate. Closed-loop control might be used to maintain these operating conditions, but the crusher operates open-loop so far as information feedback from the product size distribution is concerned.

The system of FIG. 14 presupposes that the crushing machine is set to produce material which tends to be "overground"—that is, material which contains excess fines. The excess fines are removed by a differential rate-controlled screen which operates according to the principles discussed elsewhere and the overs from the screen ultimately become the product. The overs are sampled by means of a sampler or splitting device, and the sample is fed to a particle size analyzer, which generates size-distribution information for control purposes.

The analyzer may be as simple as an accelerated sieve analysis employing a system capable of sieving a sample to completion in a relatively short length of time or one of the more complex devices previously described for directly measuring particle size distribution on a continuous basis. Of course, the time interval for manual sampling and analysis introduces a time lag so far as adjustment of the screen is concerned and may allow the passage of some amount of unsatisfactory material into the product stream before the output can be corrected. For example, if 5 minutes is required to sieve a sample, as much as a ton or so of material could go downstream during that time if the system is operating at approximately 10 tons per hour. However, if this material is fed to a mixer by way of a reservoir or surge bin, as shown, and if the system is designed with a several-minute holdup capacity, the product stream can be "smoothed" to eliminate inhomogeneities in particle size distribution.

The operation of the control system of FIG. 14 is as follows. An appropriate set point is determined as some scalar function of the desired, preselected particle size distribution. This function can be mean particle size, fineness modulus, a point on the cumulative size distribution, or other parameter as may occur to those skilled in the art. A particle-size analyzer operates in conjunction with a sampling unit, presumed in FIG. 14 to be of the intermittent variety. Cooperating with the sampling unit is a gating element which, during the time the analysis is being performed, diverts the output from the screen to a surge bin or reservoir where it accumulates until the analysis is complete. Material from the reservoir is then metered out by the feeder at a rate which permits it to be intimately mixed with material coming from the adjustable screen after the error correction has been implemented. It will be evident that if the particle size analyzer is of the continuously monitoring variety, the mixing system, including the mixer, feeder, reservoir and associated gating unit may be eliminated.

Figure 15:
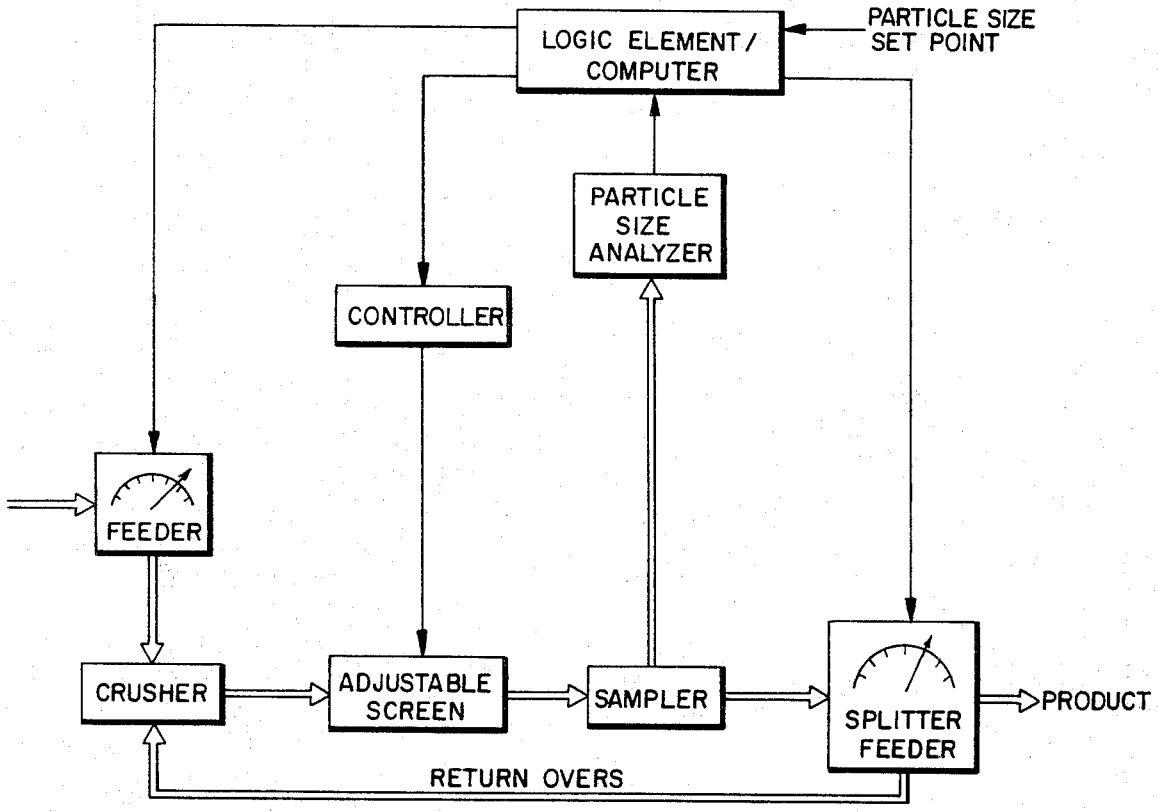
FIG. 15 is a block diagram of a feedback control means providing a return stream of oversize material in accordance with the invention.

In the event that material retained on the screen is too coarse to meet specifications, a means may be provided to eliminate excessive overs. One option is to screen the overs on a second screen and take the fines of that screen as the usable product. The second screen could return overs for recrushing. An alternative scheme and one which has certain advantages is shown in FIG. 15. This figure shows information from a size analyzer being fed to a logic element or computer (such as an AIM-65 microprocessor). This arrangement generates control signals for three purposes: (1) control of the adjustable screen; (2) diverting screen output as a return stream to the crusher; and (3) control of the rate of feed of unground stone to the crusher. A surge bin in the overs return loop may be required, but it is omitted here. It is assumed that the sampling and particle size analysis system is of the continuously monitoring variety, but it is to be recognized that the scope of the invention is not limited to such a system.

The system shown schematically in FIG. 15 operates as follows. So long as the crusher produces material with excess fines, the logic element would call for only screening control of the size distribution, and no returns would go to the crusher for recrushing. However, the logic could include a provision for diminishing waste fines by increasing the rate of feed to the crusher and/or by decreasing the crusher speed. Should excessive adjustment result in excess overs, this would be detected by the particle size analyzer as soon as the effects of the adjustment reach the sampling point. The logic element would then call for a counteracting correction and/or send a signal to the splitter feeder to direct a portion of the material back to the crusher for further crushing. Again, a surge bin may be required in the return line, but is omitted here.

By controlling the rate of returns and rate of feed of uncrushed stone, the system can be made to maintain a desired rate of throughput to the crusher. One other option of many would be to do a three-way split, with a return stream going to the screen as well as to the crusher. If material with excess fines comes off the screen, a portion may be sent back for additional screening (again with the prospect that a surge bin may be necessary). If material with excess overs comes off the screen, a portion may be sent back to the crusher for further crushing.

Clearly many possibilities for feedback control exist, and it is evident that these possibilities cover a gamut of degrees of sophistication. It is not the intent here to be exhaustive, but to disclose additional modes of size distribution control. One important consideration in selecting a control scheme is the matter of control stability. It is entirely possible that if control corrections are made at discrete and relatively long time intervals (possibly governed by the time required for a manual sieve analysis), the control loop could become unstable. In other words, a correction dictated by a current size analysis could call for a correction which would be inappropriate at the time it is applied and could therefore induce oscillations or ever increasing error signals. A delay line appropriately introduced into the system may therefore help keep information flow and material flow in time phase. Alternatively, some version of feedforward control may be employed.

FEEDFORWARD CONTROL

Figure 16:
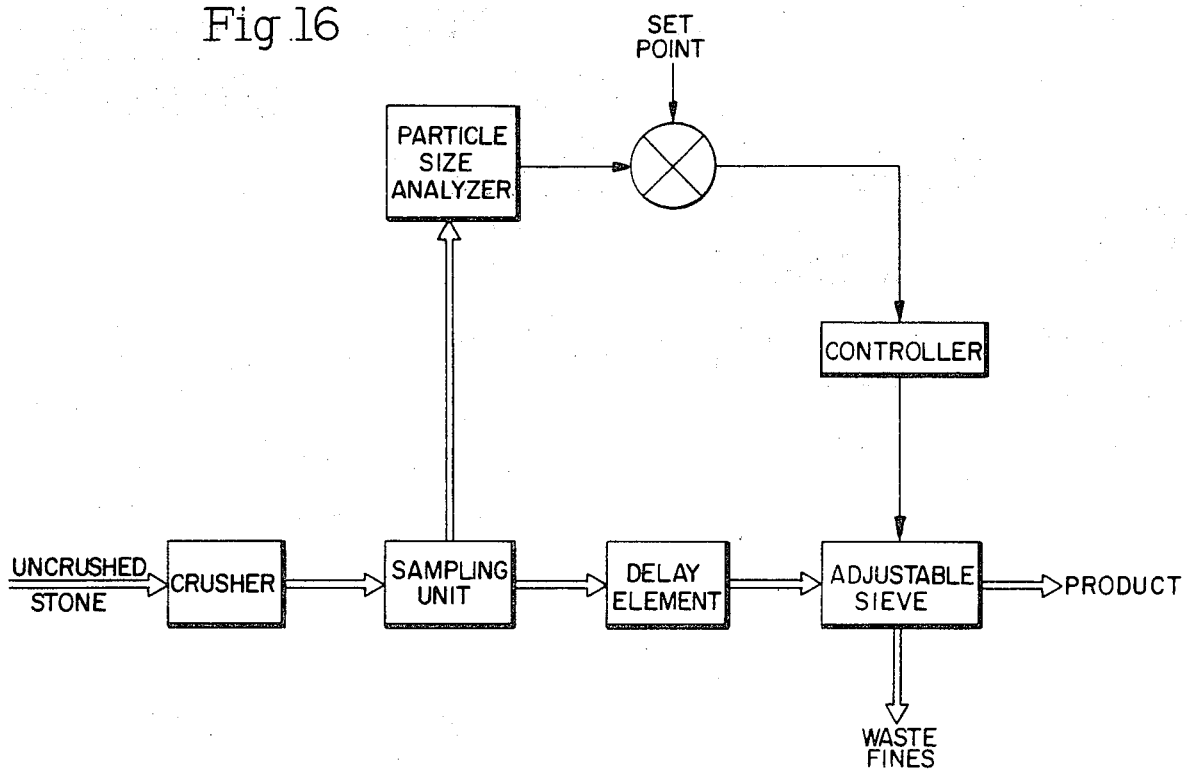
FIG. 16 is a block diagram of a feed-forward control means for the differential rate screening system of the invention.

An illustration of the principles of feedforward control is provided in FIG. 16. In the figure, it is presumed that a single screen is sufficient to adjust the size distribution by removing fine particulates from an excessively ground crusher output. Rather than monitoring the size distribution of the screen output, the size distribution of the crusher output (i.e., the feed to the screen) is monitored. Knowledge of the feed size distribution dictates the screening which must be done in order to adjust the product size distribution so that it comes within specifications. By delaying the output of the crusher a sufficient length of time to perform seive analysis, an adjustment signal can be sent forward to the screen so as to arrive in phase with the corresponding material flow. Such delay may be accomplished by discharging the output from the crusher into a holding bin and metering material out of the bin onto the screen by means of a screw conveyor or other appropriate material handling equipment. It will be evident that a timing element, not shown in the figure, may be required to synchronize the throughput of material with information from the particle size analyzer. In FIG. 16 it is presumed that the sampler and particle size analysis unit is of the continuously monitoring variety and that the delay of material throughput may be minimal since it is necessary only to compensate for any time lag involved in the particle size analyzer. The scope of the invention is not limited to this type of sampling, however, and it will be evident that intermittent sampling and longer cycle times for particle size analysis can be accommodated by incorporating the mixing concepts set forth in FIG. 14.

It will be further evident to those skilled in the art that both feedback and feedforward principles can be incorporated in the control system. If the transfer functions of the screening operation are sufficiently accurate, feedforward control can be relied upon to satisfy the particle size distribution in the product. In some cases, however, it may be necessary to monitor the output of the screen and make compensating adjustments by means of a secondary control loop. It will be further evident that the use of an adaptive control concept in conjunction with the feedback and feedforward control loops is within the scope of the present invention.

Figure 17:
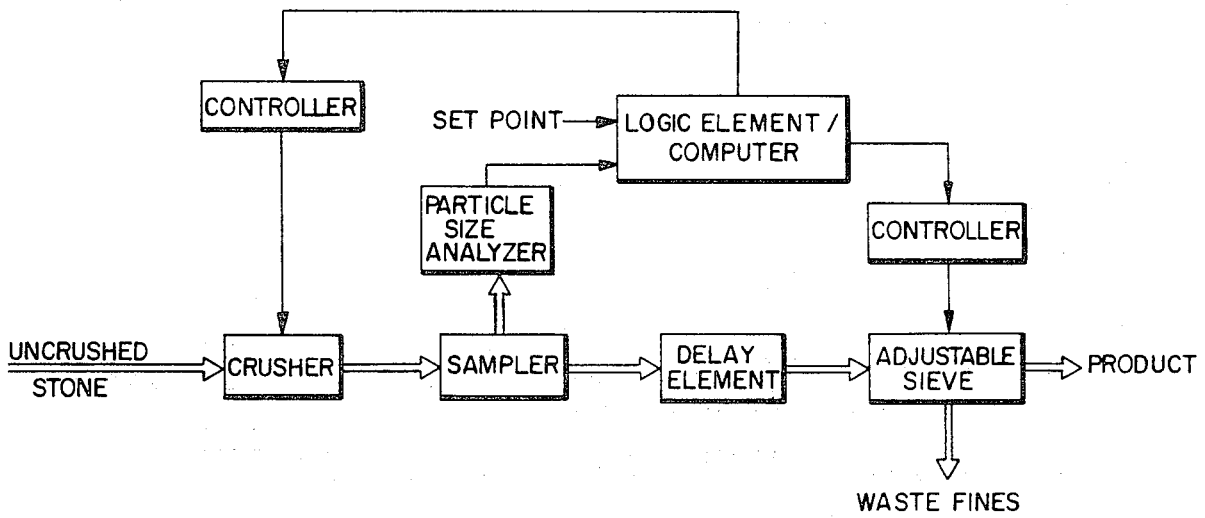
FIG. 17 is a block diagram of a control means incorporating both feed-forward and feedback elements for control of the differential rate screening system of the invention.

An embodiment which advantageously employs both feedback and feedforward control is illustrated in FIG. 17. Acting on information received from the particle size analyzer, the logic unit of FIG. 17 generates a feedforward signal to the screen and/or a feedback signal to the crusher. So long as the output from the crusher has excess fines, the logic calls for screen adjustment to remove those fines. If the output from the crusher contains excess coarse material, clearly no amount of screening will bring the product into specifications. Instead, the computer calls for more complete crushing. Although the controller for this purpose is shown as a generalized element, its function may be realized by employing a controlled feeder to the crusher or a speed or other size reduction control for the crusher itself. Though the particle size analyzer and sampling unit are presumed here to be of the continuous monitoring variety, the scope of the invention is not limited to continous sampling.

Although no recycle stream is shown in FIG. 17, a return line may be incorporated to recycle coarse material to the crusher by means of a splitter feeder, as in FIG. 15. The scope of the invention also does not preclude returning material for additional screening in circumstances in which additional screening would be advantageous. It is clear that many other options for control by means of feedback, feedforward or adaptive loops or a combination of these control loops will occur to those skilled in the art.

PRINCIPLES OF DIFFERENTIAL RATE SCREENING

In order to select the mesh size and length for each screen, establish operating values for each effective screening parameter, and set up the adjustable components of the system so as to achieve and control the alteration in size distribution needed to convert feed to product, some understanding of the physical processes involved in screening and of the quantitative equations representing a continuous, differential rate screening process may be necessary. Consideration is therefore given below to the formulation of basic relations relative to the differential rate screening process. These form the bases of practical schemes for setting up and controlling the differential rate screening apparatuses described above. The invention thus provides a simple quantitative characterization of differential rate screening sufficient to set up and operate differential rate screening systems over a wide range of conditions.

In order to quantify certain features of the differential rate screening process for purposes of system setup and control it is convenient to indicate relevant mass flow rate balance relations and introduce generalized mass transfer functions.

Figure 18A:
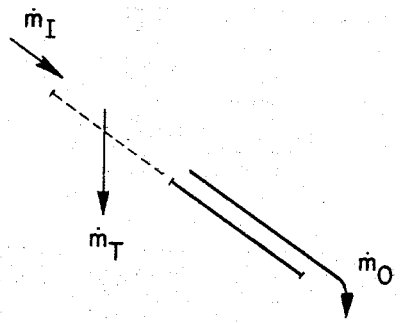
FIG. 18*a*–18*c* are diagramatic illustration of the mass flow rate balances for operating a single differential rate screen in accordance with the invention.
Figure 18B:
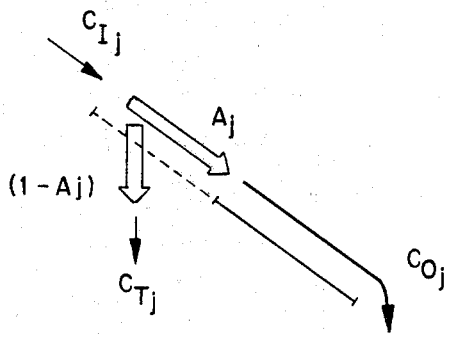
Figure 18C:
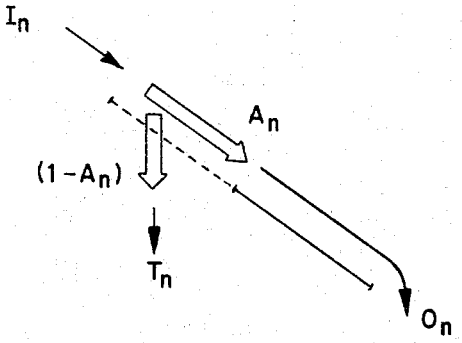

First consider the case of a single screen as shown in FIG. 18. The mass flow rate balance for total flow, FIG. 18(*a*), becomes $$\dot{m}_I = \dot{m}_O + \dot{m}_T, \tag{1}$$

where $\dot{m}_I$ = mass flow rate of input, $\dot{m}_O$ = mass flow rate of overs, $\dot{m}_T$ = mass flow rate of throughs.

The terminology "input" to the screen is used here rather than the previously used term "feed" because feed is reserved in the following considerations to apply to the overall input to the screening system.

Two mass flow rate ratios f and g are defined by:

$$f = \frac{\dot{m}_T}{\dot{m}_I} \tag{2}$$

-continued $$g = \frac{\dot{m}_O}{\dot{m}_I} \tag{3}$$

From equations (1), (2) and (3) it follows that:

$$f+g=1. \tag{4}$$

Next consider the mass flow rate balance for each individual size class. Following customary procedure an individual size class of particles is defined as consisting of all particle sizes between the mesh sizes of two successive classification screens. Herein the index j is used to denote a particular size class. Further, the ratio of mass of particles in a size class j to the total mass of all particles in the parent size distribution is defined as the mass fraction of the distribution in size class j. This mass fraction is designated by $C_{Ij}$ for the input, $C_{Oj}$ for the overs and $C_{Tj}$ for the throughs.

Suppose the size distribution of input material has a mass fraction $C_{Ij}$ in size class j. Then the input mass flow rate in size class j is $\dot{m}_I C_{Ij}$. This is balanced by the sum of the mass flow rates for particles in the same size class which pass over and through the screen. This balance is written:

$$\dot{m}_I C_{Ij} = \dot{m}_O C_{Oj} + \dot{m}_T C_{Tj} \tag{5}$$

where $C_{Oj}$ and $C_{Tj}$ are the mass fractions of the overs and throughs, respectively, in the size class j. The size class j in the feed may be visualized as a substream having the mass flow rate shown in equation (5) and the overs and throughs of size class j may be visualized as portions of this substream of the feed. It should be noted that the mass fractions for all the size classes j sum to unity for each separate stream (i.e., input, overs or throughs) consistent with the way each size distribution is determined by sieve analysis:

$$\sum_j C_{Ij} = 1 \tag{6}$$

$$\sum_j C_{Oj} = 1$$

$$\sum_j C_{Tj} = 1.$$

Further, consider the mass flow rate balance for the cumulative size distributions of the input, overs, and throughs particle streams. The cumulative size distribution indicates the mass fraction of particles with sizes less than a given screen mesh size. Equivalently this mass fraction can be expressed as a sum of the mass fractions of the constituent size classes j smaller than the given mesh size. In particular if the size classes j are arranged in order of increasing particle size and if the mesh size of the largest screen used to define size class j=n is the same as the given screen mesh size, then the summation will run over the size index values j=1 to n. The given mesh size in this case will be referred to as "the mesh size with (or corresponding to) index n." The mass flow rate balance expression is then obtained from relation (5) by forming the following sum:

$$\dot{m}_I \sum_{j=1}^{n} C_{Ij} = \dot{m}_O \sum_{j=1}^{n} C_{Oj} + \dot{m}_T \sum_{j=1}^{n} C_{Tj}. \tag{7}$$

Alternately this can be expressed in a form which resembles expression (5), that is $$\dot{m}_I I_n = \dot{m}_O O_n + \dot{m}_T T_n, \tag{8}$$

where the cumulative mass fractions of material in the input, overs and throughs streams with particle sizes smaller than the mesh size corresponding to index n are designated by $I_n$, $O_n$ and $T_n$, respectively, and where $$I_n = \sum_{j=1}^{n} C_{Ij} \tag{9}$$

$$O_n = \sum_{j=1}^{n} C_{Oj}$$

$$T_n = \sum_{j=1}^{n} C_{Tj}.$$

It is also possible to characterize the effect of the screening process on the mass flow rate within each size class j by introducing a class transfer function $A_j$. Here $A_j$ is defined mathematically as a function of the screen operating parameters such that when it is multiplied by the input mass flow rate in size class j, the result is the mass flow rate of overs in the same size class. Hence, by definition:

$$\dot{m}_O C_{Oj} = A_j \cdot (\dot{m}_I C_{Ij}). \tag{10}$$

Substituting equation (10) in (5) gives a corresponding expression for the mass flow rate of material of size class j which passes through the screen:

$$\dot{m}_T C_{Tj} = (1 - A_j) \cdot (\dot{m}_I C_{Ij}). \tag{11}$$

Thus the transfer function for the mass flow rate of throughs for size class j is $(1-A_j)$. Upon dividing both sides of equations (10) and (11) by $m_O$ and $m_T$, respectively, and using equations (2) and (3), the following alternate forms are obtained:

$$C_{Oj} = \frac{A_j}{g} C_{Ij} \tag{12}$$

$$C_{Tj} = \frac{(1 - A_j)}{f} C_{Ij}. \tag{13}$$

These forms now refer to the mass fractions of the relevant size distributions. In effect, $A_j/g$ can be thought of as the transfer function which characterizes the action of the screen in changing the size distribution of the input into the size distribution of the overs. Likewise, $(1-A_j)/f$ can be thought of as the transfer function which relates the input distribution to that of the material which passes through the screen. These transfer functions can be viewed in an operational sense as shown in FIG. 18(*b*), where $A_j/g$ is the factor which changes $C_{Ij}$ into $C_{Oj}$, and $(1-A_j)/f$ is the factor which changes $C_{Ij}$ into $C_{Tj}$.

Equations (12) and (13) when rearranged are convenient to use in determining the transfer function experimentally. They become:

$$A_j = g \frac{C_{Oj}}{C_{Ij}} = 1 - f \cdot \frac{C_{Tj}}{C_{Ij}}. \tag{14}$$

It is also convenient to introduce another transfer function $A_n$, called the cumulative transfer function in this specification, to characterize the effect of the screening process. This function $A_n$ relates the mass flow rate of the input to the mass flow rate of the overs in the category of sizes smaller than the mesh size with index n. In other words, the transfer function $A_n$ acts on the portion of the input particle stream consisting of particles smaller than mesh size with index n (which may be of mesh size less than or equal to that of the screen with index S actually used for differential rate screening) to give the mass flow rate of particles in this same size range which remain in the overs stream. Hence, by definition:

$$\dot{m}_O O_n = A_n \dot{m}_I I_n. \tag{15}$$

This relation is similar in form to relation (10), but expression (15) applies to the cumulative size distributions rather than to individual size classes.

From relations (8) and (15) a corresponding expression is obtained for the mass flow rate of particles in the same size range which pass through the screen:

$$\dot{m}_T T_n = (1 - A_n)\, \dot{m}_I I_n. \tag{16}$$

These cumulative trasfer functions are shown in an operational sense in FIG. 18(*c*).

It is noted that the transfer function $A_n$ is defined relative to a particular differential rate screen with size index S. If a different screen with size index S' is used as basis, the value of the transfer function $A_n'$ for the cumulative size of index n will differ from the value of the function $A_n$ based on a screen with index S.

The following rearrangement of equations (15) and (16) are convenient to use in determing the cumulative transfer function experimentally:

$$A_n = 1 - \frac{fT_n}{I_n} = g\frac{O_n}{I_n}. \tag{17}$$

The following relation also exists between the cumulative transfer function $A_n$ and the class transfer function $A_j$:

$$A_n I_n = \sum_{j=1}^{n} A_j C_{Ij}, \tag{18}$$

as can be readily shown.

The preceding formulations can be readily extended to the case of two or more screens as may be used in the differential rate screening systems of the invention. In these cases, a superscript is introduced to designate which screen is being referred to, e.g., $(\ )^{(1)}$ = Screen No. 1 (the top screen in FIG. 4)

$(\ )^{(2)}$ = Screen No. 2 (the bottom screen in FIG. 4)

Figure 19A:
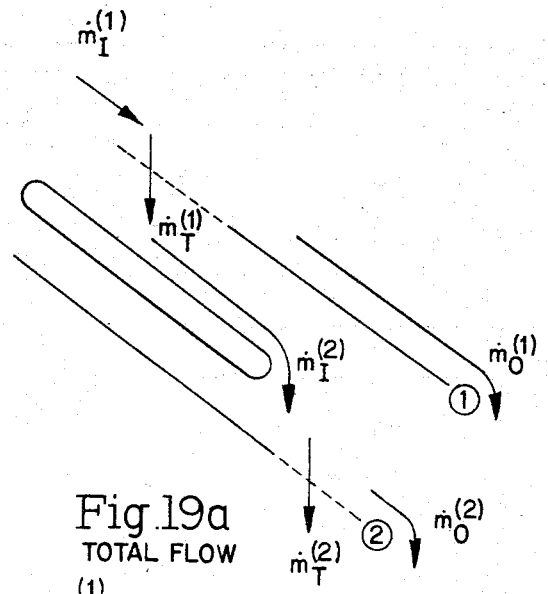
FIG. 19*a*–19*c* are diagramatic illustration of the mass flow rate balances for operating successive differential rate screens in accordance with the invention.
Figure 19B:
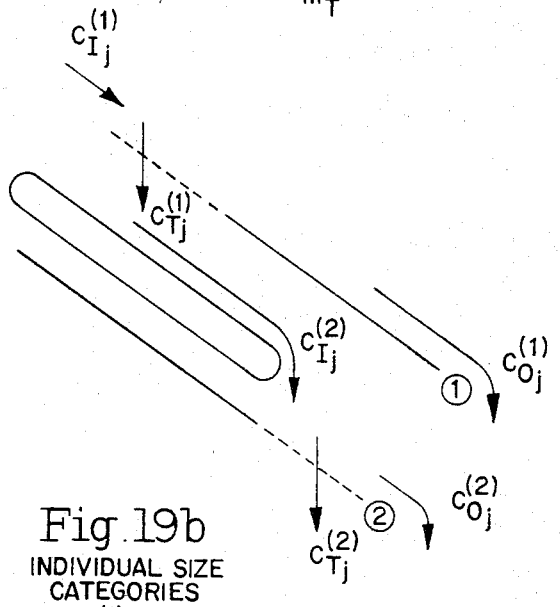
Figure 19C:
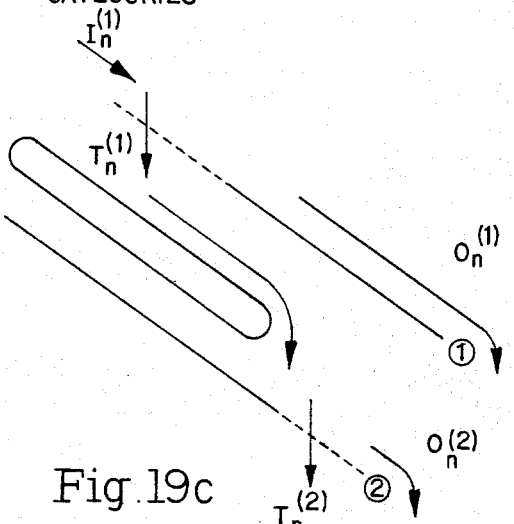

The configurations shown in FIGS. 19(*a*), 19(*b*), and 19(*c*) apply. The mass flow rate balance relations for total flow become:

$$\dot{m}_I^{(1)} = \dot{m}_O^{(1)} + \dot{m}_T^{(1)} \tag{19}$$

$$\dot{m}_T^{(1)} = \dot{m}_I^{(2)} = \dot{m}_O^{(2)} + m_T^{(2)}. \tag{20}$$

In equation (20) the fact has been used that the mass flow rate which passes through the first screen becomes the input mass flow rate to the second screen. While this is the case in the configuration of FIG. 4, it would not be the case in the configuration of FIG. 6 where the input mass flow rate to the second screen is the mass flow rate of overs from the first screen. The mass flow rate ratios for FIG. 4 are now given by:

$$f^{(1)} = \frac{\dot{m}_T^{(1)}}{\dot{m}_I^{(1)}} \qquad g^{(1)} = \frac{\dot{m}_O^{(1)}}{\dot{m}_I^{(1)}} \tag{21}$$

$$f^{(2)} = \frac{\dot{m}_T^{(2)}}{\dot{m}_I^{(2)}} \qquad g^{(2)} = \frac{\dot{m}_O^{(2)}}{\dot{m}_I^{(2)}} \tag{22}$$

and $$r = f^{(1)} g^{(2)} = \frac{\dot{m}_T^{(1)}}{\dot{m}_I^{(1)}} \cdot \frac{\dot{m}_O^{(2)}}{\dot{m}_I^{(2)}} = \frac{\dot{m}_O^{(2)}}{\dot{m}_I^{(1)}}. \tag{23}$$

The balance of mass flow rates in a given size class j becomes:

$$\dot{m}_I^{(1)} C_{Ij}^{(1)} = \dot{m}_O^{(1)} C_{Oj}^{(1)} + \dot{m}_T^{(1)} C_{Tj}^{(1)} \tag{24}$$

$$\dot{m}_T^{(1)} C_{Tj}^{(1)} = \dot{m}_I^{(2)} C_{Ij}^{(2)} = \dot{m}_O^{(2)} C_{Oj}^{(2)} + \dot{m}_T^{(2)} C_{Tj}^{(2)}. \tag{25}$$

The transfer functions for each size class j now need to be defined for each screen. These functions are given by:

$$\dot{m}_O^{(1)} C_{Oj}^{(1)} = A_j^{(1)} \cdot (\dot{m}_I^{(1)} C_{Ij}^{(1)}) \tag{26}$$

$$\dot{m}_O^{(2)} C_{Oj}^{(2)} = A_j^{(2)} \cdot (\dot{m}_I^{(2)} C_{Ij}^{(2)}). \tag{27}$$

As in the case of a single screen, these can be rearranged into forms interpretable as transfer functions which relate the input size distribution to that of the overs and throughs. The configuration of FIG. 19(*b*) applies and one finds:

$$C_{Oj}^{(1)} = \frac{A_j^{(1)}}{g^{(1)}} C_{Ij}^{(1)} \tag{28}$$

$$C_{Tj}^{(1)} = C_{Ij}^{(2)} = \frac{(1 - A_j^{(1)})}{f^{(1)}} C_{Ij}^{(1)} \tag{29}$$

$$C_{Oj}^{(2)} = \frac{A_j^{(2)}}{g^{(2)}} C_{Ij}^{(2)} = \frac{A_j^{(2)}(1 - A_j^{(1)})}{g^{(2)} f^{(1)}} C_{Ij}^{(1)} \tag{30}$$

$$C_{Tj}^{(2)} = \frac{(1 - A_j^{(2)})}{f^{(2)}} C_{Ij}^{(2)} = \frac{(1 - A_j^{(2)})(1 - A_j^{(1)})}{f^{(1)} f^{(2)}} C_{Ij}^{(1)}. \tag{31}$$

The cumulative transfer functions for mass flow rate of particles smaller than the mesh size with index n can also be defined for each screen by particularizing the relations (15) and (16).

In terms of the cumulative transfer functions $A_n^{(1)}$ and $A_n^{(2)}$, defined relative to screens $S^{(1)}$ and $S^{(2)}$ respectively, the particles smaller than the mesh size with index n which pass through the first screen are:

$$T_n^{(1)} = \frac{(1 - A_n^{(1)})}{f^{(1)}} I_n^{(1)}, \tag{32}$$

and those which pass over the second screen are:

$$O_n^{(2)} = \frac{A_n^{(2)}}{g^{(2)}} I_n^{(2)}. \quad (33)$$

Since the mass flow rate through the first screen in the configuration of FIG. 4, is the input to the second screen, the following relations hold:

$$\dot{m}_I^{(1)} T_n^{(1)} = \dot{m}_I^{(2)} I_n^{(2)}, \quad (34)$$

and $$\dot{m}_I^{(1)} = \dot{m}_I^{(2)}, \quad (35)$$

and $$T_n^{(1)} = I_n^{(2)}. \quad (36)$$

Combining the above gives:

$$O_n^{(2)} = \frac{A_n^{(2)}(1 - A_n^{(1)})}{f^{(1)} g^{(2)}} I_n^{(1)}. \quad (37)$$

Hence, the cumulative mass fraction for mesh size with index n for the product (overs in this case) is given in terms of the corresponding cumulative mass fraction values of input to the first screen, the cumulative transfer functions for the two screens, and the mass flow ratios for both screens.

The complexity of these relations suggests that it would be very difficult to define precisely the fractional values represented by either type of transfer function as an explicit function of each of the influential screening parameters. This difficulty is circumvented by using a combination of offline experimental measurements and simple approximation procedures to set up the differential rate screening system.

For purposes of approximating the operational performance of differential rate screens, two performance representation techniques are used. The first is an exponential model (which can be applied graphically), and the second is a graphical representation involving both the class and cumulative transfer functions.

An explicit model for approximating a class transfer function which is of use because of its simplicity is the following exponential model:

$$\overset{*}{A}_j^{(1)} = e^{-kj(i)L(i)} \quad (38)$$

This model represents a transfer function for screen i and mass flow rate of particles in size class j, whose locus of values is a straight line on a semi-log plot of $\overset{*}{A}_j$ versus open screen length $L^{(i)}$. This straight line locus passes through the "origin" where $\overset{*}{A}_j = 1.0$ and $L = 0$. Use of this model is discussed in the following sections in connection with system setup.

A second useful representation of screen transfer function characteristics is a graphical presentation. In this scheme the (approximate) class transfer functions $A_j$ for particles of size classes j=1 to n, which correspond to the components of the cumulative transfer function $A_n$, are plotted as functions of $A_n$. This particular plot is most useful when the concern is with material which passes over a screen, such as the lower screen of FIG. 4. As an alternative form of this second representation, the transfer functions $(1-A_j)$ for particles of size classes j=1 to n may be plotted as functions of $(1-A_n)$, where again the $A_j$ correspond to the components of the cumulative transfer function $A_n$. This form is most useful when the concern is with material which passes through a screen, such as the top screen in the system of FIG. 4. It is particularly convenient in both representations to take the mesh size with index n of the cumulative transfer function $A_n$ equal to the mesh size (of index S) of the screen used for differential rate screening. In this case the function $A_n$ is denoted by $A_S$.

SYSTEM SETUP

In any screening operation the feed to the screen is decomposed into a throughs stream and an overs stream. In differential rate screening, the screen operates in an adjustable mode, and its action can be modified in response to one or more measured characteristics of one or more of these streams. It is evident that if the screen is to be adjusted controllably so as to produce a preselected particle size distribution in one of the effluent streams, means must be provided for translating a given screen adjustment into its corresponding effect on the size distribution of the selected output stream. Conversely, if a given change in output size distribution is specified, means must be provided for translating that change into the corresponding screen adjustment required to produce that change. Establishing the relationship between screen adjustment and particle size distribution modification and specifying the operating conditions required to produce a preselected particle size distribution in the product is referred to herein as the setup problem.

A first task in setting up a differential rate screening system is to determine the number of screens to be used and to make a provisional selection of screen mesh sizes. Though it is possible to envision product particle size specifications and feed size distributions for which more than two successive screens might be needed, current experience with practical inputs suggests that a two-screen system will satisfy a large percentage of practical cases to be encountered. The screen mesh sizes can often be selected by examination of the feed and the desired specification size distribution.

Figure 5:
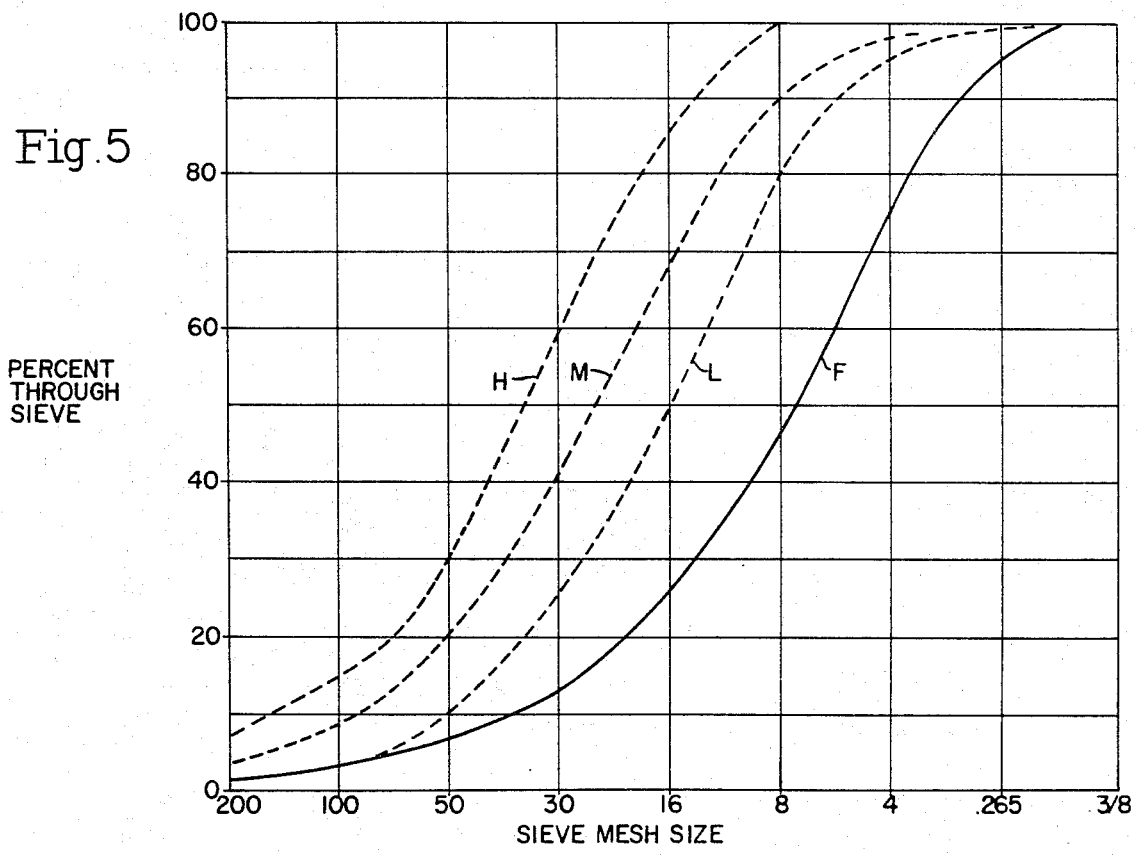
FIG. 5 is a plot of cumulative size distributions for ASTM C-33 Specification stonesand and sample feed materials.

An example will suffice to illustrate this point. FIG. 5 illustrates the mass-size distribution limits and the mid- or centerline of the ASTM C-33 Standard Specification for Concrete Aggregates as adapted for stonesand, together with the size distribution for a sample of $-\frac{3}{8}$ inch crushed limestone used in some of the operational tests to be described below. It is evident that this material, if used as the feed to a screening process, is too coarse and that size distribution adjustment must consist, in part, of the removal of excess coarse material.

By reference to the centerline of the C-33 Specification, it is evident that less than 3% of the material in the product can be allowed to exceed 4-mesh and that the percentage of material coarser than 4-mesh must lie within bounds of 0% to 5% even if the extremes of the C-33 Specification are allowed. Since the feed material contains about 25% of its mass in sizes greater than 4-mesh, it is evident that a 4-mesh screen is a likely candidate for removing excess coarse material. It will be further evident, however, that complete removal of material coarser than 4-mesh will not satisfy the C-33 Specifiction and that portions of material in finer size fractions such as −4+8 mesh, −8+16 mesh, and so on will also have to be removed. It is here that the principle of incomplete screening becomes an evident advantage, because incomplete screening on a 4-mesh screen is capable of removing material finer than 4-mesh.

It will be evident to those familiar with the adjustment of particle size distributions that removal of coarse fractions from a size distribution has the effect of enriching the finer fractions in the adjusted distribution. To prevent this enrichment process from proceeding too far is the function of the second or bottom screen, which provides a means for removing excess fines from the material passing through the top screen. It is for this reason that a two-screen system is found to be widely applicable in practice. In the present example, the product is taken as material which passes through the top screen and is retained on the bottom screen. Selection of the mesh size of the bottom screen is not obvious, but bases for its selection will be seen to evolve from experience with the incomplete screening principle. Often the mesh size of the bottom screen is advantageously selected to be near the size of the smallest particles desired in the product but not so fine as to cause screen blinding or other operational difficulties. In the instance of satisfying the C-33 Specification, the bottom screen is often advantageously selected as either 30-mesh or 50-mesh.

Setup of the differential rate screening system also involves appropriate selection and implementation of values of the various screening parameters so that in operation the system will convert a feed material with known size distribution into a product which meets a predetermined size distribution specification. There are, of course, associated questions concerned with realizability of a solution; maintaining a practical (generally large) throughput for the system; and operation of the system under conditions which will require a minimum amount of control to keep the product within suitable specification boundaries. The scope of the invention encompasses two different but similar ways to approach the setup problem.

In one embodiment, the control function for the adjustable screen is temporarily disabled so that known, discrete changes can be made in the operating values of the adjustable screen parameter. The corresponding effects on particle size distribution are observed and, by interpolation, a set-point value is selected for the adjustable screen parameter, the set point being capable of producing a size distribution in substantial agreement with the one desired. The control function for the adjustable screen is then activated to maintain compliance with the selected set point. This approach can be referred to as the static approach to set-point determination. In another embodiment, which can be referred to as the dynamic approach to set-point determination, the control function for the adjustable screen remains active and is the means by which the operating value of the adjustable screen parameter is determined. The preferred embodiment will be determined by the nature of the screening application, as will become evident in the following to one versed in process-control principles.

STATIC SET-POINT DETERMINATION

The technique advanced here for operational setup of the differential rate screening system employs the simple exponential model for transfer functions together with results of sieve analysis for selected product samples.

The scheme can be used in setting up a differential rate screening system whether or not the system is configured with a capability for measuring mass flow rate or for automatically controlling flow rate or screen open length. In other words, it could be effective for use with a system which employed mere manual adjustment of open screen lengths, and no weighbelt or control system. These procedural alternatives arise from the fact that the system setup is achieved by use of direct measurement results. Changes in how the system operates in the vicinity of this set point depend principally on the mass flow rate ratios rather than the absolute values of mass flow rates. The needed mass flow rate ratio information can be obtained during setup by taking an additional selected flow sample for each regular sample and sizing both by sieve analysis. As confirmation that this approach does work analytically, a setup sample was carried through without using mass flow rate data provided by the Autoweigh unit.

Use of the static technique presupposes that the feed material exhibits a relatively constant size distribution and that its mass flow rate is relatively constant. The setup procedure which follows applies specifically to the screening system of FIG. 4, but may be readily adapted to other system configurations. The procedure, itself, treats first the top screen alone and then deals with both the top and bottom screen as a complete system.

(a) Set the top screen at a trial open screen length $L^{(1)}=l_1$ and close the bottom screen. Set the feed mass flow rate at a desired value, if such a value is known. If the feed rate must be determined as well, then two flow rate conditions may need to be run so that a suitable value can ultimately be attained via interpolation or extrapolation of selected characteristics of the output stream. In the latter case, set the feed rate to a value that represents a likely lower or upper bound.

(b) With the system operating, measure the feed mass flow rate and sample the feed for subsequent analysis of particle size distribution. Shift the feed flow onto the top screen, measure the mass flow rate of the throughs and sample the throughs for particle size analysis. If no flow rate measurements are made, the overs must also be sampled so the mass flow rate ratios which apply to the top screen can be determined for the run. Without stopping the material flow, reset the bottom screen to a predetermined value $L^{(2)}=l_2$ of open screen length, measure the mass flow rate of the overs, and sample the overs for particle size analysis. The overs of the bottom screen forms the product stream in this case.

(c) This will result in 3 (or 5) samples for sieve analysis. This analysis will lead to the transfer functions $(1-A_j^{(1)})$ $A_j^{(2)}$ for the upper and lower screens for a given feed rate. To obtain information for establishing feed flow rate, repeat the foregoing steps at the second bounding value of feed rate. For a constant input size distribution, this will result in an additional 2 (or 4) samples, at the second feed rate for sieve analysis. The resulting data will allow determination of transfer functions as above at the second feed rate.

(d) Plot the transfer functions on a semi-log plot, with $A_j^{(1)}$ on the log scale against open screen length $L^{(1)}$ on the linear scale. Similarly, plot $A_j^{(2)}$ versus open screen length $L^{(2)}$. Construct exponential model approximations to the transfer functions in each case by connecting the function values for different sizes j with the "origin" at $A_j^{(1)}==1.0$, $L^{(j)}=0$ using straight lines.

(e) From these straight lines determine approximate transfer function values $(1=A_j^{(1)})$ and $A_j^{(2)}$ for intermediate screen lengths of $$L^{(1)}=\frac{l_1}{2} \text{ and } L^{(2)}=\frac{l_2}{2}.$$

(f) Select two mass-fraction values corresponding to given screen sizes on a particular (e.g., median) cumulative size distribution curve within the particle size band associated with the size distribution specification. These two mass fractions, together with the selected top screen mesh size, effectively constitute three constraints to be imposed on the product size distribution. Limited experience suggests that one of the selected mass-fraction values should be near 0.25 and the other near 0.75. If the small particle size end of the distribution is the most critical, these values may both need to be lowered somewhat. Since the cumulative size distribution curve is nondecreasing, a small particle size is associated with the small mass-fraction value and a larger particle size with the larger mass fraction value. Let "a" refer to the cumulative mass fraction corresponding to the small particle size, and "b" refer to one minus the mass fraction corresponding to the larger particle size. Note how many and which explicit size classes j span the size range less than the small particle size associated with "a", and those which span the size range greater than the larger particle size associated with "b". The quantities "a" and "b" each represent a sum of specific mass fractions $C_{Oj}^{(2)}$ of the desired product size distribution. Each such sum can be expressed in terms of the corresponding values $C_{Ij}^{(1)}$ of the feed, together with the transfer functions $(1-A_j^{(1)})$ and $A_j^{(2)}$ using formula (30).

(g) For example, if the largest two size classes, say j=6, 7 contribute to the value of "b", then the explicit equation for this constraint is:

$$b=[C_{I6}^{(1)}(1-A_6^{(1)})+C_{I7}^{(1)}(1-A_7^{(1)})]\cdot 1/r \tag{39}$$

where is is assumed that the lower screen will not pass particles in size classes j=6 or 7 and therefore that $A_6^{(2)}=A_7^{(2)}=1.0$.

(h) Likewise, if the smallest three size classes j=1, 2, 3. . . contribute to the value of "a", then the explicit equation for this constraint is:

$$a=[C_{I2}^{(1)}(1-A_1^{(1)})A_1^{(2)}+C_{I2}^{(1)}(1-A_2^{(1)})A_2^{(2)}+C_{I3}^{(1)}(1-A_3^{(1)})A_3^{(2)}]\cdot 1/r \tag{40}$$

Both of these equations are exact, and can readily be adapted to alternate conditions as needed. Although these analytical expressions are known, the values of the transfer functions, the corresponding open screen lengths and the flow rate ratio r which are required to satisfy the constraint equations are unknown. A graphical means for obtaining a solution follows.

(i) Using the transfer function values $A_j^{(1)}$ and $A_j^{(2)}$ measured for the given values of $L^{(1)}=l_1$ and $L^{(2)}=l_2$, approximated for $L^{(1)}=l_1/2$ and $L^{(2)}=l_2,/2$, and known analytically to be unity for $L^{(1)}=L^{(2)}=0$, together with the corresponding measured value of r, and the values $C_{I6}$ and $C_{I7}$ obtained from the feed size distribution, the right hand side of equations (38) and (40) can be evaluated. Strictly, the value of r also changes, but these changes can usually be neglected without serious error. Consider the "b" equation first. Plot the calculated right hand side values as ordinate and corresponding open screen length $L^{(1)}$ values as abscissa. Construct a simple smooth curve through these points. Determine the abscissa corresponding to the point where this curve intersects the line of constant ordinate whose value equals (b). This gives a solution $L^{(1)}=L_1$. If the curve does not intersect the line, then no exact solution exists for this combination of parameters. In general a second feed flow value must then be used, and, in difficult cases, different combinations of other operating parameters as well. Using the solution $L_1$, approximate the corresponding transfer functions $(1-A_j^{(1)})$ from the previous semi-log transfer function plots. Next, determine a solution for $L^{(2)}=L_2$ in a similar manner, utilizing the "a" equation and the approximate $(1-A_j^{(1)})$ just obtained.

(j) From the approximate solutions $L_1$ and $L_2$, their corresponding approximate transfer function values and the size distribution of the feed, the predicted mass-size distribution of the product can be evaluated.

Figure 21:
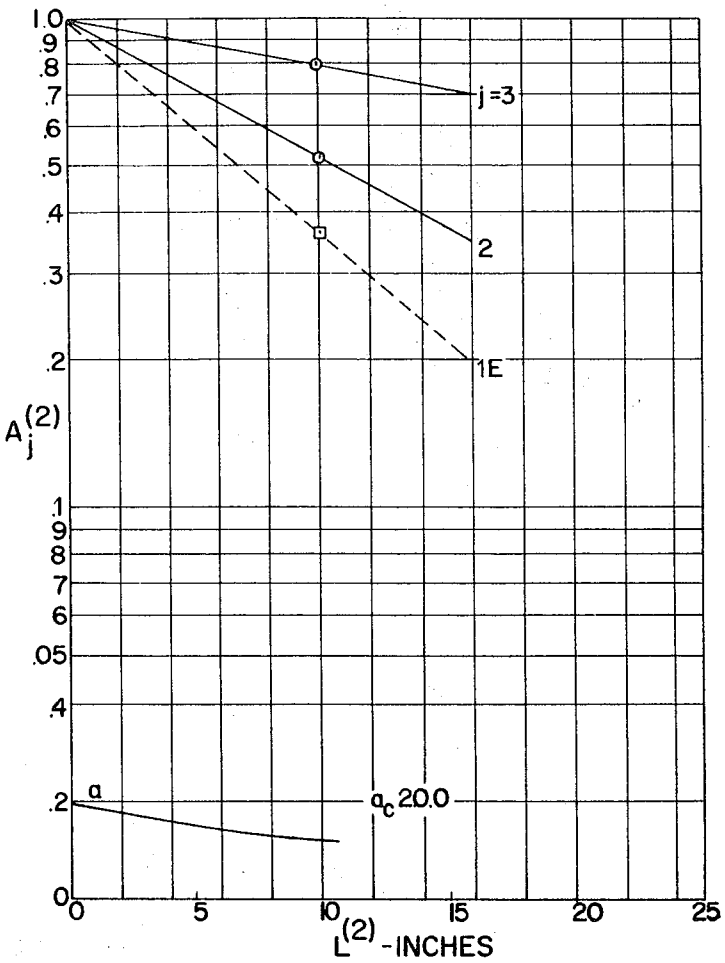
FIG. 21 illustrates a static setup procedure for the bottom screen of the differential rate screening system of FIG. 4.
Figure 20:
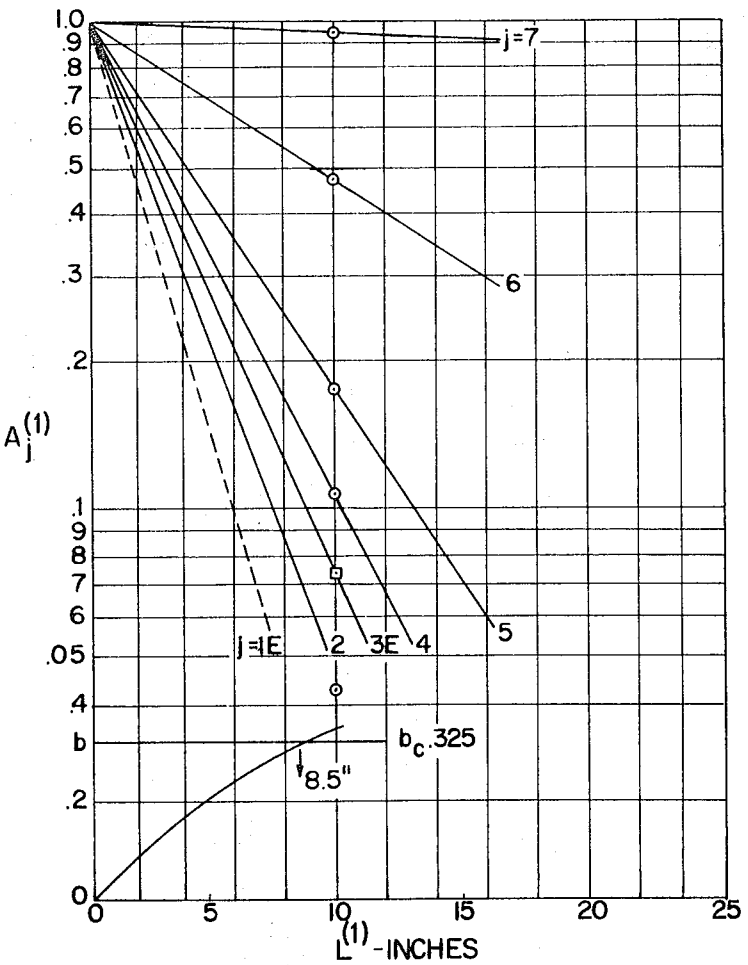
FIG. 20 illustrates a static setup procedure for the top screen of the differential rate screening system of FIG. 4.
Figure 22:
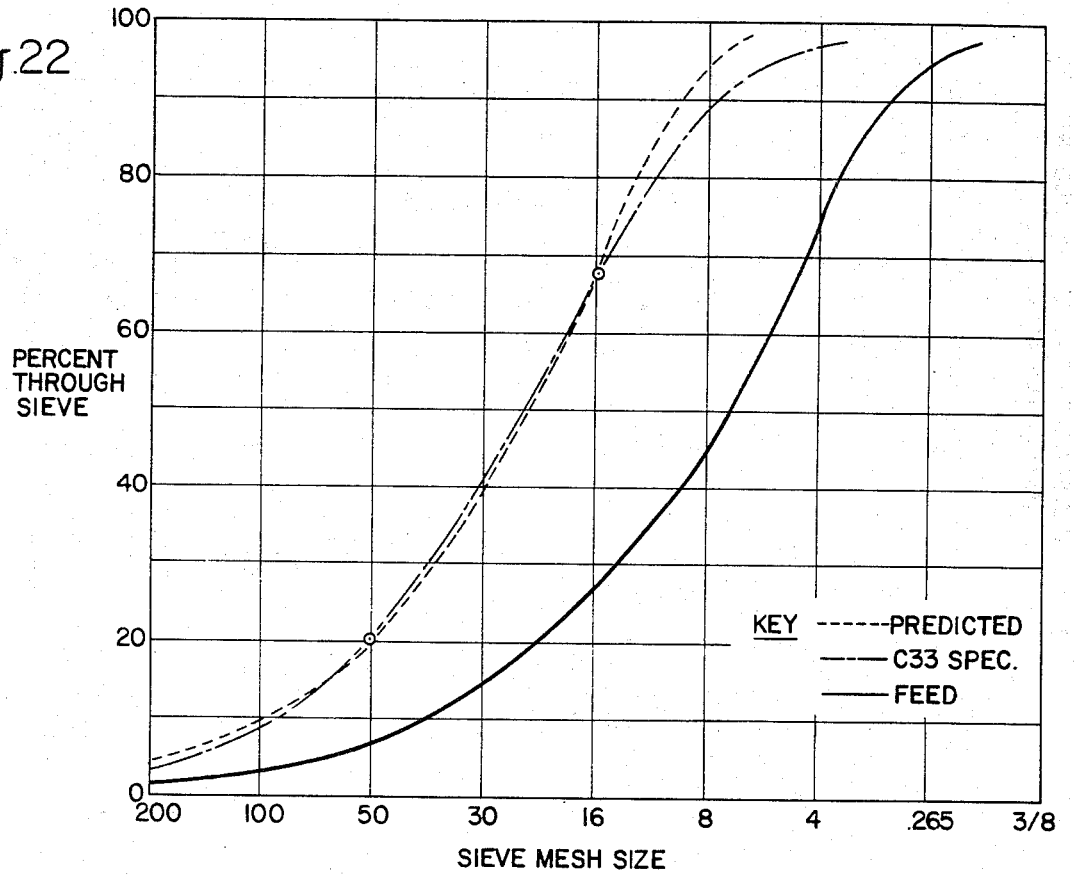
FIG. 22 is a plot of the cumulative size distribution predicted by the static setup procedures of FIGS. 20 and 21.

An example is given in Table 2 and in FIGS. 20, 21 and 22 to illustrate this setup scheme in detail. In this example, a 4-mesh top screen and 50-mesh bottom screen were used together with the C-33 size distribution specification. Only a single feed rate was used; this was independently measured at 9.8 tons per hour for this test.

TABLE 2

TOP AND BOTTOM SCREEN SET-UP VIA STATIC PROCEDURE

DISTRIBUTIONS:

TEST DATE: 1-22-81
TEST NO: 2710
SCREEN #1: 4 MESH
SCREEN #2: 50 MESH
FROM PLOTS & CURVES

| | | | $L^{(1)}=10''$, $L^{(2)}=0''$ | | $L^{(1)}=10''$, $L^{(2)}=10''$ | | $A_j^{(1)}/g^{(1)}=C_{Oj}^{(1)}/$ | | $A_j^{(2)}/g^{(2)}=C_{Oj}^{(2)}/$ | $L^{(1)}=10''$, 1 − | $L^{(2)}=10''$, 1 − | $L^{(1)}=5''$, 1 − | $L^{(2)}=5''$, 1 − | $L=8.5''$, 1 − | |
|---|---|---|---|---|---|---|---|---|---|---|---|---|---|---|---|
| INDEX$_j$ | Size | $C_{Ij}^{(1)}$ | $C_{Oj}^{(1)}$ | $C_{Tj}^{(1)}$ | $C_{Oj}^{(1)}$ | $C_{Oj}^{(2)}$ | $C_{Ij}^{(1)}$ | $A_j^{(1)}$ | $C_{Tj}^{(1)}$ | $A_j^{(1)}$ | $A_j^{(2)}$ | $A_j^{(1)}$ | $A_j^{(2)}$ | $A_j^{(1)}$ | CALC $C_{Oj}^{(2)}$ |
| 8 | −⅜ +4 | .247 | .378 | | .425 | | 1.530 | 1.000 | .277 | 0 | 1.0 | 0 | 1.0 | 0 | |
| 7 | −4 +8 | .305 | .439 | .0721 | .427 | .0887 | 1.439 | .741 | 1.230 | .057 | 1.0 | .030 | 1.0 | .050 | .047 |
| 6 | −8 +16 | .181 | .129 | .298 | .115 | .324 | .713 | .466 | 1.087 | .534 | 1.0 | .315 | 1.0 | .478 | .265 |

TABLE 2-continued

TOP AND BOTTOM SCREEN SET-UP VIA STATIC PROCEDURE

| | | | | | | | | | | | | | | | |
|---|---|---|---|---|---|---|---|---|---|---|---|---|---|---|---|
| 5 | −16 +30 | .121 | .0314 | .277 | .0190 | .276 | .260 | .170 | .996 | .830 | 1.0 | .590 | 1.0 | .779 | .287 |
| 4 | −30 +50 | .0768 | .0116 | .182 | .0062 | .181 | .151 | .097 | .994 | .901 | 1.0 | .690 | 1.0 | .861 | .203 |
| 3 | −50 +100 | .0370 | .0050 | .0878 | .0016 | .0760 | .135 | .070E | .866 | .930E | .804 | .737 | .895 | .896 | .102 |
| 2 | −100 +200 | .0161 | .0010 | .0408 | .0016 | .0228 | .0062 | .043 | .559 | .957 | .519 | .797 | .720 | .932 | .046 |
| 1 | −200 | .0161 | .0050 | .0376 | .0046 | .0302 | .310(?) | .020E | .803(?) | .980E | .365E | .860 | .600 | .960 | .048 |

$b = [C_{16}^{(1)}(1 - A_6^{(1)}) + C_{17}^{(1)}(1 - A_7^{(1)})] \cdot \frac{1}{r}$ $\quad \frac{1}{g^{(1)}} = 1.530 \quad \frac{1}{g^{(2)}} = 1.076 \quad b_c = .325$ ( )"E" DENOTES ESTIMATE $a = [C_{11}^{(1)}(1 - A_1^{(1)})A_1^{(2)} + C_{12}^{(1)}(1 - A_2^{(1)})A_2^{(2)} + C_{13}^{(1)}(1 - A_3^{(1)})A_3^{(2)}] \cdot \frac{1}{r}$ $\quad g^{(1)} = .654 \quad g^{(2)} = .929 \quad a_c = .200$ $f^{(1)} = .346 \quad f^{(2)} = .071 \quad r_{10'',10''} = f^{(1)}g^{(2)} = .321$ $b_{10''} = (.1176) \cdot \frac{1}{r} = .356 \quad a_{10} = (.04008) \cdot \frac{1}{r} = .125$ b GRAPH GIVES $L_1 \simeq 8.5''$ $b_{5''} = (.6616) \cdot \frac{1}{r} = .206 \quad a_{5''} = (.04975) \cdot \frac{1}{r} = .155$ a GRAPH GIVES $L_2 \simeq 0''$ $b_{0''} = 0 \quad a_{0''} = (.06361) \cdot \frac{1}{r} = .198$ NOTE: $A_j^{(2)} = 1.0$ FOR ALL $j$ WHEN $L^{(2)} = 0$ Samples of the material which passed over the top screen were taken and sized by sieve analysis. The results of the first sample (for $L^{(1)}=10$ inches, $L^{(2)}=0$ inches) were used in evaluating the flow rate ratio $f^{(1)}$. The flow rate ratio $f^{(1)}$ arises from calculation of the mass-fraction ratio $C_{Oj}^{(1)}/C_{Tj}^{(1)}$ for the size classes j that cannot pass through the top screen. By equation (28) this ratio is equal to $A_j^{(1)}/g^{(1)}$, but for the particular size classes used $A_j^{(1)} \equiv 1$, so the ratio is directly equal to $1/g^{(1)}$. The value of $f^{(1)}$ follows using equation (4). A corresponding scheme is used to evaluate $1/g^{(2)}$ and $f^{(2)}$ using the ratio $C_{Oj}^{(2)}/C_{Tj}^{(1)}$. In this case an average of the ratios for the several size classes larger than the screen are used.

The constraint values adopted were $a=0.20$ and $b=0.325$. The corresponding points on the C-33 size specification centerline are shown circled in FIG. 22. Graphical solutions give setup lengths of $L^{(1)}=L_1=8.5$ inches and $L^{(2)}=L_2=0$ inches. These length values represent approximations, since approximate transfer function values have been used in the graphical solutions. These approximate results indicate that, for the example shown, one screen (i.e., the top screen) should be adequate.

Using the individual class transfer function values and the flow rate ratios corresponding to these setup values, the predicted product size distribution was calculated and plotted in FIG. 22 together with the centerline C-33 distribution. The predicted distribution compares favorably with the size specification.

The setup steps just indicated should generally give a close estimate for values of open screen lengths and mass flow rate ratios required to produce screened material close to specifications. If the product size distribution obtained from a confirmatory run using these approximate setup values is not as close as desired to the size specification, then the foregoing static setup procedure can be repeated to refine the solution. In such a case, the setup values obtained above are used as the starting trial values. Convergence of the results of such successive approximation should be quite rapid so that no more than a second correction of the setup values should be required.

DYNAMIC SET-POINT DETERMINATION

As in the static technique, this scheme presupposes that the feed material exhibits a relatively constant particle size distribution and that its mass flow rate to the screen is very nearly constant. It is assumed that the original size distribution of the feed has been determined and that the product (at least) can be sampled and subjected to sieve analysis upon demand.

The dynamic approach to set-point determination is based on the assumption that mass flow rate is available as a measured characteristic of an output stream from the screen and that means exist for monitoring the ratio between this mass flow rate and the mass flow rate of the feed. The control system is configured so that once a desired mass flow rate is set, the system adjusts the open screen length to maintain that mass flow rate ratio. It is therefore not necessary to know explicitly the relation between transfer function and open screen length, given that the relation between screen transfer function and mass flow rate ratio is known. The position control system can be given the burden of increasing or decreasing the open length of the screen to attain the value of the transfer function required to realize the preselected particle-size distribution in the product. The setup procedure described below deals first with the top screen alone and then treats the setup of the overall system.

(a) Establish a trial feed rate and determine the mass flow rate ratio corresponding to some intermediate value of the cumulative transfer function for the top screen about midway between the extreme values of zero and one. The required mass flow rate ratio can be computed directly from the feed rate and the known particle size distribution of the feed. It is to be noted that, alternatively, a trial open length for the screen can be selected and the corresponding flow rate ratio determined by direct measurement of the input and output flow rates.

(b) Calculate the transfer functions $(1-A_j^{(1)})$ for material which passes through the screen for each size class j using equation (29). For this same sample determine the cumulative transfer function $(1-A_S^{(1)})$ from equation (17). Plot the values of $(1-A_j^{(1)})$ as ordinate and $(1-A_S^{(1)})$ as abscissa using linear scales. Fair a set of curves from the origin (0,0) through the sample points and to the point (1,1). In the event that there is considerable latitude as to how and where the curves should be drawn, repeat the process for a second intermediate value of the cumulative transfer function.

Figure 23:
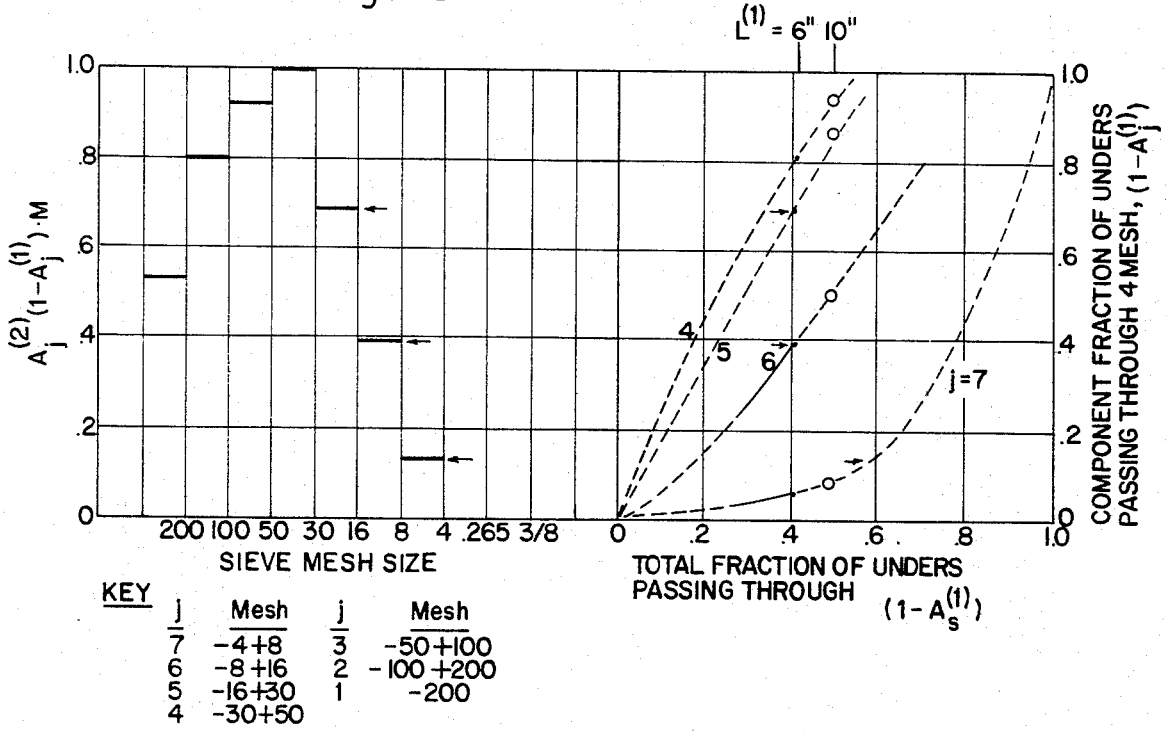
FIG. 23 illustrates a dynamic setup procedure for the top screen of the differential rate screening system of FIG. 4.

(c) From the feed distribution $C_{Ij}^{(1)}$ and the centerline values (or other chosen locus) of the desired size specification (denoted by Subscript "$S_p$") $[C_{Oj}^{(2)}]_{Sp}$ for the final product, determine the ratio $[C_{Oj}^{(2)}]_{Sp}/C_{Ij}^{(1)}$ and renormalize this set of values so the largest value becomes unity. Designate the renormalized ratios $[C_{Oj}^{(2)}]_{Sp}/C_{Ij}^{(2)}$ as $A_j^{(2)}(1-A_j^{(1)})\cdot M$, where M is a normalization constant. Plot the values $A_j^{(2)}(1-A_j^{(1)})\cdot M$ as ordinates on the same scale as that previously used for $(1-A_j^{(1)})$ versus size class interval j as abscissa. It is convenient to arrange these plots side by side as shown in FIG. 23. Select a particular trial value of $A_s^{(1)}$ and read the corresponding values of $A_j^{(1)}$ from the several curves. Once these values are known, the distribution which will result when the feed passes through the top rate screen for the given conditions can be predicted. If the distribution is not as desired, a different trial value of $A_s^{(1)}$ can be employed and a solution approached by iteration of the above procedure.

(d) With the top screen setting determined and the top screen reset to this value, one proceeds to find corresponding conditions for the bottom screen. This can be done in either of two ways.

(e) First, the system is run using a preselected value for $A_2^{(2)}$ as a set point for the position control system. The burden in this case is on the position control system to extend or close the open length of the screen until the mass flow ratio $g^{(2)}$ (or r) is attained that corresponds to the preselected value of $A_s^{(2)}$. When this condition is reached, the output product is sampled and size analyzed. This product output can be compared directly with the desired size distribution specification to ascertain agreement. If further adjustment appears necessary, a new value of $A_s^{(2)}$ must be determined and set into the length control system. In making this determination, it appears to be convenient to construct a plot of $A_j^{(2)}$ as ordinate versus the corresponding $A_s^{(s)}$ as abscissa, similar to the plot for the top screen. The measured value of $A_s^{(2)}$ and the corresponding $A_j^{(2)}$ calculated from the sample size analysis provide coordinate values for points through which a set of curves can be drawn for the second screen. Using the adjusted value of $A_s^{(2)}$, the system is run again and the product sampled and compared against the size specification.

(f) A second way of setting the bottom rate screen within this overall scheme involves following the same type of procedure used in the case of the top screen. One or two flow rate ratios are used, samples taken and analyzed and values of $A_j^{(2)}$ versus $A_s^{(2)}$ plotted. Curves are drawn through the origin, the data points and the (1,1) point to obtain results of the general type shown in FIG. 24. A trial value of $A_s^{(2)}$ (or $L_2$) is then selected and the corresponding values of $A_j^{(2)}$ are read from the curves. Upon combining the values of $1-A_j^{(1)}$ and $A_j^{(2)}$ for the full set of size classes j, the result for each j can be multiplied by the appropriate $C_{Ij}^{(1)}$, to obtain an unnormalized $C_{Oj}^{(2)}$. (Generally, values of $1-A_j^{(1)}$ and $A_j^{(2)}$ may both occur for some of the same size classes j. These must be multiplied together in that case.) By adding the $C_{Oj}^{(2)}$'s over all j and renormalizing so the sum equals unity, the predicted $C_{Oj}^{(2)}$ for the selected system settings is obtained.

The analytical features of this setup procedure are illustrated in a static sense in the following example. The system dynamics of adjusting the open screen length to seek out and maintain a mass flow rate ratio set point are not illustrated directly. However, the dynamic aspects of system behavior corresponds to the indicated analytical feature of convergence of the sequence of mass flow rate ratio trial values to the desired set point value.

The example is given in Tables 3 and 4 and FIGS. 23, 24, 25 and 26. The dynamic setup scheme was-carried out as indicated using samples taken at two lengths for each screen. Only one feed rate was used. A 4-mesh top screen and 50-mesh bottom screen were used together with the C-33 size distribution specification. Since the tests for setup of the top and bottom screens were run independently, and the feed size distributions measured for the two runs were not identical a separate feed size distribution was used in reducing the top screen data. The results of sieve analysis on the sample taken for the top screen at the open length $L^{(1)}$ of 6 inches were used as a basis for constructing the curves in FIG. 23. Estimates of $A_j^{(1)}$ for $L^{(1)}=10$ inches were read from the curves of FIG. 25 and used in FIG. 23 to help establish the curves. A value of $L^{(1)}=10$ inches was adopted as the value to use for setup of the bottom screen. This selection was based heavily on the results for the largest two size classes j=6 and 7.

A second test was made and samples of the overs from the bottom screen were taken for $L^{(2)}=0$, 5, 15 and 25 inches. The $L^{(2)}=0$ sample was used to directly determine the input to the second screen. The samples yielded useful transfer function values only for size classes j=2 and 3. Since the full system performance was influential in the bottom screen tests, the composite transfer function was recalculated for this case using the appropriate feed size distribution. The setup length $L^{(2)}=2$ inches was selected with little ambiguity.

Figure 26:
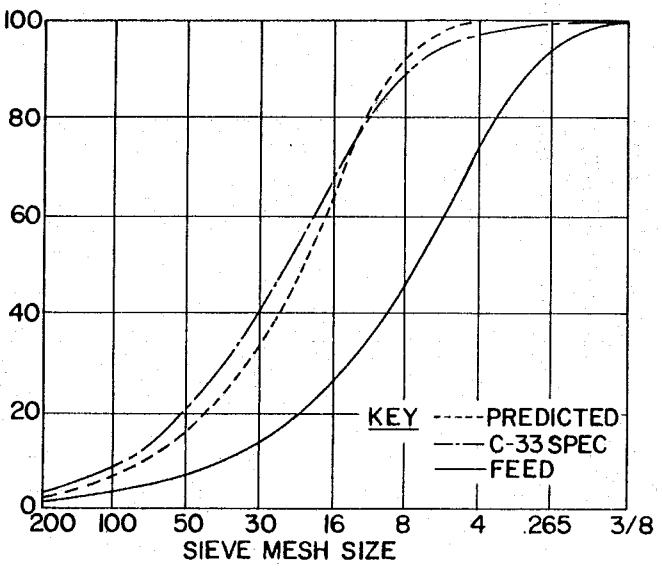
FIG. 26 is a plot of the cumulative size distribution predicted by the dynamic setup procedures of FIGS. 23 and 24.

Using the individual class transfer function values and the feed for the bottom screen tests, the predicted product size distribution was calculated and plotted in FIG. 26 together with the centerline C-33 distribution. The predicted product distribution compares favorably with the size specification.

TABLE 3

TOP SCREEN SETUP VIA DYNAMIC PROCEDURE

TEST DATE: 12-11-80 AM
TEST NO's: 2703 & 2706
SCREEN #1: 4 MESH

MASS FLOWS:

TABLE 3-continued

TOP SCREEN SETUP VIA DYNAMIC PROCEDURE $L^{(1)}$ 6″

$\dot{m}_I^{(1)}$ 5.643 TPH $\quad 1 - A_j^{(1)} = f^{(1)} \dfrac{C_{Ij}^{(1)}}{C_{Ij}^{(1)}} \quad 1 - A^{(1)} = \dfrac{f^{(1)}}{C_{IN}^{(1)}}$ $\dot{m}_r^{(1)}$ 1.887

$f^{(1)}$ .334

DISTRIBUTIONS:

| INDEX$_j$ | SIZE | $C_{Ij}^{(1)}$ | $L^{(1)} = 6''$ $C_{Ij}^{(1)}$ | $1 - A_j^{(1)}$ | $L^{(1)} = 10''$ $1 - A_j^{(1)}$ | MID C-33 $[C_{Oj}^{(2)}]_s$ | $\dfrac{[C_{Oj}^{(2)}]_s}{C_{Ij}^{(1)}(6'')}$ | TRANS FCTN (RENORM) |
|---|---|---|---|---|---|---|---|---|
| 8 | (−⅜ +4) | .1734 | | 0 | | 0 | 0 | 0 |
| 7 | −4 +8 | .2874 | .0514 | .0598 | .085 | .10 | .348 | .132 |
| 6 | −8 +16 | .2173 | .2534 | .3900 | .506 | .225 | 1.035 | .372 |
| 5 | −16 +30 | .1461 | .3014 | .6899 | .859 | .265 | 1.814 | .688 |
| 4 | −30 +50 | .0796 | .1917 | .8053 | .934 | .210 | $\boxed{2.638}$ | 1.000 |
| 3 | −50 +100 | .0475 | .1165 | .8202 | ~.99 | .115 | 2.421 | .918 |
| 2 | −100 +200 | .0238 | .0462 | .6491(?) | ~1.0 | .050 | 2.101 | .796 |
| 1 | −200 | .0249 | .0394 | .5291(?) | ~1.0 | .035 | 1.406 | .533 |
| $1 - A^{(1)}$ | | | | .4051 | .47 | | | |

TABLE 4

BOTTOM SCREEN SETUP VIA DYNAMIC PROCEDURE

TEST DATE: 12-11-80 PM
TEST NO: 2710
SCREEN #1: 4 MESH
SCREEN #2: 50 MESH

MASSFLOWS:

$L^{(1)} = 10''$ $\dot{m}_I^{(1)} = 5.460$ TPN $\quad A_j^{(2)} = g^{(2)} \dfrac{C_{Oj}^{(2)}}{C_{Ij}^{(1)}}$ $L^{(2)} = 0''$ $\quad L^{(2)} = 5''$ $\quad L^{(2)} = 15''$ $\quad L^{(2)} = 25''$ $\dot{m}_I^{(1)} = 2.507$ TPN $\quad \dot{m}_O^{(2)} = 2.434$ $\quad \dot{m}_O^{(2)} = 2.203$ $\quad \dot{m}_O^{(2)} = 2.155$ $\quad A^{(2)} = 1 - \dfrac{(1 - g^{(2)})}{C_{IN}^{(2)}}$ $f^{(1)} = .4592$ $\quad g^{(2)} = .9709$ $\quad g^{(2)} = .8787$ $\quad g^{(2)} = .8596$

DISTRIBUTIONS:

| IN-DEX$_j$ | SIZE | $C_{Ij}^{(1)}$ | $L^{(2)} = 0''$ $C_{Ij}^{(1)}$ | 5″ $C_{Oj}^{(2)}$ | 15″ $C_{Oj}^{(2)}$ | 25″ $C_{Oj}^{(2)}$ | 5″ $A_j^{(2)}$ | 15″ $A_j^{(2)}$ | 25″ $A_j^{(2)}$ | MID C-33 $[C_{Oj}^{(2)}]_3$ | $\dfrac{[C_{Oj}^{(2)}]_3}{C_{Ij}^{(1)}}$ | TRANS. FCTN (RE-NORM) | $\left\{\begin{matrix} L^{(1)} = 10'' \\ L^{(2)} = 2'' \end{matrix}\right\}$ RENORM $A_j^{(2)}(1 - A_j^{(1)})$ | CALC. $C_{Oj}^{(2)}$ |
|---|---|---|---|---|---|---|---|---|---|---|---|---|---|---|
| 8 | −⅜+4 | .2506 | | | | | | | | 0 | 0 | 0 | 0 | |
| 7 | −4+8 | .2912 | .0610 | .0769 | .0774 | .0994 | 1.224 | 1.115 | 1.401 | .10 | .348 | .106 | .087 | .070 |
| 6 | −8+16 | .1990 | .2847 | .2752 | .3037 | .3182 | 1.007 | .937 | .961 | .225 | 1.131 | .343 | .522 | .287 |
| 5 | −16+30 | .1278 | .2957 | .2904 | .3065 | .2958 | .953 | .911 | .860 | .265 | 2.074 | .631 | .886 | .311 |
| 4 | −30+50 | .0638 | .1756 | .2072 | .2190 | .2009 | 1.146 | 1.096 | .983 | .210 | $\boxed{3.292}$ | 1.000 | .963 | .170 |
| 3 | −50+100 | .0357 | .0980 | .0879 | .0745 | .0654 | .871 | .668 | .574 | .115 | 3.221 | .978 | 1.000 | .077 |
| 2 | −100+200 | .0172 | .0443 | .0189 | .0043 | .0023 | .414 | .085 | .045 | .050 | 2.907 | .883 | .794 | .038 |
| 1 | −200 | .0147 | .0407 | .0188 | .0088 | .0090 | .448(?) | .190(?) | .190(?) | .035 | 2.381 | .723 | .619 | .025 |
| | $C_{IN}^{(1)} =$ | .7494 | $C_{IN}^{(2)} =$ | .1830 | | | $A^{(2)} =$ .841 | $A^{(2)} =$ .337 | $A^{(2)} =$ .233 | | | | | |

EXAMPLES 1–5

A key phenomenological aspect of the differential rate screening process is that the mass fraction of material which passes through a screen under given conditions changes, often exponentially, with open screen length L. The following examples indicate the experimental basis for this feature and certain other characteristics of differential rate screening.

Figure 27:
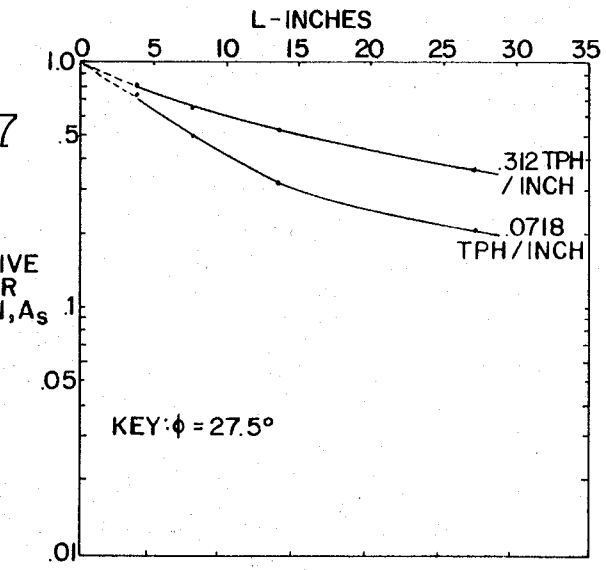
FIG. 27 is a plot of a cumulative transfer function, $A_s$, obtained from laboratory tests using a 30-mesh differential rate screen in accordance with the invention.

FIG. 27 shows, for different input mass flow rates, how the cumulative transfer function $A_s$ decays as a function of open screen length L. Recall that this transfer function is the ratio of mass flow rate of undersize material which passes over the screen to the total mass flow rate of material which could pass through the screen. Although these decay curves do not follow any known simple mathematical expression, the exponential model has been found to apply approximately to portions of these curves. As will be seen in the following examples, the exponential model applies somewhat better to the decay curves for the class transfer functions $A_j$ than to the cumulative transfer functions $A_s$.

The data for the decay curves of FIG. 27 were obtained using a single screen, laboratory scale differential rate screening system similar in concept to the system of FIG. 4.

Figure 28:
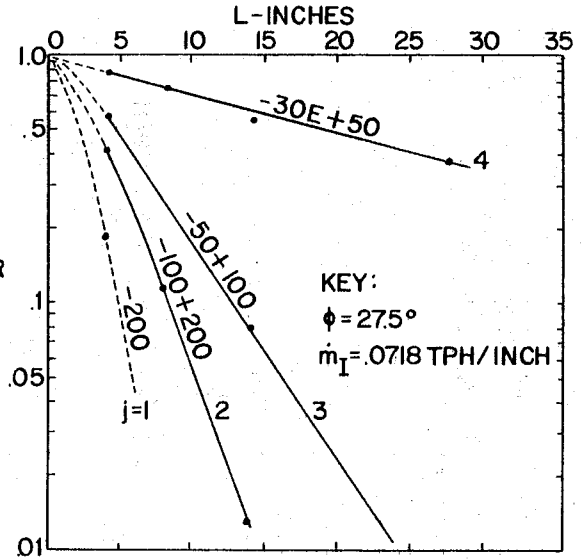
FIG. 28 is a plot of class transfer functions, $A_j$, obtained by laboratory tests using a 30-mesh differential rate screen in accordance with the invention.
Figure 29:
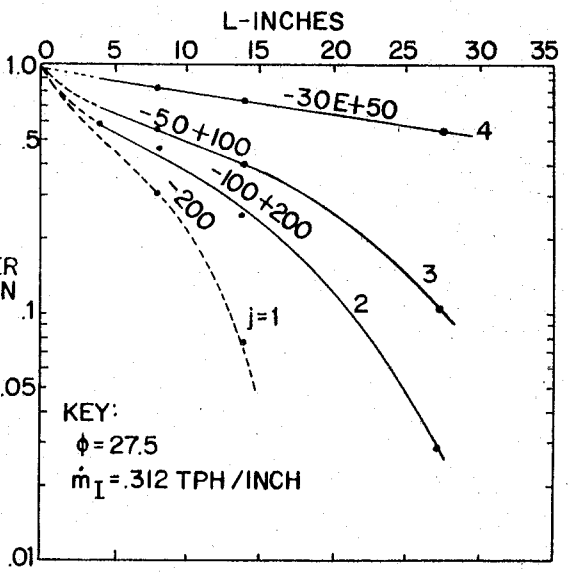
FIG. 29 is a class transfer function plot similar to FIG. 28 but at a different feed rate.

FIGS. 28 and 29 show how the class transfer functions which are components of the cumulative transfer functions of FIG. 27 decay as functions of open screen length. These decay data are for a commercial sand (SAKRETE All Purpose Sand) continuously screened on a square mesh screen of variable open length made from an experimental No. 30 stainless steel wire mesh screen (designated No. 30E). In these tests, the particulates were fed onto the screen with velocities principally in the plane of the screen.

Figure 30:
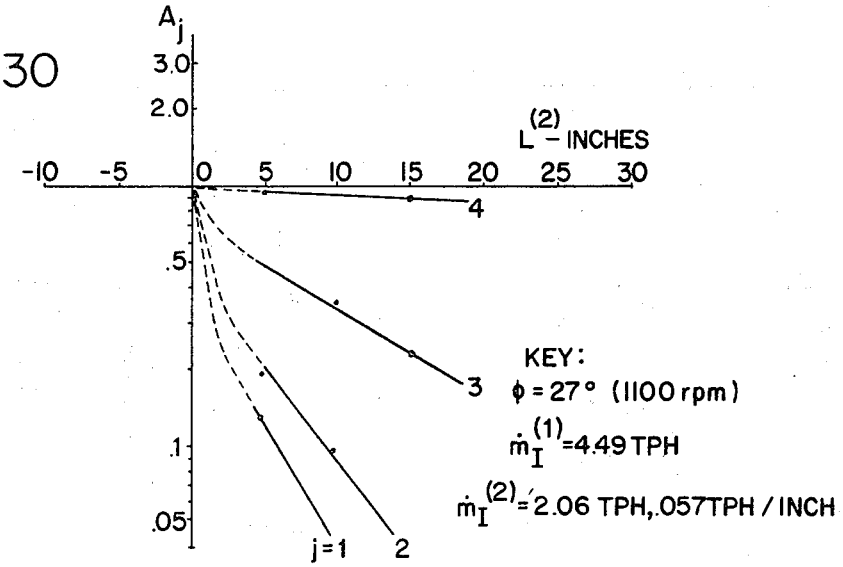
FIG. 30 is a plot of class transfer functions $A_j$, for a single 30-mesh screen used in the differential rate screening system of FIG. 4.
Figure 31:
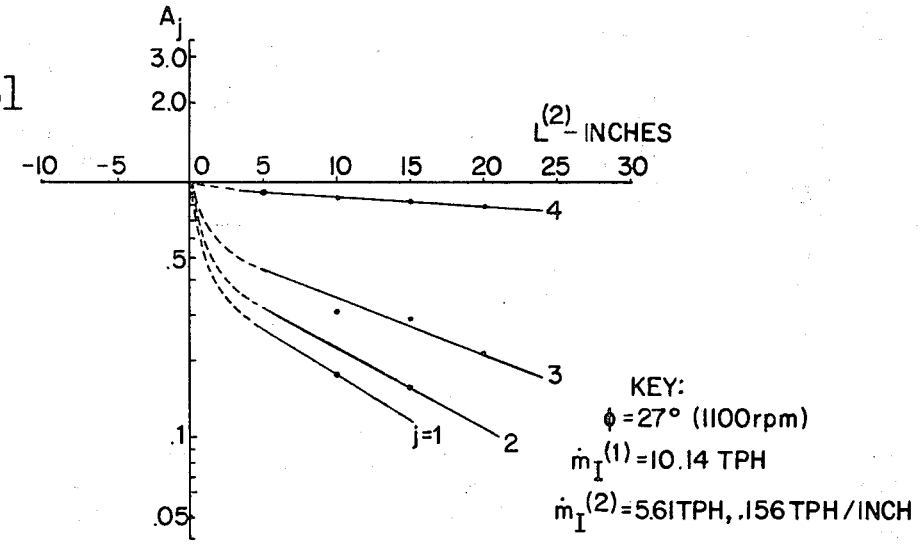
FIG. 31 is a class transfer function plot similar to FIG. 30 but at a different feed rate.
Figure 32:
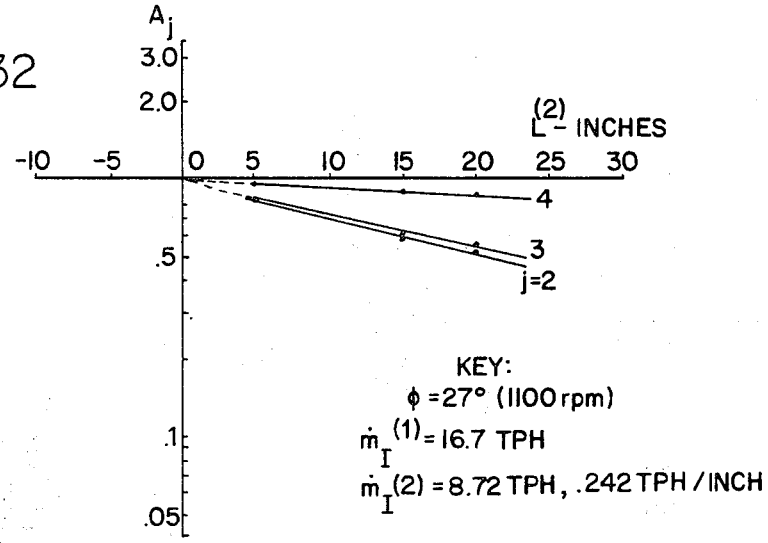
FIG. 32 is a class transfer function plot similar to FIGS. 30 and 31 but at a difrerent feed rate.

Examples of similar class transfer function decay curves as determined using a pilot scale differential rate screening system similar to FIG. 4 are shown in FIGS. 30, 31 and 32. The data points used to construct these plots cover a more restricted range of open screen lengths than in the three previous figures. The data on which FIGS. 30, 31 and 32 are based are similar to that given in Table 2 and were obtained using $-\frac{3}{8}$ inch crushed limestone screened on a square mesh screen of variable open length made from standard No. 30 stainless steel wire. In these latter tests, the particulates were fed onto the screen with velocities principally perpendicular to the plane of the screen.

The screening decay curves of FIG. 29, while for specific screen sizes and types of material, are believed to be representative of the general type of phenomenological behavior to be expected in rate screening according to the invention. The decay curves exhibit three distinct regions: an initial transient region at short open screen lengths, a central region where the decay is roughly exponential, and a final region of (usually) rapid decay.

It was noted during testing that the behavior of the class transfer functions appears to be influenced somewhat by the nature of the input size distribution of particles fed to the rate screening system. Small changes in the distribution seemed to have neglible effects on the transfer functions, and this is important for control considerations. However, large changes need to be compensated for. Two obvious problems here are, first, to decide when a distribution change is sufficiently large to require action, and second, to decide what action to take. These questions are generally circumvented by the setup and control techniques discussed elsewhere.

Figures 33A, 33B, 33C:
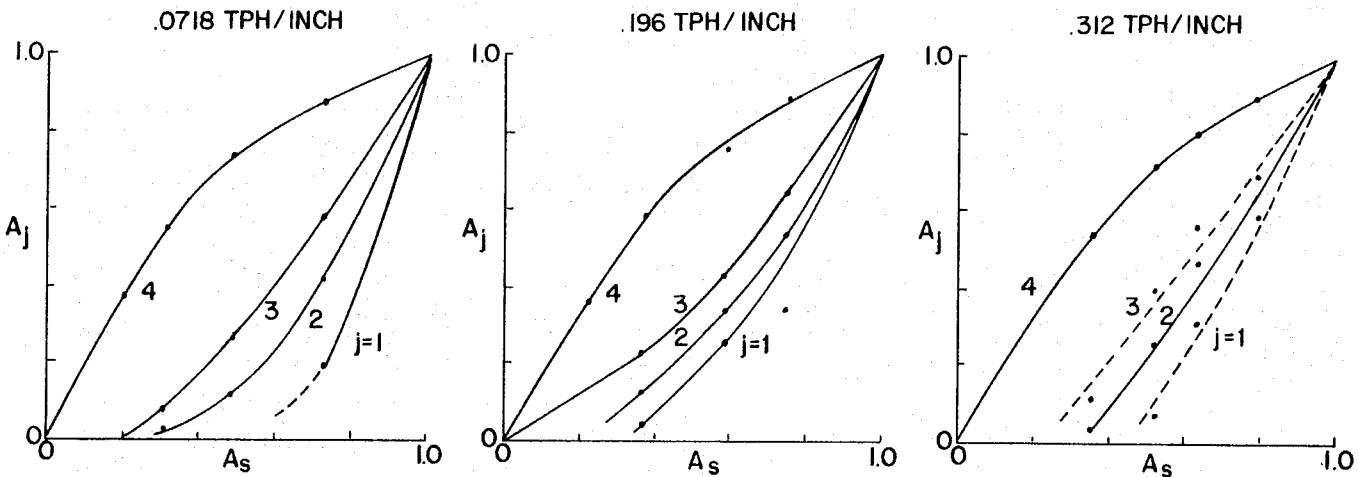
FIGS. 33*a*–33*c* and 34*a*–34*c* are diagramatic illustrations of relationships between class transfer functions, $A_j$, and cumulative transfer functions, $A_s$, at different feed rates.
Figures 34A, 34B, 34C:
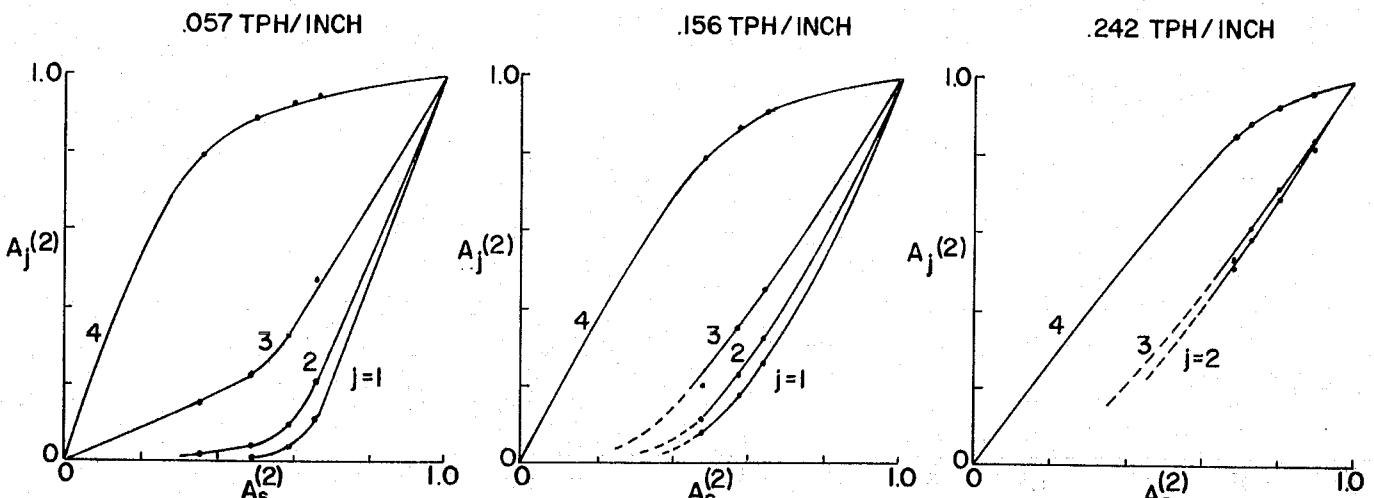

In FIGS. 33 and 34, the transfer functions $A_j$ for particles in size classes j, which correspond to the components of cumulative transfer function $A_s$, are plotted as functions of $A_s$. This figure illustrates the shape changes in the resulting curves in response to changes in mass flow rate to the screen.

EXAMPLES 6–29

A series of tests were run using the equipment setup of FIG. 4 to demonstrate that the differential rate screening process of the invention could readily yield screened products which satisfy the ASTM C-33 Specification for stonesand. The feed was crushed limestone obtained from a centrifugal crusher. The particle sizes in the feed were all $-\frac{3}{8}$ inch. The opening size of the upper screen was 4-mesh and that of the lower screen was 30-mesh. The results of these tests are set forth in Table 5.

Some explanation of the nomenclature used in Table 5 will be helpful in understanding this data. The groups of numbers and letters used in designating each test sample have the following meanings. The first two numbers starting at the left represent the inclination of the screen, namely 27°, relative to the horizontal. The next two numbers represent the open length of the top screen ($L^{(1)}$) in inches, namely 6 inches. The first two numbers following the dash (-) represent the nominal total mass flow rate of the feed in tons per hour. For example, -04, -10 and -15 represent nominal mass flow rates of 4, 10 and 15 tons per hour (tph), respectively. The actual measured or calculated total mass flow rate for each test sample is set forth under Column I, subcolumn $\dot{m}_I$. The final group of two numerals represents the open length of the bottom screen ($L^{(2)}$) in inches. The final letter designations are to be interpreted as follows. $B_1$ denotes samples of the feed taken at the start of each test series. $B_2$ denotes samples of the feed taken at the end of each test series. $B_3$ denotes samples of the feed taken upon restart of a test series which was interrupted to refill the feed bin. $B_4$ denotes samples of the feed taken at the end of an interrupted test series. S denotes a set of samples taken while differential rate screening was occurring on either one or two screens. $S_1$ and $S_2$ designate the set of samples taken with the top screen closed in the first and second portions of an interrupted test series.

With reference to Test Sample No. "2706-0400$B_1$", this test sample bypassed both screens of the differential rate screening system and consisted only of the feed at the beginning of the test series. This sample was taken at a nominal feed mass flow rate of 4 tph. From this sample, the mass-size distribution of the feed was determined. With reference to Test Sample No. "2706-0400S", this set of test samples was taken with a screen inclination of 27° and a top screen open length of 6 inches. The nominal mass-flow rate of feed for this test was 4 tph and the bottom screen was closed, i.e., the lower screen open length was 0 inches. From samples taken during this test run, the mass-size distributions of the overs and throughs of screen No. 1 (i.e., the top screen) were obtained.

TABLE 5

| TEST SAMPLE | TOP SCREEN LENGTH (#1) | LOWER SCREEN LENGTH (#2) | Column I MASS FLOW RATES - TPH | | | | | Column II MASS FLOW RATE RATIOS | | |
|---|---|---|---|---|---|---|---|---|---|---|
| | | | $\dot{m}_I$ | $\dot{m}_O^{(1)}$ | $\dot{m}_T^{(1)} = \dot{m}_I^{(2)}$ | $\dot{m}_O^{(2)}$ | $\dot{m}_T^{(2)}$ | $\dot{m}_I^{(2)}/\dot{m}_I^{(1)}$ | $\dot{m}_O^{(1)}/\dot{m}_I^{(1)}$ | $\dot{m}_O^{(2)}/\dot{m}_I^{(1)}$ |
| 2706-0400$B_1$ | — | 0" (Feed) | 4.110 | — | — | — | — | — | — | — |
| -0400S | 6" | 0" (Thru | 4.201 | 2.251 | 1.950 | 1.950 | 0 | .4642 | .5358 | .4642 |
| -0405S | 6" | 5" #1) | 4.372 | 2.342 | 2.030 | 1.750 | .280 | .4642 | .5358 | .4027 |
| -0410S | 6" | 10" | 4.480 | 2.400 | 2.080 | 1.750 | .330 | .4642 | .5358 | .3875 |
| -0415S | 6" | 15" | 4.620 | 2.475 | 2.145 | 1.698 | .447 | .4642 | .5358 | .3703 |
| -0420S | 6" | 20" | 4.748 | 2.544 | 2.204 | 1.541 | .663 | .4642 | .5358 | .3252 |
| -0400$B_2$ | — | 0" (Feed) | 4.901 | — | — | — | — | — | — | — |
| 2706-1000$B_1$ | — | 0" (Feed) | 9.703 | — | — | — | — | — | | |
| -1000S | 6" | 0" (Thru | 9.961 | 4.452 | 5.509 | 5.509 | 0 | .5531 | .4469 | .5531 |
| -1005S | 6" | 5" #1) | 9.940 | 4.442 | 5.498 | 4.733 | .765 | .5531 | .4469 | .4762 |
| -1010S | 6" | 10" | 10.086 | 4.507 | 5.579 | 4.572 | 1.007 | .5531 | .4469 | .4533 |
| 1015S | 6" | 15" | 10.258 | 4.584 | 5.674 | 4.650 | 1.029 | .5531 | .4469 | .4533 |
| -1020S | 6" | 20" | 10.430 | 4.661 | 5.769 | 4.720 | 1.049 | .5531 | .4469 | .4525 |
| -1000$B_2$ | — | 0" (Feed) | 10.650 | — | — | — | — | — | — | — |
| 2706-1500$B_1$ | — | 0" (Feed) | 14.809 | — | — | — | — | — | — | — |
| -1500$S_1$ | 6" | 0" (Thru | 15.371 | 6.981 | 8.390 | 8.390 | 0 | .5458 | .4542 | .5458 |
| -1505S | 6" | 5" #1) | 16.083 | 7.305 | 8.778 | 8.416 | .362 | .5458 | .4542 | .5233 |
| -1510S | 6" | 10" | 16.908 | 7.680 | 9.228 | 7.893 | 1.330 | .5458 | .4542 | .4671 |

TABLE 5-continued

| | | | | | | | | | | |
|---|---|---|---|---|---|---|---|---|---|---|
| -1500B$_2$ | — | 0" (Feed) | 17.820 | — | — | — | — | — | — | — |
| 2706-1500B$_3$ | — | 0" (Feed) | 15.965 | — | — | — | — | — | — | — |
| -1500S$_2$ | 6" | 0" (Thru | 16.652 | 8.340 | 8.312 | 8.312 | 0 | .4992 | .5008 | .4992 |
| -1515S | 6" | 15" #1) | 17.289 | 8.658 | 8.631 | 7.654 | .977 | .4992 | .5008 | .4427 |
| -1520S | 6" | 20" | 18.014 | 9.021 | 8.993 | 7.851 | 1.142 | .4992 | .5008 | .4358 |
| -1500B$_4$ | — | 0" (Feed) | — | — | — | — | — | — | — | — |

Column III, MASS-SIZE DISTRIBUTIONS* (FEED) [CALCULATED]**$C^{(1)}_{ij}$

| TEST SAMPLE | Mesh (+4) | Mesh (−4 +8) | Mesh (−8 +16) | Mesh (−16 +30) | Mesh (−30 +50) | Mesh (−50 +100) | Mesh (−100 +200) | Mesh (−200) |
|---|---|---|---|---|---|---|---|---|
| 2706-0400B$_1$ | 16.50 | 23.40 | 20.60 | 15.50 | 10.60 | 6.50 | 3.70 | 3.20 |
| -0400S | 18.27 | 23.11 | 19.46 | 15.52 | 10.98 | 6.32 | 3.45 | 2.90 |
| -0405S | 17.73 | 23.50 | 21.08 | 16.85 | 11.05 | 5.22 | 2.65 | 1.93 |
| -0410S | 18.54 | 24.62 | 20.99 | 16.51 | 10.55 | 4.75 | 2.35 | 1.69 |
| -0415S | 18.26 | 25.31 | 20.28 | 15.37 | 10.03 | 5.44 | 3.05 | 2.25 |
| -0420S | 22.72 | 22.80 | 18.10 | 13.50 | 9.16 | 7.25 | 3.81 | 2.64 |
| -0400B$_2$ | 22.50 | 27.10 | 19.20 | 13.20 | 8.40 | 4.50 | 2.60 | 2.50 |
| 2706-1000B$_1$ | 19.70 | 24.80 | 19.40 | 12.90 | 11.50 | 5.40 | 3.40 | 2.90 |
| -1000S | 20.38 | 23.18 | 17.68 | 15.20 | 10.85 | 6.05 | 3.68 | 2.98 |
| -1005S | 15.73 | 24.11 | 21.11 | 16.33 | 10.82 | 5.71 | 4.04 | 2.10 |
| -1010S | 15.73 | 24.46 | 21.80 | 16.12 | 10.19 | 5.37 | 3.50 | 2.83 |
| -1015S | 14.52 | 24.77 | 21.31 | 17.38 | 10.60 | 5.23 | 3.44 | 2.75 |
| -1020S | 15.10 | 24.49 | 21.83 | 17.63 | 10.60 | 5.03 | 3.58 | 1.79 |
| -1000B$_2$ | | | | | | | | |
| 2706-1500B$_1$ | 26.20 | 25.20 | 16.70 | 12.30 | 8.20 | 5.00 | 2.90 | 3.50 |
| -1500S$_1$ | 21.75 | 20.13 | 18.21 | 15.50 | 10.55 | 6.24 | 3.75 | 3.87 |
| -1505S | 19.03 | 22.78 | 20.20 | 15.92 | 9.94 | 5.40 | 3.18 | 3.55 |
| -1510S | 21.26 | 21.35 | 17.73 | 14.68 | 10.55 | 6.53 | 4.06 | 3.84 |
| -1500B$_2$ | 21.50 | 24.80 | 20.10 | 15.40 | 9.30 | 3.50 | 2.80 | 2.60 |
| 2706-1500B$_3$ | 25.50 | 33.60 | 18.20 | 9.80 | 5.30 | 3.00 | 1.80 | 2.80 |
| -1500S$_2$ | 17.43 | 24.78 | 19.99 | 15.08 | 9.59 | 5.69 | 3.50 | 3.94 |
| -1515S | 21.08 | 24.87 | 18.33 | 13.58 | 8.88 | 5.56 | 3.64 | 4.06 |
| -1520S | 19.53 | 25.24 | 18.60 | 14.43 | 9.65 | 5.57 | 3.55 | 3.43 |
| -1500B$_4$ | 19.00 | 25.80 | 20.50 | 15.60 | 9.30 | 4.10 | 2.40 | 3.30 |

*as percentage of total mass

**Mass-size distributions of test samples ending with the letter "B" are actual measurements. Remaining mass-size distributions are back calculated from output data.

Column IV, MASS SIZE DISTRIBUTIONS* (OVERS) $C^{(1)}_{oj}$

| TEST SAMPLE | Mesh (+4) | Mesh (−4 +8) | Mesh (−8 +16) | Mesh (−16 +30) | Mesh (−30 +50) | Mesh (−50 +100) | Mesh (−100 +200) | Mesh (−200) |
|---|---|---|---|---|---|---|---|---|
| 2706-0400B$_1$ | — | — | — | — | — | — | — | — |
| -0400S | 34.10 | 40.70 | 17.60 | 4.70 | 1.70 | .70 | .20 | .30 |
| -0405S | 33.10 | 40.20 | 17.30 | 5.30 | 1.90 | 1.00 | .70 | .50 |
| -0410S | 34.60 | 42.10 | 16.80 | 4.20 | 1.40 | .40 | .20 | .30 |
| -0415S | 34.10 | 43.20 | 15.70 | 4.00 | 1.60 | .50 | .40 | .50 |
| -0420S | 42.40 | 37.90 | 13.80 | 3.70 | 1.10 | .50 | .30 | .30 |
| -0400B$_2$ | — | — | — | — | — | — | — | — |
| 2706-1000B$_1$ | — | — | — | — | — | — | — | — |
| -1000S | 45.60 | 43.80 | 8.50 | 1.10 | .40 | .30 | .20 | .10 |
| -1005S | 35.20 | 45.40 | 14.00 | 3.30 | 1.10 | .40 | .30 | .30 |
| -1010S | 35.20 | 45.80 | 13.80 | 3.10 | .90 | .40 | .30 | .50 |
| -1015S | 32.50 | 47.00 | 14.00 | 3.70 | 1.10 | .60 | .50 | .60 |
| -1020S | 33.80 | 45.80 | 13.40 | 3.70 | 1.40 | .70 | .50 | .70 |
| -1000B$_2$ | | | | | | | | |
| 2706-1500B$_1$ | — | — | — | — | — | — | — | — |
| -1500S$_1$ | 47.90 | 37.10 | 9.80 | 3.00 | 1.00 | .40 | .20 | .60 |
| -1505S | 41.90 | 40.00 | 11.30 | 3.60 | 1.40 | .70 | .30 | .80 |
| -1510S | 46.80 | 38.80 | 8.70 | 2.60 | 1.30 | .40 | .40 | 1.00 |
| -1500B$_2$ | — | — | — | — | — | — | — | — |
| 2706-1500B$_3$ | — | — | — | — | — | — | — | — |
| -1500S$_2$ | 34.80 | 44.30 | 13.90 | 3.80 | 1.30 | .60 | .30 | 1.00 |
| -1515S | 42.10 | 41.80 | 10.00 | 2.90 | 1.00 | .50 | .60 | 1.10 |
| -1520S | 39.00 | 43.60 | 11.30 | 2.80 | 1.20 | .60 | .50 | 1.00 |
| -1500B$_4$ | — | — | — | — | — | — | — | — |

*as percentage of total mass

Col. V, MASS SIZE DISTRIBUTIONS* (INPUT #2) [CALCULATED] $C^{(2)}_{ij}$

| TEST SAMPLE | Mesh (−4 +8) | Mesh (−8 +16) | Mesh (−16 +30) | Mesh (−30 +50) | Mesh (−50 +100) | Mesh (−100 +200) | Mesh (−200) |
|---|---|---|---|---|---|---|---|
| 2706-0400B$_1$ | — | — | — | — | — | — | — |
| -0400S | 2.80 | 21.60 | 28.00 | 21.70 | 12.80 | 7.20 | 5.90 |
| -0405S | 4.22 | 25.43 | 30.17 | 21.60 | 10.09 | 4.89 | 3.59 |
| -0410S | 4.46 | 25.82 | 30.71 | 21.11 | 9.77 | 4.83 | 3.29 |
| -0415S | 4.67 | 25.57 | 28.50 | 19.75 | 11.14 | 6.11 | 4.26 |
| -0420S | 5.38 | 23.07 | 25.12 | 18.46 | 15.04 | 7.87 | 5.34 |
| -0400B$_2$ | — | | | | | | |
| 2706-1000B$_1$ | — | — | — | — | — | — | — |
| -1000S | 6.50 | 25.10 | 26.60 | 19.30 | 10.70 | 6.50 | 5.30 |
| -1005S | 6.89 | 26.86 | 26.94 | 18.68 | 10.00 | 7.07 | 3.56 |
| -1010S | 7.21 | 28.28 | 26.63 | 17.69 | 9.38 | 6.09 | 4.72 |
| -1015S | 6.80 | 27.21 | 28.44 | 18.28 | 8.97 | 5.81 | 4.49 |
| -1020S | 7.28 | 28.69 | 28.88 | 18.03 | 8.53 | 6.07 | 2.57 |

TABLE 5-continued

| | | | | | | | |
|---|---|---|---|---|---|---|---|
| -1000B$_2$ | — | — | — | — | — | — | — |
| 2706-1500B$_1$ | — | — | — | — | — | — | — |
| -1500S$_1$ | 6.00 | 25.20 | 25.90 | 18.50 | 11.10 | 6.70 | 6.60 |
| -1505S | 8.44 | 27.62 | 26.18 | 17.05 | 9.30 | 5.58 | 5.83 |
| -1510S | 6.85 | 25.25 | 24.73 | 18.24 | 11.62 | 7.10 | 6.21 |
| -1500B$_2$ | — | — | — | — | — | — | — |
| 2706-1500B$_3$ | — | — | — | — | — | — | — |
| -1500S$_2$ | 5.20 | 26.10 | 26.40 | 17.90 | 10.80 | 6.70 | 6.90 |
| -1515S | 7.89 | 26.69 | 24.30 | 16.78 | 10.63 | 6.69 | 7.02 |
| -1520S | 6.81 | 25.94 | 26.10 | 18.13 | 10.55 | 6.60 | 5.87 |
| -1500B$_4$ | — | — | — | — | — | — | — |

*as percentage of total mass

| | Column VI, MASS SIZE DISTRIBUTIONS* (PRODUCT) $C^{(2)}_{oj}$ | | | | | | |
|---|---|---|---|---|---|---|---|
| TEST SAMPLE | Mesh (−4 +8) | Mesh (−8 +16) | Mesh (−16 +30) | Mesh (−30 +50) | Mesh (−50 +100) | Mesh (−100 +200) | Mesh (−200) |
| 2706-0400B$_1$ | — | — | — | — | — | — | — |
| -0400S | 2.80 | 21.60 | 28.00 | 21.70 | 12.80 | 7.20 | 5.90 |
| -0405S | 4.90 | 29.50 | 35.00 | 23.60 | 5.50 | 1.00 | .50 |
| -0410S | 5.30 | 30.70 | 36.50 | 23.00 | 3.90 | .50 | .10 |
| -0415S | 5.90 | 32.30 | 36.00 | 22.00 | 3.10 | .40 | .30 |
| -0420S | 7.70 | 33.00 | 35.50 | 20.90 | 2.50 | .20 | .20 |
| -0400B$_2$ | | | | | | | |
| 2706-1000B$_1$ | — | — | — | — | — | — | — |
| -1000S | 6.50 | 25.10 | 26.60 | 19.30 | 10.70 | 6.50 | 5.30 |
| -1005S | 8.00 | 31.20 | 31.30 | 19.60 | 5.20 | 2.60 | 2.10 |
| -1010S | 8.80 | 34.50 | 32.50 | 18.50 | 3.50 | 1.20 | 1.00 |
| -1015S | 8.30 | 33.20 | 34.70 | 18.50 | 3.10 | 1.10 | 1.10 |
| -1020S | 8.90 | 35.00 | 35.30 | 17.30 | 2.20 | .60 | .70 |
| -1000B$_2$ | — | — | — | — | — | — | — |
| 2706-1500B$_1$ | — | — | — | — | — | — | — |
| -1500S$_1$ | 6.00 | 25.20 | 25.90 | 18.50 | 11.10 | 6.70 | 6.60 |
| -1505S | 8.80 | 28.80 | 27.30 | 17.10 | 8.10 | 4.80 | 5.10 |
| -1510S | 8.00 | 29.50 | 28.90 | 18.30 | 7.20 | 4.10 | 4.00 |
| -1500B$_2$ | — | — | — | — | — | — | — |
| 2706-1500B$_3$ | — | — | — | — | — | — | |
| -1500S$_2$ | 5.20 | 26.10 | 26.40 | 17.90 | 10.80 | 6.70 | 6.90 |
| -1515S | 8.90 | 30.10 | 27.40 | 16.70 | 7.20 | 4.40 | 5.30 |
| -1520S | 7.80 | 29.70 | 29.90 | 17.80 | 6.60 | 3.90 | 4.30 |
| -1500B$_4$ | — | — | — | — | — | — | — |

*as percentage of total mass

| | Col. VII, MASS SIZE DISTRIBUTIONS* (FINES) $C^{(2)}_{Ti}$ | | | | Col. VIII. TOTAL CUMULATIVE TRANSFER FUNCTIONS | |
|---|---|---|---|---|---|---|
| TEST SAMPLE | Mesh (−30 +50) | Mesh (−50 +100) | Mesh (−100 +200) | Mesh (−200) | $(1 - A^{(1)})$ | $A^{(2)}$ |
| 2706-0400B$_1$ | — | — | — | — | | |
| -0400S | — | — | — | — | .568 | 1.000 |
| -0405S | 9.10 | 38.80 | 29.20 | 22.90 | .564 | .657 |
| -0410S | 11.10 | 40.90 | 27.80 | 20.20 | .570 | .593 |
| -0415S | 11.20 | 41.70 | 27.80 | 19.30 | .568 | .495 |
| -0420S | 12.80 | 44.20 | 25.70 | 17.30 | .601 | .356 |
| -0400B$_2$ | | | | | | |
| 2706-1000B$_1$ | — | — | — | — | — | |
| -1000S | — | — | — | — | .695 | 1.000 |
| -1005S | 13.00 | 39.70 | 34.70 | 12.60 | .656 | .646 |
| -1010S | 14.00 | 36.10 | 28.30 | 21.60 | .656 | .575E# |
| -1015S | 17.30 | 35.60 | 27.20 | 19.90 | .647 | .519 |
| -1020S | 21.30 | 37.00 | 30.70 | 11.00 | .652 | .483 |
| -1000B$_2$ | — | — | — | — | | |
| 2706-1500B$_1$ | — | — | — | — | | |
| -1500S$_1$ | — | — | — | — | .700 | 1.000 |
| -1505S | 16.00 | 37.30 | 23.80 | 22.90 | .674 | .891 |
| -1510S | 17.90 | 37.90 | 24.90 | 19.30 | .693 | .800E |
| -1500B$_2$ | — | — | — | — | | |
| 2706-1500B$_3$ | — | — | — | — | | |
| -1500S$_2$ | — | — | — | — | .605 | 1.000 |
| -1515S | 17.40 | 37.50 | 24.60 | 20.50 | .632 | .725 |
| -1520S | 20.40 | 37.70 | 25.20 | 16.70 | .620 | .691 |
| -1500B$_4$ | — | — | — | — | | |

Values followed by the letter "E" have been estimated from other data.
*as percentage of total mass

| | Col. IX, TRANSFER FUNCTION $(1-A^{(1)}_j)=[1-C^{(1)}_{oj}/C^{(1)}_{ij}N)]$ FOR $L_1=6''$ | | | | | | | |
|---|---|---|---|---|---|---|---|---|
| TEST SAMPLE | Mesh (+4) | Mesh (−4 +8) | Mesh (−8 +16) | Mesh (−16 +30) | Mesh (−30 +50) | Mesh (−50 +100) | Mesh (−100 +200) | Mesh (−200) |
| 2706-0400B$_1$ | — | — | — | — | — | — | — | — |
| -0400S | 0 | .0547 | .544 | .835 | .915 | .939 | | |
| -0405S | 0 | .0700 | .558 | .840 | .922 | .946 | | |
| -0410S | 0 | .0829 | .568 | .845 | .927 | .952 | | |
| -0415S | 0 | .0970 | .580 | .849 | .931 | .957 | | |
| -0420S | 0 | .1088 | .592 | .852 | .935 | .961 | | |

TABLE 5-continued

| | | | | | | |
|---|---|---|---|---|---|---|
| -0400B$_2$ | | | | | | |
| 2706-1000B$_1$ | — | — | — | — | — | — |
| -1000S | 0 | .137 | .780 | .967 | .983 | .977 |
| -1005S | 0 | .159 | .704 | .910 | .955 | .969 |
| -1010S | 0 | .164 | .717 | .914 | .960 | .967 |
| -1015S | 0 | .152 | .706 | .905 | .954 | .949 |
| -1020S | 0 | .164 | .726 | .906 | .941 | .938 |
| -1000B$_2$ | — | — | — | — | — | — |
| 2706-1500B$_1$ | — | — | — | — | — | — |
| -1500S$_1$ | 0 | .163 | .756 | .912 | .957 | .971 |
| -1505S | 0 | .202 | .748 | .897 | .936 | .941 |
| -1510S | 0 | .175 | .777 | .920 | .944 | .972 |
| -1500B$_2$ | — | — | — | — | — | — |
| 2706-1500B$_3$ | — | — | — | — | — | — |
| -1500S$_2$ | 0 | .105 | .652 | .874 | .932 | .947 |
| -1515S | 0 | .158 | .727 | .893 | .944 | .955 |
| -1520S | 0 | .135 | .696 | .903 | .938 | .946 |
| -1500B$_4$ | — | — | — | — | — | — |

| | Col. X, TRANSFER FUNCTION $A^{(2)}_j = C^{(2)}_{0j}/C^{(2)}_{Ij}N'$) | | | | | | |
|---|---|---|---|---|---|---|---|
| TEST SAMPLE | Mesh (−4 +8) | Mesh (−8 +16) | Mesh (−16 +30) | Mesh (−30 +50) | Mesh (−50 +100) | Mesh (−100 +200) | Mesh (−200) |
| 2706-0400B$_1$ | — | — | — | — | — | — | — |
| -0400S | 1.0 | 1.0 | 1.0 | 1.0 | 1.0 | 1.0 | 1.0 |
| -0405S | 1.0 | 1.0 | 1.0 | .942 | .470 | .176 | .120 |
| -0410S | 1.0 | 1.0 | 1.0 | .918 | .336 | .087 | .026 |
| -0415S | 1.0 | 1.0 | 1.0 | .882 | .220 | .052 | .056 |
| -0420S | 1.0 | 1.0 | 1.0 | .792 | .116 | .013 | .026 |
| -0400B$_2$ | | | | | | | |
| 2706-1000B$_1$ | — | — | — | — | — | — | — |
| -1000S | 1.0 | 1.0 | 1.0 | 1.0 | 1.0 | 1.0 | 1.0 |
| -1005S | 1.0 | 1.0 | 1.0 | .904 | .448 | .317 | .508 |
| -1010S | 1.0 | 1.0 | 1.0 | .857 | .306 | .162 | .174 |
| -1015S | 1.0 | 1.0 | 1.0 | .830 | .283 | .155 | .245 |
| -1020S | 1.0 | 1.0 | 1.0 | .785 | .211 | .081 | .223 |
| -1000B$_2$ | | | | | | | |
| 2706-1500B$_1$ | — | — | — | — | — | — | — |
| -1500S$_1$ | 1.0 | 1.0 | 1.0 | 1.0 | 1.0 | 1.0 | 1.0 |
| -1505S | 1.0 | 1.0 | 1.0 | .962 | .835 | .825 | .839 |
| -1510S | 1.0 | 1.0 | 1.0 | .859 | .528 | .494 | .552 |
| -1500B$_2$ | — | — | — | | | | |
| 2706-1500B$_3$ | — | — | — | — | — | — | — |
| -1500S$_2$ | 1.0 | 1.0 | 1.0 | 1.0 | 1.0 | 1.0 | 1.0 |
| -1515S | 1.0 | 1.0 | 1.0 | .882 | .600 | .583 | .669 |
| -1520S | 1.0 | 1.0 | 1.0 | .858 | .546 | .516 | .640 |
| -1500B$_4$ | | | | | | | |

Figure 35:
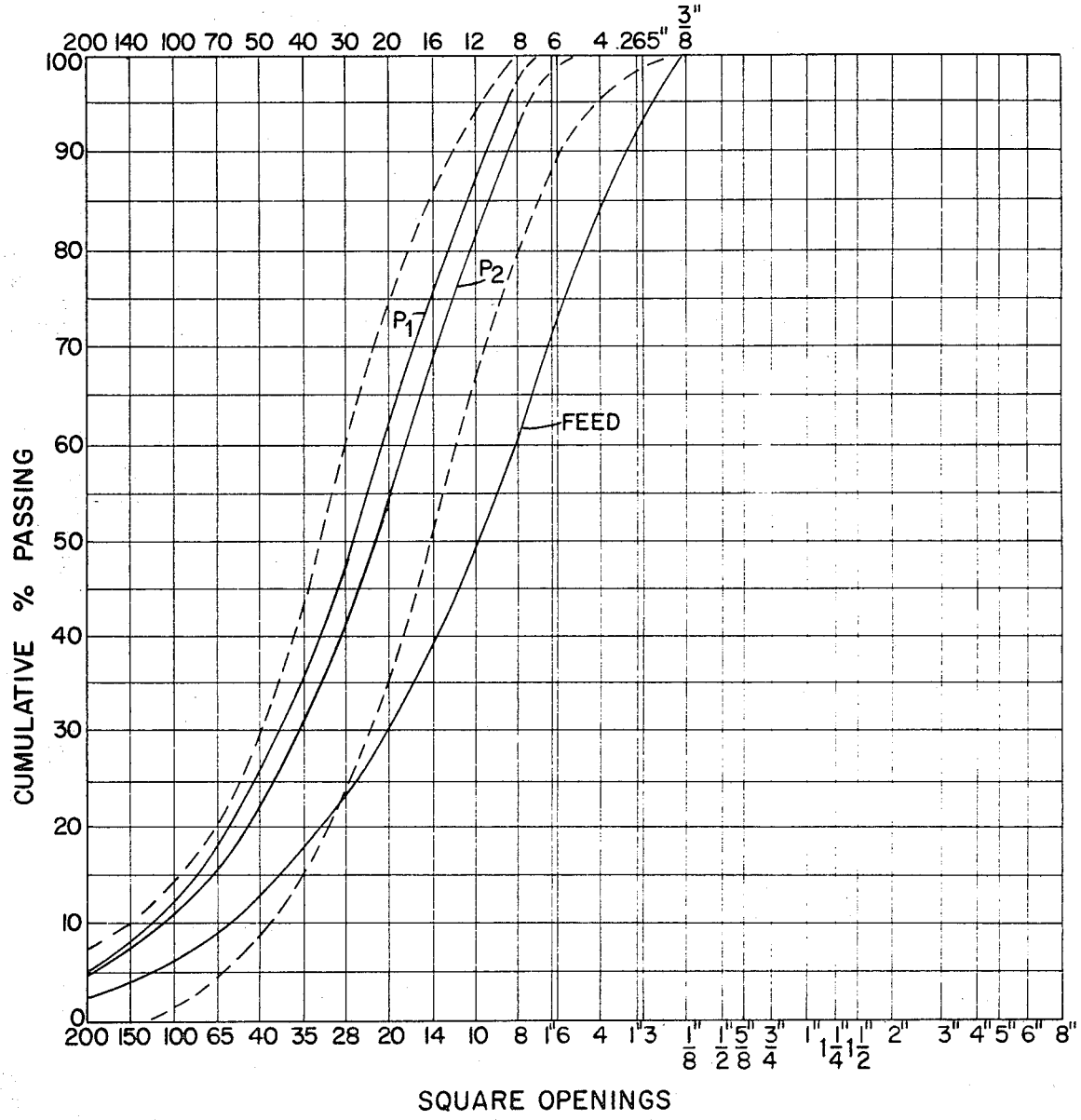
FIGS. 35, 36, 37 and 38 are plots of cumulative size distributions based on actual test data obtained during experimental operation of the differential rate screening system illustrated diagramatically in FIG. 4.

FIG. 35 illustrates that with the particular feed tested, ASTM C-33 can be met by a single screen employing the rate screening process of the invention. In this figure, the dotted lines represent the upper and lower limits of the ASTM C-33 specification. The curve marked "FEED" is a plot of the cumulative size distribution of test sample 2706-0400B$_1$ as given in Table 5. The curve marked "P$_1$" is a plot of the cumulative size distribution of the product from screening test sample 2706-0400S and is obtained from the data presented in the corresponding line of column VI in Table 5. The solid curve marked "P$_2$" is a plot of the cumulative size distribution of the product produced by screening test sample 2706-1500S and is obtained from the data presented in the corresponding line of column VI in Table 5.

Figure 36:
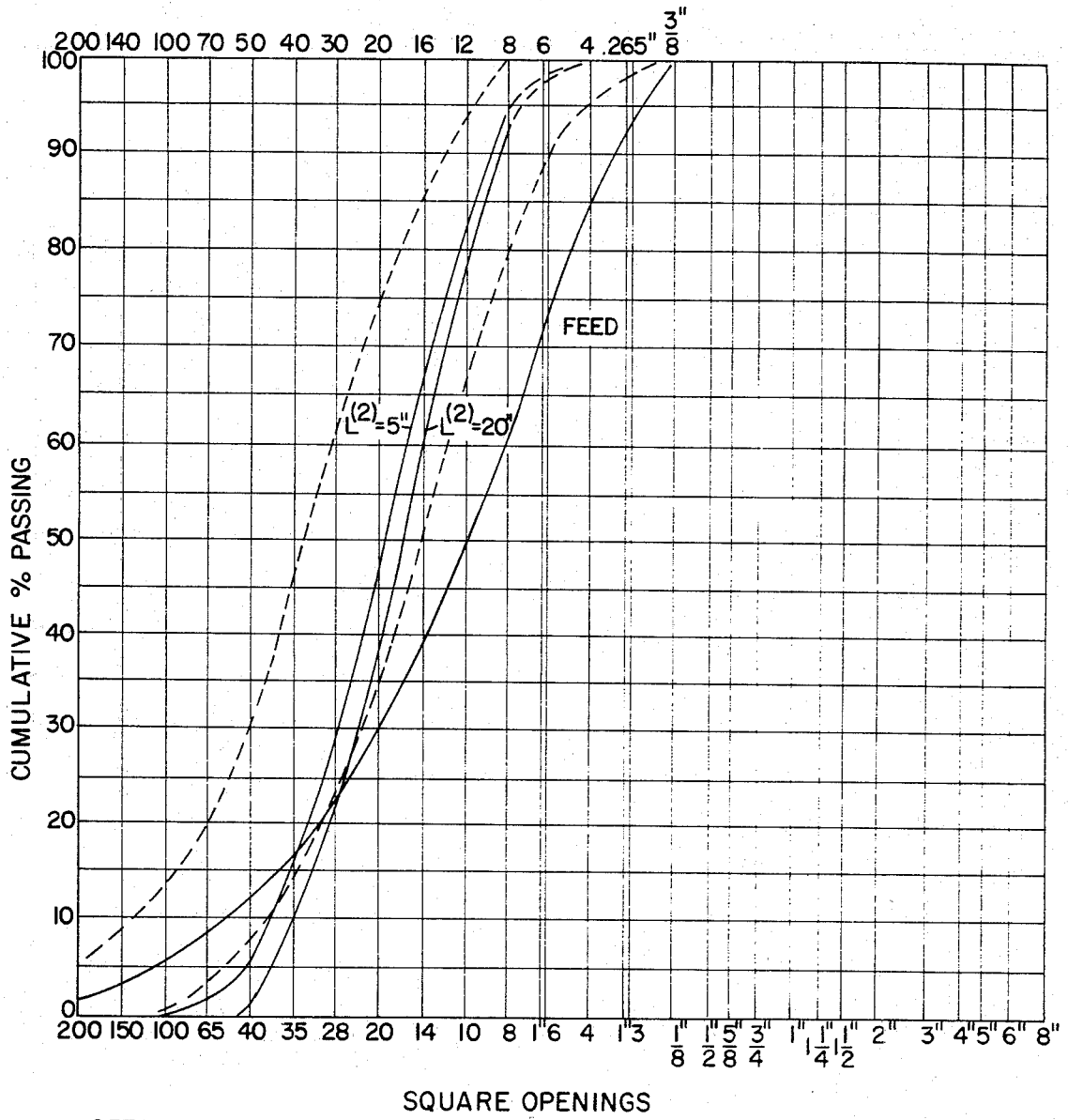
Figure 37:
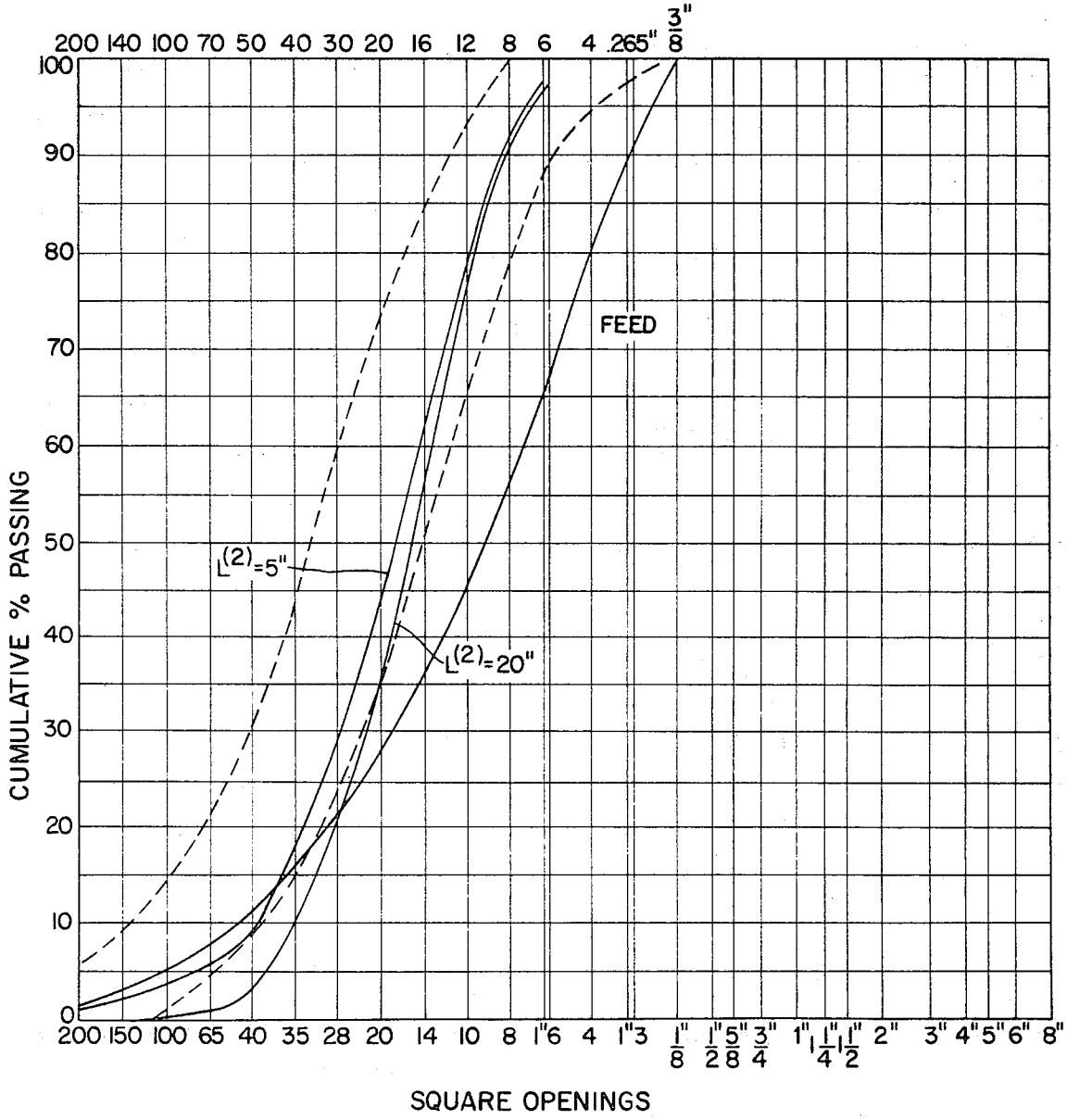
Figure 38:
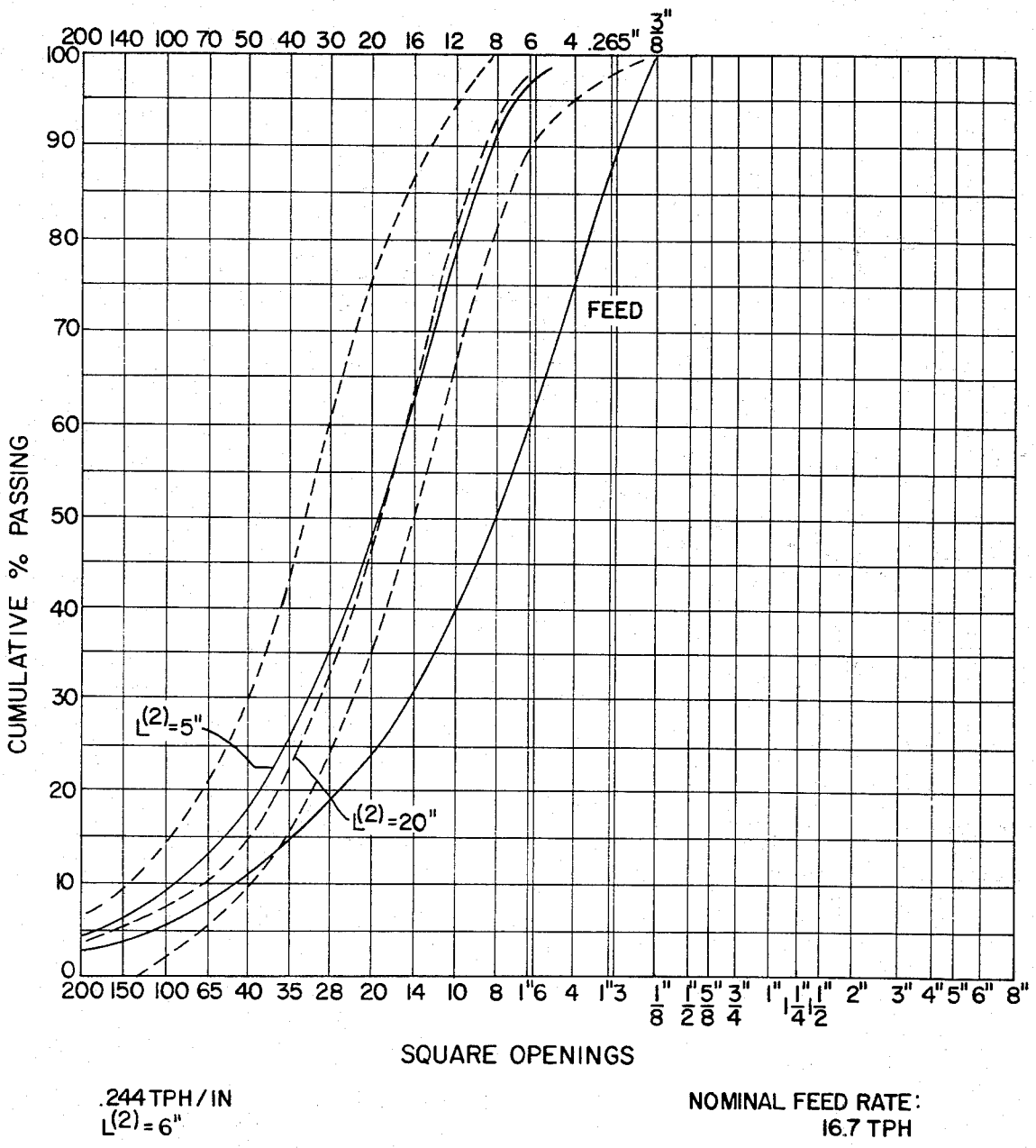

FIGS. 36, 37 and 38 each illustrate the change in product size distribution where the first screen is set at six inches and the second screen is changed from five inches to twenty inches of open length. The data for these figures is given in Table 5 and was obtained at nominal feed rates of 4.5, 10.1 and 16.7 tons per hour (tph), respectively. In the upper right corner of each figure, there is also given the mass flow rate of the feed to the lower screen in tons per hour per inch of lower screen width, the same being 0.0578, 0.156 and 0.244 tph/in. for FIGS. 36, 37 and 38, respectively. The test samples screened to obtain the data plotted on these figures are identified on each figure. The corresponding cumulative size distributions of the product streams were calculated by summing appropriate data lines in Column VI of Table 5. The cumulative size distribution of the feed stream in each of these figures was obtained from the appropriate data lines in Column III of Table 2. The specific mass flows for each sample tested appear in Column I of Table 5.

A comparison between the sets of curves in each of these figures further illustrates that for the particular feed tested, the C-33 specification can be met by increasing the feed rate to about 16 to 18 tph while maintaining the open lengths of both the upper and lower screens at the values indicated.

The examples presented and the screening data incorporated in Table 5 have demonstrated the feasibility and technical merits of this novel differential rate screening process and apparatus. In addition, the data not only provide qualitative and quantitative assurance that the setup and control schemes described in this specification perform satisfactorily, but also support the claims of this patent with reference to certain preferred embodiments.

INDUSTRIAL APPLICABILITY

The invention has a wide range of commercial uses as illustrated by the specific embodiments and examples set forth above. These embodiments and examples are merely exemplary and the true scope of the invention is not to be limited to those embodiments and examples but is as defined by the claims at the end of this specification. Additional embodiments and modifications which may prove to have significant commercial utility are set forth below.

The theory of differential rate screening teaches that of all the particles capable of passing through a screen, the finer particles pass more readily and the coarser or "near-mesh" particles pass with greater difficulty. Consequently, a size-distribution gradient exists along the screen from the point at which the feed is first introduced onto the screen to the point at which the overs exit off of the open apertured screen length. If one samples the material passing through the screen early in its traverse along the screen, that material will be found to be rich in fine or "far-mesh" material. For example if the screen were 30-mesh, an early sample would be rich in −200 and −100+200 particles but relatively lean in −30+50 (near-mesh) particles. On the other hand, if the material passing through the screen is sampled at a position near its downstream end, that material would be found to be rich in the relatively coarse, near-mesh particles and relatively deficient in very fine particles. For the 30-mesh sieve, for example, the late sample might be expected to consist mostly of −30+50 (near-mesh) particles. This postulated behavior is in accordance with the transfer functions for differential rate screening as previously given in this specification.

A typical embodiment of this differential rate screening concept is that of screen 64' in FIG. 4, in which the lower end of the screen is masked by a plate 132' and the effective length of the screen is restricted so that something less than essentially complete screening occurs. Screen 64' avails itself of the size-distribution gradient cumulatively up to the point of screen obstruction by plate 132', which constitutes a "cut-off" so far as coarse, near-mesh particles are concerned. The particles deprived of access to the screen comprise the overs 252' discharged through chute 131', while the throughs 250' fall onto the interscreen conveyor 72'.

An alternative approach to limiting the effective open length of the screen is represented by interscreen pan 150 in FIG. 1. Instead of a plate to restrict access of the particles to the screen, all particles are allowed to pass through screen 66, but a portion of the throughs is retrieved by interscreen pan 150 and the retrieved or "retained" part is recombined with the overs coming off of the end of screen 66. These combined "overs" would be equivalent in size distribution to overs emerging from collection chute 162 if a masking plate was used over the same portion of screen 66 as is intercepted by pan 150.

The principles described above do not exploit all of the flexibility available for preferentially selecting regions along the length of the screen to be used as the effective portion of that screen. For example, a catch tray 400 is employed in FIG. 39 in a manner similar to pan 150 in FIG. 1, but the throughs recovered by catch tray 400 are treated as a separate stream 405 and are not combined with the overs stream 407. There can then be employed as at least part of the product stream either throughs stream 409 or throughs stream 405. If throughs stream 409 is elected, the result is substantially the same as in the previous embodiments, that is, the effective length of the screen is simply shortened. If throughs stream 405 is selected, however, it is possible to take advantage of the coarser end of the size-distribution gradient and to eliminate from the product an appreciable portion of the very fine material without having to screen the material on a second, finer mesh screen.

Figure 39:
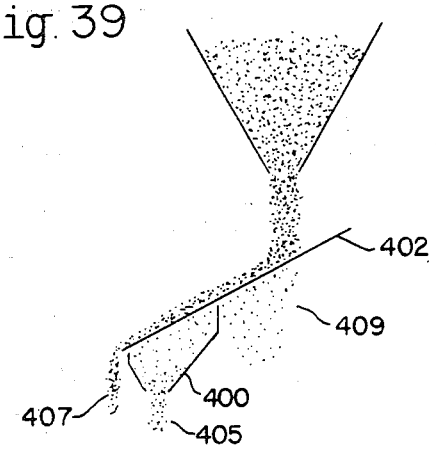
FIGS. 39, 40 and 41 are diagrammatic illustrations of further embodiments of the differential rate screening process and apparatus of the invention.
Figure 40:
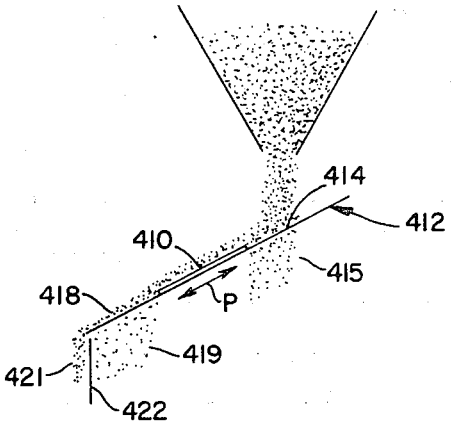
Figure 40:
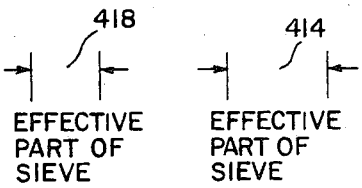

A similar effect to that achieved by catch tray 400 of FIG. 39 can be realized by the use of a masking plate 410 as shown in FIG. 40. Masking plate 410 is movable in either direction relative to screen 412 as illustrated by the arrow P. By masking a central portion of the screen 412, there is formed an inlet effective part 414 of screen 412 which yields a throughs stream 415, and an outlet effective part 418 of the screen yielding a second throughs stream 419. Through stream 419 may be separated from overs stream 421 by baffle 422 so as to be utilized as a separate throughs stream similar to throughs stream 405 of FIG. 39.

Figure 41:
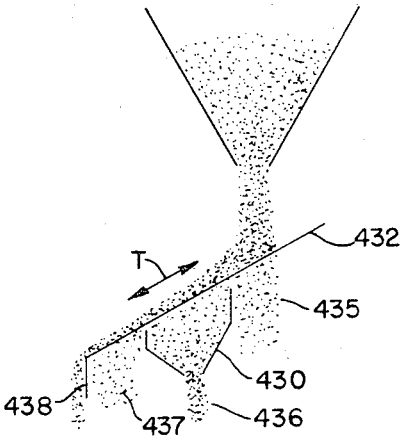

Many possibilities exist in selecting those portions of a screen along its length to be used in generating all or a portion of a product stream. A further example of this is illustrated by FIG. 41 in which a catch tray 430 is positioned about midway between the two ends of a screen 432. Three (3) throughs streams 435, 436 and 437, in addition to an overs stream 438, are generated by this arrangement. Throughs streams 435, 436 and 437 each exploit a unique portion of the size-distribution gradient. If stream 435 were to be used in the product, the material would contain a high percentage of the finest particles available in the feed. If stream 437 were to constitute the product, very fine particles would be relatively scarce. If stream 436 were employed in the product, very fine particles would be present in an amount intermediate between the amounts of those particles available in streams 435 and 437. It is also evident that similar selective means could be used to acquire specific portions of the near-size overs for purposes of tailoring the size distribution of the product in the desired manner.

A larger number of additional options can be implemented by varying the position of catch tray 430 along the length of screen 432 as represented by arrow T. Instead of varying the position of catch tray 430 relative to screen 432, the effective length of the catch tray as measured in the direction of particle flow along the screen may be varied so as to receive throughs from a greater or lesser apertured screen length.

It is also evident that both the masking plate 410 and the catch tray 430 may be moved relative to their corresponding screen either by making the plate or tray the movable component and/or by making the corresponding screen the movable component. The possibility of still further embodiments exists through the use of more than one masking plate, more than one catch tray, other configurations of masking plates and/or catch trays, and/or combinations of such masking plates and catch trays.

What is claimed is:

1. A differential rate screening process for continuously screening a feed of particulate material to provide a product having a preselected size distribution substantially different from a predetermined size distribution of said feed which contains particles distributed among a plurality of substreams each of a different size class, said screening process comprising introducing a stream of said feed onto a screening member of a screen means, said screening member having apertures of sufficient size to pass at least one of said substreams as an undersize substream; separating said feed stream into at least a first throughs stream and one other first stream by causing part of said undersize substream to pass through the apertures of said screening member and into said first throughs stream at a first partial flow rate substantially greater than zero and substantially less than conventional flow rates at which said undersize substream would pass through the apertures of said screening member upon screening said undersize substream to provide essentially complete screening, said first partial flow rate being such as to provide control over the size distribution of said first throughs stream; and controlling said first partial flow rate so as to provide substantially said preselected size distribution in a particulate product stream comprising at least a portion of at least one of said first throughs stream and said other first stream.

2. The differential rate screening process of claim 1 in which said separating is conducted in screen means capable of selectively varying said first partial flow rate.

3. The differential rate screening process of claim 2 in which control means is provided for controllably varying said first partial flow rate.

4. The differential rate screening process of claim 2 in which said feed stream is introduced onto a screening member having apertures of sufficient size to pass at least two of said feed substreams as undersize substreams; in which said separating includes causing part of each of said undersize substreams to pass through the apertures of said screening member and into said first throughs stream at first partial flow rates substantially greater than zero and substantially less than conventional flow rates at which said undersize substreams would pass through the apertures of said screening member upon screening said undersize substreams to provide essentially complete screening, said first partial flow rates being such as to provide control over the size distribution of said first throughs stream; and in which said screen means is capable of selectively varying the relative flow rates at which said undersize substreams pass into said first throughs stream.

5. The screening process of claim 1, 2, or 4 in which said feed separation provides a substantial differential between the mass flow rate of at least one undersize substream in said feed stream and the mass flow rate at which said at least one undersize feed stream passes into said first throughs stream, in which said screen means has at least one screening parameter the value of which is variable so as to vary said substantial differential between said mass flow rates, and in which said screening process further includes controlling the value of said variable screening parameter.

6. The screening process of claim 5 in which said differential between the mass flow rates of said undersize feed substraam is at least 20% by weight of the mass flow rate of said undersize feed substream in said feed stream.

7. The screening process of claim 4, in which said screening member is a first screening member; in which said screen means includes a second screening member; and in which said process further comprises introducing a second stream of said feed onto said second screening member of said screen means in parallel with introducing a first stream of said feed onto said first screening member, said second screening member having apertures of sufficient size to pass at least two of said substreams as second undersize substreams; separating said second feed stream into at least a second throughs stream and one other second stream by causing part of each of said second undersize substreams to pass through the apertures of said second screening member and into said second throughs stream at second partial flow rates substantially greater than zero and substantially less than conventional flow rates at which said second undersize substreams would pass through the apertures of said second screening member upon screening said second undersize substreams to provide essentially complete screening, said second partial flow rates being such as to provide control over the size distribution of said second throughs stream and said screen means being capable of selectively varying the relative flow rates at which said second undersize substreams pass into said second throughs stream; and controlling said first and second partial flow rates so as to provide substantially said preselected size distribution in a particulate product stream comprising a mixture of at least a portion of at least one of said first throughs stream and said other first stream and at least a portion of at least one of said second throughs stream and said other second stream.

8. The screening process of claim 7 in which at least one screening parameter of said screen means is variable so as to vary said first and second partial flow rates, respectively; and in which said screening process further includes controlling the value of said variable screening parameter.

9. The screening process of claim 4 in which said first throughs stream comprises a first portion of the total flow of particles passing through the apertures of said screening member.

10. The screening process of claim 9 in which said other first stream comprises a second portion of the total flow of particles passing through the apertures of said screening member, said second portion being collected as at least a portion of said other first stream before reaching said first throughs stream.

11. The screening process of claim 10 which further includes selectively varying the amounts of said first and second portions relative to one another.

12. The screening process of claim 11 in which control means is provided for controllably varying the relative proportions of said first and second portions.

13. The differential rate screening process of claim 4 in which control means is provided for controllably varying the relative flow rates at which said undersize substreams pass into said first throughs stream.

14. The screening process of claim 13 in which each of said different size classes is definable by a percentage of undersize particles in a sample of said feed passing through a corresponding sieve of a set of sieves each of a different mesh size of a preselected standard establishing different mesh sizes for the classification of particulate materials, and in which there is a differential between the mass flow rate of at least one undersize substream in said first throughs stream and the mass flow rate of said at least one undersize substream in said feed stream of at least five percent of the mass flow rate of said at least one undersize substream in said feed stream.

15. The screening process of claim 14 in which said differential between the mass flow rate of said at least one undersize substream in said first throughs stream and the mass flow rate of said at least one undersize substream in said feed stream is at least 20 percent of the mass flow rate of said at least one undersize substream in said feed stream.

16. The screening process of claim 14 in which said differential between the mass flow rate in said first throughs stream and the mass flow rate in said feed stream is in the range of about 20 to about 40 percent of the mass flow rate in said feed stream for each of said at least two undersize substreams.

17. The screening process of claim 14 in which said preselected distribution of particle sizes is substantially ASTM Specification C-33 for stonesand.

18. The screening process of claim 14 in which said preselected distribution of particle sizes is substantially ASTM Specification C-33 for stonesand.

19. The differential rate screening process of claim 13 in which said screening member is a first screening member and said screen means includes a second screening member, and in which said process further comprises introducing onto said second screening member and screening thereon an input stream comprising at least a portion of at least one of said first throughs stream and said other first stream so as to provide at least a second throughs stream and one other second stream, and in which said product stream comprises at least a portion of at least one of said second throughs stream and said other second stream.

20. The screening process of claim 19 in which said input stream is further comprised of a second stream of said feed material bypassing said first screening member.

21. The screening process of claim 19 in which said input stream is comprised of a throughs stream from said first screening member, said other second stream is a second overs stream from said second screening member, and said product stream is comprised of at least a portion of said second overs stream.

22. The screening process of claim 19 in which said input stream is comprised of a throughs stream from said first screening member, and said product stream is comprised of at least a portion of said second throughs stream.

23. The screening process of claim 19 in which said input stream is comprised of an overs stream from said first screening member, and said product stream is comprised of at least a portion of a second overs stream from said second screening member.

24. The screening process of claim 19 in which said input stream is comprised of an overs stream from said first screening member, and said product stream is comprised of at least a portion of said second throughs stream.

25. The screening process of claim 4 or 13 in which each of said different size classes is definable by a weight percentage of undersize particles in a particulate sample passing through a corresponding sieve of a set of sieves each of a different mesh size of a preselected standard establishing different mesh sizes for the classification of particulate materials; in which said at least two undersize substreams are caused to pass into said first throughs stream at substantially different mass flow rates; and in which said screening process includes controlling a differential between said mass flow rates.

26. The screening process of claim 25 in which at least 20% by weight of the undersize substream having the smaller of said mass flow rates is retained on said screening member.

27. The screening process of claim 13 which further includes prescreening a stream of particulate material by passing a plurality of substreams each of a different size class through the apertures of at least one prescreening member so as to provide said predetermined size distribution in said feed stream.

28. The screening process of claim 27 in which a second stream of said particulate material bypasses said prescreening member.

29. The process of claim 13 or 3 in which said control is provided in response to a control signal from a signal generating means.

30. The screening process of claim 13 in which said screen means has at least one screening parameter the value of which is variable so as to vary said relative flow rates, and in which said screening process includes controllably varying the value of said variable screening parameter.

31. The screening process of claim 30 in which said variable screening parameter is the flow rate of said feed stream.

32. The screening process of claim 30 in which said variable screening parameter is the distribution of particle sizes in said feed stream.

33. The screening process of claim 30 in which the value of said at least one variable screening parameter is controlled in response to a measured characteristic of at least one of said feed stream, said product stream, said throughs stream and said other stream of said screening process.

34. The screening process of claim 33 which further includes taking a sample of said at least one stream at least once during said screening process, and in which said at least one measured characteristic is a function of a distribution of particle sizes in said sample.

35. The screening process of claim 34 in which said at least one measured characteristic is a fineness modulus of said sample.

36. The screening process of claim 30 in which said at least one measured characteristic is an average particle size of said sample.

37. The screening process of claim 34 in which said at least one measured characteristic is a median particle size of said sample.

38. The screening process of claim 30 in which said variable screening parameter is the mass flow rate of said feed stream.

39. The screening process of claim 30 in which said variable screening parameter is a distribution of particle sizes in said feed stream.

40. The screening process of claim 39 which further includes the step of crushing rocks of particle sizes larger than said feed particle sizes to provide a reduction in the particle sizes of said rocks to the sizes of particles in said feed stream, and changing said particle size reduction provided by said crushing step so as to vary the distribution of particle sizes in said feed stream.

41. The screening process of claim 1, 2, 4, 13 or 30 in which said feed stream contains a mass flow of undersize particles the largest of which is smaller than the average size of said apertures in said screening member by at least one mesh size of a preselected standard establishing different mesh sizes for the classification of particulate materials, and in which at least 20% by weight of said mass flow of undersize particles in said feed stream is retained on said screening member.

42. The screening process of claim 41 in which the largest of the undersize particles in said mass flow is smaller than the average size of said apertures in said screening member by at least two of said standard mesh sizes.

43. The screening process of claim 13 or 3 in which said screen means has at least one screening parameter the value of which is variable so as to vary a differential between the mass flow rate of at least one undersize substream in said feed stream and the mass flow rate at which said at least one undersize substream passes into said first throughs stream, and in which said screening process includes controlling the value of said variable screening parameter.

44. The screening process of claim 43 in which said control means includes means for automatically varying the value of said at least one variable screening parameter, and in which said value is automatically controlled in response to said at least one measured characteristic.

45. The screening process of claim 13 or 3 which further includes the step of crushing rocks of particle sizes larger than said feed particle sizes to reduce the particle sizes of said rocks so as to provide said predetermined distribution of particle sizes in said feed, said particle size reduction provided by said crushing step being controllably variable, in which said one other first stream is an overs stream from said first screening member and at least a portion of said overs stream is recycled to said crushing step and introduced onto said first screening member as part of said feed stream, and in which said variable size reduction is controlled.

46. The screening process of claim 45 in which said one other first stream is an overs stream from said first screening member and at least a portion of said overs stream is recycled to said crushing step and introduced onto said screening member as part of said feed stream.

47. A differential rate screening apparatus for continuously screening a feed of particulate material so as to provide a product having a preselected size distribution substantially different from a predetermined size distribution of said feed which has particles distributed among a plurality of substreams each of a different size class, said screening apparatus comprising screen means having a screening member; feed means for introducing a stream of said feed onto said screening member, said screening member having apertures of sufficient size to pass at least one of said substreams as an undersize substream; separation means for separating said feed stream into at least a first throughs stream and one other first stream by causing a part of said undersize substream to pass through the apertures of said screening member and into said first throughs stream at a first partial flow rate substantially greater than zero and substantially less than conventional flow rates at which said undersize substream would pass through the apertures of said screening member upon screening said undersize substream to provide essentially complete screening, said first partial flow rate being such as to provide control over the size distribution of said first throughs stream; and control means for controlling said first partial flow rate so as to provide substantially said preselected size distribution in a particulate product stream comprising at least a portion of at least one of said first throughs stream and said other first stream.

48. The differential rate screening apparatus of claim 47 in which said control means includes means for controllably varying said first partial flow rate.

49. The screening apparatus of claim 47 in which said screen means is a first screen means having a first screening member; and in which said apparatus further comprises second screen means having a second screening member, second feed means for introducing a second stream of said feed onto said second screening member in parallel with a first feed stream introduced onto said first screening member, said second screening member having apertures of sufficient size to pass at least one of said feed substreams as a second undersize substream, second separation means for separating said second feed stream into at least a second throughs stream and one other second stream by causing part of said second undersize substream to pass through the apertures of said second screening member and into said second throughs stream at a second partial flow rate substantially greater than zero and substantially less than conventional flow rates at which said second undersize substream would pass through the apertures of said second screening member upon screening said second undersize substream to provide essentially complete screening, said second partial flow rate being such as to provide control over the size distribution of said second throughs stream, and second control means for controlling said second partial flow rate so as to provide substantially said preselected size distribution in a particulate product stream comprising a mixture of at least a portion of at least one of said first throughs stream and said other first stream and at least a portion of at least one of said second throughs stream and said other second stream.

50. The apparatus of claim 49 in which said first screen means has at least one screening parameter the value of which is variable so as to vary said first partial flow rate, in which said second screen means has at least one screening parameter the value of which is variable so as to vary said second partial flow rate, and in which said first and second control means include varying means for controllably varying the value of said variable screening parameters.

51. The differential rate screening apparatus of claim 47 in which said screening member has apertures of sufficient size to pass at least two of said substreams as undersize substreams; in which said separation means causes part of each of said undersize substreams to pass through the apertures of said screening member and into said first throughs stream at first partial flow rates substantially greater than zero and substantially less than conventional flow rates at which said undersize substreams would pass through the apertures of said screening member upon screening said undersize substreams to provide essentially complete screening, said first partial flow rates being such as to provide control over the size distribution of said first throughs stream; and in which said control means includes means for controllably varying the relative flow rates at which said undersize substreams pass into said first throughs stream.

52. The screening apparatus of claim 51 in which each of said different size classes is definable by a weight percentage of undersize particles in a particulate sample passing through a corresponding sieve of a set of sieves each of a different mesh size of a preselected standard establishing different standard mesh sizes for the classification of particulate materials; in which said separation means includes means for causing said two undersize substreams to pass into said first throughs stream at substantially different mass flow rates; and in which said control means includes means for controlling a differential in said mass flow rates.

53. The screening apparatus of claim 52 in which at least 20% by weight of the undersize substream having the smaller of said mass flow rates is retained on said screening member.

54. The screening apparatus of claim 51 in which said screening member is a first screening member; in which said screen means includes a second screening member;

in which said apparatus further includes input means for introducing onto said second screening member and screening thereon at least one input stream comprising at least a portion of at least one of said first throughs stream and said other first stream so as to provide at least a second throughs stream and one other second stream; and in which said product stream comprises at least a portion of at least one of said second throughs stream and said other second stream.

55. The screening apparatus of claim 54 in which said screen means has at least one screening parameter, the value of which is variable so as to vary the relative rates at which said at least two substreams pass into said first throughs stream, and in which said control means includes varying means for controllably varying said variable screening parameter.

56. The screening apparatus of claim 47 in which said separation means includes means for providing a substantial differential between the mass flow rate of at least one undersize substream in said feed stream and the mass flow rate at which part of said at least one undersize feed substream passes into said first throughs stream, in which said screen means has at least one screening parameter the value of which is variable so as to vary said substantial differential between said mass flow rates, and in which said control means includes means for controlling the value of said variable screening parameter.

57. The screening apparatus of claim 51 or 56 in which said control means includes means for generating a control signal and means for providing said control in response to said control signal.

58. The screening apparatus of claim 47, 48 or 51 in which said feed stream contains a mass flow of undersize particles the largest of which is smaller than the average size of said apertures in said screening member by at least one mesh size of a preselected standard establishing different standard mesh sizes for the classification of particulate materials, and in which said separation means includes means for causing at least 20% by weight of said mass flow of undersize particles in said feed stream to be retained on said screening member.

59. The screening apparatus of claim 58 in which the largest of the undersize particles in said mass flow is smaller than the average size of said apertures in said screening member by at least two of said standard mesh sizes.

60. The screening apparatus of claim 51 in which said screen means has at least one screening parameter the value of which is variable so as to vary the relative rates at which said at least two substreams pass into said throughs stream, and in which said control means includes varying means for controllably varying the value of said variable screening parameter.

61. The screening apparatus of claim 60 in which said screening member has apertures distributed throughout an areal extent extending for a fixed distance in a direction of flow of said feed stream, said fixed distance defining a total apertured length of said screening member; in which said variable screening parameter is an effective screening length of said screening member, said effective screening length being adjustable over a range between said total apertured length and a minimum apertured length; and in which said varying means includes means for adjusting said effective screening length between said total apertured length and said minimum apertured length.

62. The screening apparatus of claim 61 in which said effective screening length is that portion of said total apertured length of said screening member exposed to particles of said feed stream, and in which said varying means includes means for varying said effective screening length by changing the location at which said feed stream is introduced onto said screening member.

63. The screening apparatus of claim 61 in which said effective screening length is defined by a blocking member arranged to intercept a portion of said feed stream after said feed stream is introduced onto said screening member but before substantially all of said at least two undersize substreams in said feed stream have passed through the apertures of said screening member, and in which said varying means includes means for varying said effective screen length by changing the location at which said blocking nember intercepts said portion of said feed stream.

64. The screening apparatus of claim 61 in which said effective screening length is defined by a collecting member arranged to intercept a portion of the throughs passing through apertures within an exposed apertured length of said screening member exposed to particles of said feed stream, said portion of throughs being intercepted before reaching said first throughs stream, and in which said control means includes means for varying said effective screening length of said screening member by changing the location at which said collecting member intercepts said portion of throughs.

65. The screening apparatus of claim 61 in which said effective screening length is adjustable so as to vary the total number of apertures of said screening member exposed to particles of said feed stream.

66. The screening apparatus of claim 65 in which the number of apertures in a unit area of said screening member varies in said direction of feed flow over said screening member.

67. The screening apparatus of claim 65 in which the total number of apertures exposed to said feed stream is varied by changing the location at which said feed stream is introduced onto said screening member.

68. The screening apparatus of claim 61 in which the apertures of said screening member vary in size, and said effective screening length is adjustable so as to vary the size of apertures exposed to particles of said feed stream.

69. The screening apparatus of claim 68 in which the apertures of said screening member vary in size in said direction of feed flow over said screening member, and in which the size of apertures exposed to said feed stream is varied by changing the location at which said feed stream is introduced onto said screening member.

70. The screening apparatus of claim 68 in which said aperture size is varied by changing the ratio between total opening area of apertures within a unit of apertured area and the total area of solid structure within said unit of apertured area.

71. The screening apparatus of claim 60 which further includes means for crushing rocks of particle sizes larger than said feed particle sizes to reduce the particle sizes of said rocks so as to provide said predetermined distribution of particle sizes in said feed, said particle size reduction provided by said crushing means being controllably variable by said control means.

72. The screening apparatus of claim 61 in which said screening member is inclined relative to a horizontal plane at an angle of inclination and said variable screening parameter is said angle of inclination of said screening member relative to said horizontal plane.

73. The screening apparatus of claim 60 in which said control means includes means for controllably varying the value of said at least one variable screening parameter in response to a measured characteristic of at least one of said feed stream, said product stream, said throughs stream and said other stream of said screening apparatus.

74. The screening apparatus of claim 73 in which said control means includes means for automatically varying the value of said at least one variable screening parameter in response to said at least one measured characteristic.

75. The screening apparatus of claim 74 in which said measured characteristic is a mass flow rate.

76. The screening apparatus of claim 73 which further includes a means for taking a sample of at least one of said feed stream, said product stream, said throughs stream and said other stream at least once during operation of said screening apparatus and screening said sample essentially to completion on at least one separate measuring screen, said at least one measured characteristic being a weight fraction of a portion of said sample separated by said at least one measuring screen.

77. The screening apparatus of claim 73 in which said at least one measured characteristic is a ratio between at least two mass flow rates.

78. The screening apparatus of claim 60 in which said screening member is subjected to vibratory motion and said variable screening parameter is at least one of the frequency, amplitude or wave form of said vibratory motion.

79. The screening apparatus of claim 56 in which said differential between said mass flow rates is at least 20% by weight of the mass flow rate of said undersize substream in said feed stream.

* * * * *